US009217614B2

(12) United States Patent
Pizano

(10) Patent No.: US 9,217,614 B2
(45) Date of Patent: Dec. 22, 2015

(54) FIREARM HAVING AN ARTICULATED BOLT TRAIN WITH TRANSVERSALLY DISPLACING FIRING MECHANISM, DELAY BLOWBACK BREECH OPENING, AND RECOIL DAMPER

(76) Inventor: Jorge Pizano, Cordova, TN (US)

( * ) Notice: Subject to any disclaimer, the term of this patent is extended or adjusted under 35 U.S.C. 154(b) by 342 days.

(21) Appl. No.: 13/385,262

(22) Filed: Feb. 10, 2012

(65) Prior Publication Data

US 2012/0240760 A1 Sep. 27, 2012

Related U.S. Application Data

(60) Provisional application No. 61/463,034, filed on Feb. 11, 2011.

(51) Int. Cl.
*F41A 5/00* (2006.01)
*F41A 5/24* (2006.01)
*F41A 3/26* (2006.01)

(52) U.S. Cl.
CPC ... *F41A 5/24* (2013.01); *F41A 3/26* (2013.01); *Y10T 29/49826* (2015.01)

(58) Field of Classification Search
CPC ..... F41A 5/24; F41A 3/26
USPC ..... 89/191.01, 184, 194, 125; 42/16
See application file for complete search history.

(56) References Cited

U.S. PATENT DOCUMENTS 447,836 A * 3/1891 Maxim ..... 89/143
574,189 A * 12/1896 Carr ..... 89/144
918,447 A * 4/1909 Hepburn ..... 89/139
930,865 A * 8/1909 Keith et al. ..... 89/145
1,080,268 A * 12/1913 Dawson et al. ..... 89/23
1,293,022 A * 2/1919 Browning ..... 89/142
1,322,053 A * 11/1919 Reising ..... 89/144
1,452,123 A * 4/1923 McCrudden ..... 89/129.01
1,457,961 A * 6/1923 Browning ..... 89/145
1,464,864 A * 8/1923 Browning ..... 89/184
1,497,096 A * 6/1924 Eriksen ..... 89/149
1,835,715 A * 12/1931 McCoy ..... 89/197
2,365,188 A * 12/1944 Gorton ..... 89/197
2,476,232 A * 7/1949 Williams ..... 89/182
2,499,090 A * 2/1950 Browning ..... 89/176
2,555,379 A * 6/1951 Simpson ..... 89/186
2,732,768 A * 1/1956 Browning ..... 89/182
3,000,268 A * 9/1961 Robinson ..... 89/189

(Continued)

*Primary Examiner* — Michelle R Clement
(74) *Attorney, Agent, or Firm* — Hulsey Hunt & Parks, PC; William S. Parks

(57) ABSTRACT

An improved firearm having an Pivotally Articulated Bolt Train assembly consisting of a series of linked carriages, containing firing mechanisms, placed inside a compact ergonomic jaw articulated receiver, holding all the sub assemblies in the convenient location, synchronizing the movements of all the components, and controlling its alternating motion by displacing along divergent and converging paths and tracks, where the Bolt Train, moving through tracks, displaces to align, entirely horizontally, with the barrel axis, rapidly shifting into a curved and transverse path. Such motion forces the cocking, the partial displacement into a Handle Tunnel, and modifies the bearing of the recoil force, conveying a unique dynamic behavior. When displacing rearwards it generates a dual transient angular momentum vector helping to compensate the "barrel Torque" phenomenon caused by the bullet rifling when fired. The interaction of several components delays the breech opening, decelerating the rearwards motion to assist the recoil damping.

8 Claims, 52 Drawing Sheets

(56) References Cited

U.S. PATENT DOCUMENTS

| | | | | | |
|---|---|---|---|---|---|
| 3,251,270 | A | * | 5/1966 | Seifried | 89/177 |
| 3,301,712 | A | * | 1/1967 | Bach | 429/100 |
| 3,489,060 | A | * | 1/1970 | Marocchi | 89/139 |
| 3,540,141 | A | * | 11/1970 | Butler | 42/17 |
| 3,554,077 | A | * | 1/1971 | Schlapia, Jr. | 89/194 |
| 3,564,077 | A | * | 2/1971 | Brinkmann et al. | 525/173 |
| 3,568,565 | A | * | 3/1971 | Swieskowski | 89/198 |
| 3,580,132 | A | * | 5/1971 | Vartanian | 89/130 |
| 3,641,867 | A | * | 2/1972 | Junker | 89/1.704 |
| 3,650,060 | A | * | 3/1972 | Schubert | 42/1.06 |
| 3,661,049 | A | * | 5/1972 | Perrine | 89/189 |
| 3,683,534 | A | * | 8/1972 | Davis | 42/1.06 |
| 3,748,961 | A | * | 7/1973 | Perrine | 89/189 |
| 3,783,739 | A | * | 1/1974 | Perrine | 89/189 |
| 3,861,274 | A | * | 1/1975 | Perrine | 89/180 |
| 4,052,926 | A | * | 10/1977 | Tollinger | 89/1.4 |
| 4,088,057 | A | * | 5/1978 | Nasypany | 89/1.701 |
| 4,112,605 | A | * | 9/1978 | Staub | 42/1.06 |
| 4,126,077 | A | * | 11/1978 | Quesnel | 89/1.704 |
| 4,164,825 | A | * | 8/1979 | Hutchison | 42/1.06 |
| 4,167,890 | A | * | 9/1979 | Adams | 89/189 |
| 4,172,408 | A | * | 10/1979 | Ayler et al. | 89/7 |
| 4,183,282 | A | * | 1/1980 | Perrine | 89/189 |
| 4,279,091 | A | * | 7/1981 | Edwards | 42/1.06 |
| 4,301,712 | A | * | 11/1981 | Cristina | 89/153 |
| 4,369,759 | A | * | 1/1983 | Gerstenberger et al. | 124/68 |
| 4,373,519 | A | * | 2/1983 | Errede et al. | 602/43 |
| 4,391,180 | A | * | 7/1983 | Koine | 89/129.01 |
| 4,398,116 | A | * | 8/1983 | Lewis | 310/334 |
| 4,439,943 | A | * | 4/1984 | Brakhage | 42/74 |
| 4,447,975 | A | * | 5/1984 | Ljutic | 42/16 |
| 4,492,050 | A | * | 1/1985 | Kagehiro | 42/1.06 |
| 4,503,632 | A | * | 3/1985 | Cuevas | 42/1.06 |
| 4,506,589 | A | * | 3/1985 | Junker et al. | 89/190 |
| 4,514,921 | A | * | 5/1985 | Burkleca | 42/1.06 |
| H211 | H | * | 2/1987 | Vanderbeck | 42/17 |
| 4,718,841 | A | * | 1/1988 | Kiya | 425/149 |
| 4,719,841 | A | * | 1/1988 | Perrine | 89/189 |
| 4,753,230 | A | * | 6/1988 | Carus et al. | 602/47 |
| 4,769,937 | A | * | 9/1988 | Gregory et al. | 42/74 |
| 4,840,107 | A | * | 6/1989 | Weldon | 89/8 |
| 4,867,038 | A | * | 9/1989 | Metz | 89/43.01 |
| 4,910,904 | A | * | 3/1990 | Rose | 42/74 |
| 4,938,116 | A | * | 7/1990 | Royster | 89/198 |
| 4,969,880 | A | * | 11/1990 | Zamierowski | 604/305 |
| 4,974,493 | A | * | 12/1990 | Yeffman | 89/198 |
| 4,986,018 | A | * | 1/1991 | McDonald, Jr. | 42/1.06 |
| 5,031,348 | A | * | 7/1991 | Carey | 42/74 |
| 5,069,110 | A | * | 12/1991 | Menck | 89/198 |
| 5,138,931 | A | * | 8/1992 | Brookshire | 89/161 |
| 5,202,530 | A | * | 4/1993 | Stephens | 89/7 |
| 5,343,649 | A | * | 9/1994 | Petrovich | 42/1.06 |
| 5,445,604 | A | * | 8/1995 | Lang | 602/47 |
| 5,519,957 | A | * | 5/1996 | Iannetta | 42/74 |
| 5,520,019 | A | * | 5/1996 | Schuetz | 42/49.02 |
| 5,524,374 | A | * | 6/1996 | Gernstein | 42/1.06 |
| 5,581,046 | A | * | 12/1996 | Weldle et al. | 89/196 |
| 5,585,590 | A | * | 12/1996 | Ducolon | 89/42.01 |
| 5,596,161 | A | * | 1/1997 | Sommers | 89/14.2 |
| 5,614,691 | A | * | 3/1997 | Taylor | 89/128 |
| 5,669,173 | A | * | 9/1997 | Rodney, Jr. | 42/124 |
| 5,678,345 | A | * | 10/1997 | Gnade | 42/97 |
| 5,682,007 | A | * | 10/1997 | Dobbins | 89/187.02 |
| 5,722,195 | A | * | 3/1998 | Bentley et al. | 42/74 |
| 5,758,447 | A | * | 6/1998 | Venetz | 42/94 |
| 5,782,875 | A | * | 7/1998 | Ledbetter | 607/2 |
| 5,811,714 | A | * | 9/1998 | Hull et al. | 89/14.3 |
| 5,811,720 | A | * | 9/1998 | Quinnell et al. | 89/37.04 |
| 5,844,162 | A | * | 12/1998 | Renner | 89/14.3 |
| 5,908,693 | A | * | 6/1999 | Delgado et al. | 428/343 |
| 5,909,002 | A | * | 6/1999 | Atchisson | 89/130 |
| 5,911,173 | A | * | 6/1999 | Westrom | 89/185 |
| 5,952,602 | A | * | 9/1999 | Gussalli Beretta | 89/196 |
| 5,954,679 | A | * | 9/1999 | Baranitsky | 602/41 |
| 5,979,098 | A | * | 11/1999 | Griggs | 42/73 |
| 5,983,549 | A | * | 11/1999 | Battaglia | 42/17 |
| 6,044,748 | A | * | 4/2000 | Westrom | 89/185 |
| 6,045,942 | A | * | 4/2000 | Miekka et al. | 429/124 |
| 6,055,760 | A | * | 5/2000 | Cuson et al. | 42/74 |
| 6,079,138 | A | * | 6/2000 | Meaker | 42/17 |
| 6,079,311 | A | * | 6/2000 | O'Quinn et al. | 89/14.4 |
| 6,196,108 | B1 | * | 3/2001 | Murello | 89/44.02 |
| 6,234,058 | B1 | * | 5/2001 | Morgado | 89/33.03 |
| 6,243,978 | B1 | * | 6/2001 | Vignaroli et al. | 42/17 |
| 6,269,727 | B1 | * | 8/2001 | Nigge | 89/14.3 |
| 6,305,115 | B1 | * | 10/2001 | Cook | 42/74 |
| 6,343,536 | B1 | * | 2/2002 | Rossier et al. | 89/161 |
| 6,357,157 | B1 | * | 3/2002 | Constant et al. | 42/84 |
| 6,418,833 | B1 | * | 7/2002 | Hajjar | 89/199 |
| 6,463,336 | B1 | * | 10/2002 | Mawhinney | 607/156 |
| 6,532,876 | B1 | * | 3/2003 | Ramirez et al. | 102/430 |
| 6,585,670 | B2 | * | 7/2003 | Augustine et al. | 602/2 |
| 6,838,589 | B2 | * | 1/2005 | Liedtke et al. | 602/58 |
| 7,078,582 | B2 | * | 7/2006 | Stebbings et al. | 602/57 |
| 7,201,094 | B2 | * | 4/2007 | Jebsen et al. | 89/189 |
| 2002/0053156 | A1 | * | 5/2002 | McCarthy | 42/74 |
| 2002/0139241 | A1 | * | 10/2002 | Butler | 89/191.01 |
| 2003/0051600 | A1 | * | 3/2003 | Breuer et al. | 89/37.14 |
| 2003/0056639 | A1 | * | 3/2003 | Giza | 89/1.701 |
| 2004/0025680 | A1 | * | 2/2004 | Jebsen et al. | 89/199 |
| 2004/0069137 | A1 | * | 4/2004 | Jebsen et al. | 89/198 |
| 2004/0069138 | A1 | * | 4/2004 | Jebsen et al. | 89/198 |
| 2010/0077643 | A1 | * | 4/2010 | Kerbrat et al. | 42/1.06 |

* cited by examiner

SCHEMATIC PLACEMENT OF COMPONENTS IN A PISTOL.

FIREARM HAVING AN ARTICULATED BOLT TRAIN WITH TRANSVERSALLY DISPLACING FIRING MECHANISM, DELAY BLOWBACK BREECH OPENING, AND RECOIL DAMPER

CROSS REFERENCE TO RELATED APPLICATIONS

This Application claims the benefit of Provisional Patent Application Ser. No. 61/463,034 filed on Feb. 11, 2011 by the present inventor.

TERMS AND DEFINITIONS

"Train" is a series of pivotally interlinked carriages that move in a plane along tracks in a reciprocating manner capable of transmitting force.

The terms "Articulated Bolt Train", "Articulated Bolt", "Bolt Train", "Bolt Train sub assembly", "Bolt Train Assembly", "Bolt Train Mechanism", "Pivotally Articulated Bolt Train", are used indistinctively.

The terms "Front Bolt", "Bolt Head", "Head Bolt" and "Bolt" refer to the first member of the Bolt Train. These terms may be used alternatively.

The terms "Axial Force" or "axial recoil force" refer to that one occurring in the direction of the axis of the barrel of the firearm or bore axis when the firearm is discharged.

The terms "Carrier", "Carrier Housing", "Mechanism Carriage Housing", "Carriage", refer to a hollow train member, track mounted box, displaceable, solid structural member link, capable of containing and controlling mechanisms placed within, are used indistinctively.

The term "forward direction" is referred as the one having the direction of the projectile when fired.

The term "rearward direction" is the one opposite to forward or muzzle wards.

The term "transverse" is used to define a course oblique to the bore axis of the barrel.

The term "hammer" is used to designate a moving part propelled linearly at the impulse of a spring. This can be also referred as a striker, or slide striker hammer.

The terms "slot tracks guides", and slot channel guides are used indistinctively.

The terms "charging handle" and cocking handle are used indistinctively.

The term "Protruding Guides" is used to refer to the protruding elements that run and slide into the Slot tracks guides, Also referred as "protruding shapes", or "side projections", "lateral projections" or "lugs". They serve as mobile contact joints to the track.

The term "Trunnion" is used to refer to a part where the barrel is mounted, and in turn it is mounted to the receiver.

The term "mechanical disadvantage" is used in opposition to "mechanical advantage" term when the ratio of output force/input force in a mechanism is less than 1

The term "impulse", in mechanics, is something that changes the momentum of an object.

The term "impulse" is the integral of a force with respect to time.

Terms such as "under," "over," "in front of," "the back of the gun," or "behind," "anterior," "posterior," "downward," "upward," or "transverse," are used here as somebody firing a gun would understand them, which is by reference to the longitudinal or firing axis of the barrel when the gun is held in the usual horizontal attitude.

Also, a force component perpendicular to or lateral to the longitudinal axis of the barrel refers to a vectorial component or part of a force or momentum vector directed outside the longitudinal axis of the barrel.

The term "horizontal" is used to refer to a line being parallel or concentric to the axis of the barrel The term "vertical" is used to refer to a direction perpendicular to horizontal.

The term "bearing" is the direction or path along which something moves or along which it lays while moving.

"Kinematics" is the branch of mechanics concerned with the motion of objects without reference to the forces that cause the motion. The features or properties of motion in an object, regarded in such a way.

Kinematics is used in Mechanical engineering to describe the motion of systems composed of joined parts (multi-link systems).

"Link" is a nominally rigid body that possess at least two nodes

"Node" is an attachment point to other links via joints

A "joint" is a connection between two or more links (at their nodes), which allows some motion, or potential motion, between the connected links.

"Joints" (also called kinematic pairs) can be classified in several ways:

A "rolling contact" joint also counts as a one-degree-of-freedom revolute joint capable of rotating about its longitudinal axis.

A "Spring" is a link classified as "compliant" meaning yielding, may be grounded to a frame of reference. When grounded can store energy.

The term "ground link" acts as a reference for all motions of the other links, and attached to it is a power input device usually a motor or another link. It may be mobile.

A "Kinematic Chain" is defined as an assemblage of links and joints, interconnected in a way to provide a controlled output motion in response to a supplied input motion.

"Revolute" (r) is a kind of joint also called "pin joint", "hinge pin", "hinge joint", or "pivot", allowing rotary planar motion only (around an axis perpendicular to the plane on which the motion occurs) where the pin and the pin hole are perfectly round. It has one degree of freedom per link. The revolute joint may be open or closed; it allows the planar rotation of two bodies in contact about an axis that is common to both contacting parts.

The terms "Prismatic (p) joint": also called a "slider" or "sliding joint" designates a joint displacing linearly only along a plane.

A joint with more than one freedom may also be a "higher pair".

To "pivot" (verb) to rotate about the axis of a pin perpendicular to the plane about which the planar motion takes place.

"A Pin in slot" is a kind of joint (a higher pair) where a pin allows a link to rotate and the pin itself can slide in the slot. The geometry keeps the joint constrained or closed. It has two degrees of freedom per joint.

The "half joint" is also called a "roll-slide joint" because it allows both rolling and sliding.

The "order" of a link indicates the number of joints to which the link is connected (or number of nodes per link)

A "binary" link is a link with two nodes.

A "carriage" is a binary type of link with "pivot joints" and with a cavity to contain mechanisms using the carriage as ground.

The term "ground" is defined as any link or links that are fixed (nonmoving) with respect to the reference frame. Note that the reference frame may in fact itself be in motion.

Based on Reuleaux's classifications of the kinematic chain, mechanism, and machine.

A "mechanism" is a kinematic chain in which at least one link is connected or attached to a frame of reference (ground) where the ground is also counted as a link (which itself may be in motion).

A "machine" is defined as a combination of resistant bodies arranged to compel the mechanical forces of nature to do work accompanied by determinate motions.

"Dyad" is an open kinematic chain of two binary links and one joint.

A "track" is a grounded link to connect with mobile joints.

"Pure rotation" motion the body possesses one point (center of rotation) that has no motion with respect to the "stationary" frame of reference. all other points on the body describe arcs about that center. a reference line drawn on the body through the center changes only it's angular orientation.

"Pure translation" all points on the body describe parallel (curvilinear or rectilinear) paths. A reference line drawn on the body changes its linear position but does not change its angular orientation.

"Complex motion" is a simultaneous combination of rotation and translation.

Any reference line drawn on the body will change both its linear position and its angular orientation. Points on the body will travel nonparallel paths, and there will be, at every instant, a center of rotation, which will continuously change location.

A "revolute", or "pin joint" is a connection between two or more links (at their nodes), which allows Pure Rotation only between the connected links.

The term "Angle of articulation" refers to the angular displacement about a revolute pin connecting two train members, defined by the (incremental change) angle formed by longitudinal axes of two adjacent the members of the Pivotally Articulated Bolt Train measured at the intersection point of said axis or at the revolute joint as depicted in FIG. 17A The term "cocking" meaning to set the hammer of (a firearm) in a position ready for firing.

The terms "objectives" or "purposes" are used indistinctively.

BACKGROUND OF INVENTION

1. Field

This invention generally relates to a firearm having a collection of mechanisms and arrays, conceived to manage recoil by changing the dynamic behavior of the weapon when firing, in a manner that redirects forces, creates delays, decelerates motion, and lowers significantly the center of gravity, resulting in an improvement of the handling of the gun, accommodating the subassemblies in an array, and receiver, being compact, portable ergonomic, with a low center of gravity, and capable of functioning with large rifle cartridges.

Specially In one embodiment, this invention is about a firearm having an Articulated Bolt Train 90 FIG. 9 and FIG. 9A, FIG. 12 TO FIG. 12C and a by design Receiver 66 FIG. 10B, FIG. 11B, FIG. 12B, FIG. 12C that operates in conjunction. In order to function properly, the Bolt Train 90 has to be placed inside a Receiver 66 that controls and governs its path, and holds all the sub assemblies in the convenient location allowing the synchronic movements of all the components to take place. The Receiver 66 FIG. 10 A, FIG. 20 can have different shapes, dimensions, and proportions to be used in several applications as shown in FIG. 18.

The Articulated Bolt Train 90 consists of a Front Bolt of either Types 20, 20A or 20B, as shown in FIG. 2B, initially moving along the bore axis, articulately linked at the rear to a Mechanism Carriage Housing 40 types 40 or 40B as shown in FIG. 4, FIG. 4A, FIG. 4B, containing The Active Firing Mechanisms. The Mechanism Carriage Housing 40 displaces transversally, articulately linked at the rear to another optional carriage displacing transversally also comprising a Recoil Damper Sub Assembly 64 FIG. 4B. The Articulated Train Bolt 90 is track mounted on slot Channel guides 80 FIG. 10A embedded or supported laterally inside the receiver 66, directing a transversal path. In This invention the conventional firing, mechanisms assembly is separated physically in two different groups. The Active Firing Mechanisms subassembly 39 FIG. 5B comprise the hammer, the hammer spring, the sear, sear lever; all of them placed inside a moveable mechanisms carriage housing 40 and are an integral part of the Bolt Train 90. The controlling firing mechanisms subassembly 74 FIG. 5B, FIG. 5C comprise the trigger 75, the lever 76, the safe 77, the column spring fire actuator, and disengager 78 which are housed in a stationary compact small frame 79 in a convenient fixed location. The Fire Actuator and Disengager or disconnector 78A can be of a solid piece sustained by a convenient spring mounted support, enabling its deflection, after being pushed aside by the sear protrusion portion on the forward displacement after firing. Part 78, or alternatively part 78A, have al dual function: pushing the sear out of the engaging surface with the Mechanism Carriage Housing 40, and serving as disconnector for the semiautomatic firing mode.

The Active Firing Mechanisms subassembly 39 compact mechanism array integrates its mass and its volume to the Bolt Train 90 and significantly reduces the number of parts, volume, weight, and lowers the center of gravity, resulting in an effective recoil management absorbing system for automatic or semiautomatic firearms.

2. Background Prior Art

Previously, in firearms, the use of articulated or toggled bolts and connecting masses to control recoil is very old. When recoiling, these types of mechanisms displace in a different direction of the barrel axis creating force vectors partially diverting the initial recoil force, away from the bore axis. Many guns generate impulses provoke perpendicular components to the to the axis of the barrel The use of this principle is present in the first known auto loading pistol invented by Hugo Borchardt in the C-93 pistol (1893), U.S. Pat. No. 577,183 of Feb. 16, 1897, and the same principle for displacing the bolt rearwards and the heavy connecting bars transversally to reduce the axial recoil is used by Georg Luger in (1898) U.S. Pat. No. 753,414, in the well known P-08 model. Both, Borchardt and Luger, were following the even earlier design of Hiram Maxim U.S. Pat. No. 317,161 of May 5, 1885 incorporating the toggle lock or knee principle. Borchardt and Luger had an exterior articulating bolt fixedly hinged grounded to the frame at the rear. A similar approach was taken by J. D. Pedersen U.S. Pat. No. 1,737,974 of Dec. 3, 1229, who opt to apply the toggle knee mechanism in a semiautomatic rifle for military use utilizing long rifle cartridges, in which the heavy link bars displaced upwards generating a large momentum vector upwards having a component perpendicular to the axis of the barrel. An application of this rifle was the T1 E3 in 30-06 cartridge. The rifle showed impressive recoil characteristics and the proved that by scaling up the dimensions of the knee toggle mechanism, previously used in pistols, could be used in large rifle cartridges.

An inconvenience of this rifle was the potential injure danger, to the firer, due to the upwards projection of bar links when discharged close to the body. Years later Walter E. Perrine obtained U.S. Pat. Nos. 3,630,119; 3,861,274; 3,709,091 for firing mechanisms in which the toggle knee principle mechanisms were used to displace the linkages downwards, internally to the receiver upon firing. Again, the displacement of mechanism masses away and downwards from the axis of the barrel had effect on the dynamic behavior of the weapon. All the above Perrine's applications were made in the development of pistol guns, which showed better stability and recoil distribution. Of particular interest is the patent of Walter E. Perrine, U.S. Pat. No. 3,783,739 of Jan. 8, 1974, which refers to an improved mechanism displacing a considerable mass downwards inside the receiver under aspect conditions that allowed a practical, dimensional, ergonomic shape without affecting the classic functional aesthetical silhouette. As a result, upon firing, the recoil force produced a considerable downwards impulse, having a substantial downwards component perpendicular to the axis of the barrel, becoming prior art to the series of patents presented several years later by Jebsen and Herbrat patents, which is one of the permanent predominant claims.

All the above mentioned patents are Kinematic Chains based in the Knee Toggle principle, having three binary links, pivotally connected, in which the rear joint of the Kinematic Chain was pivotally fixed or grounded to the receiver frame, therefore limiting the horizontal travel of the bolt to the length of the links, condition which conflicts with the compactness of the receiver when the articulation of the links occurs downwards. In addition it was a characteristic of this series of patents that that the chain mechanism, could not be placed in perfect alignment with the axis of the barrel when the bolt was closing the breech. A small misalignment of the pivot joints and the links with the axis of the barrel was a necessary condition to induce the rotation of the pivotally articulated links in a certain direction, upwards or downwards, and the displacement of the articulating links in that direction.

All the above mentioned mechanisms have limitations in the Bolt travel length in the horizontal axis; are voluminous in its operation, which disservices compactness; are a potential source of injure to the firer when discharged in a position close to body parts; cannot be placed in perfect alignment with the axis of the barrel; and due to the direct ground contact with the receiver frame by means of a pivot joint, it directly transmits to the receiver the prime horizontal component leading recoil impulse.

Several firearms recoil absorbing systems have been patented recently using similar principles that cause an inertia mass to move downwards or transversally by using the original recoil force, transforming it into two force vectors; Like U.S. Pat. No. 7,201,094 of Jan Henrik Jebsen. In previous inventions like U.S. Pat. No. 7,201,094, the firearm in which the bolt head is attached to an independent body or inertia mass without any mechanisms inside. It is just a sliding dead mass confined to move along a straight path upwards and downwards. The two bodies are connected by series of linked interconnected parts requiring the contact of sloped surfaces to force a displacement of the contacted body like a wedge action, some of them requiring sufficient margin of play, like a slotted guide, placed at an inclined angle at the end of one of the link bodies. A rod, belonging to the bolt, travels horizontally through a slotted guide forcing an inertia mass or slider to move downwards A rod placed transversally to the bolt becomes the contact point between the bolt and the inertia mass. As the bolt travels horizontally it pushes the rod through the inclined slotted guide causing the effect of a wedge by pushing the mass in a transverse direction, and tilting abandoning the axis of the barrel to partially sink below it.

The confined oblique displacement of the dead inertia mass, also named slider, is forced by a prismatic joint of the slider though which it slides linearly only transverse fixed guide bar rear part of the bolt passing through the mass with a "pin in slot" type of joint. However the different means used to achieve the recoil absorption are significantly inefficient in terms of the volume, horizontal bolt travel distance, and total weight required. None of the design solutions involve the use of firing mechanisms displacement, or the use of the firing mechanisms mass as a part of the recoiling inertial mass. U.S. Pat. No. 7,201,094 of Jan Henrik Jebsen uses a complete conventional separate stationary fixed firing mechanism assembly, placed conveniently that necessitates significant volume and weight to operate. The latter mentioned patent does not have any sort of internal recoil abatement mechanisms inside the inertia mass as my this invention has provides. It is notorious for being voluminous and unwieldy. It is voluminous with a very little barrel length Shortly after, U.S. Pat. No. 7,997,183 of Aug. 16, 2011 of Jebsen and Kerbrat, claiming priority benefits of the U.S. Pat. No. 7,201,094, covered a very similar firearm in which the distinctive difference was a set of intermediate link plates placed between the bolt head and the slider to transmit the recoil impact to the slider by means of sloped, or inclined plane surfaces contacting each other promoting the slider displacement, like a wedge would do.

Additional patents claiming priority benefits of U.S. Pat. No. 7,201,094 were awarded recently as continuations of the latter mentioned patents. They are U.S. Pat. No. 8,122,633 of: Renhaurd Kerbrat of Feb. 28, 2012, and U.S. Pat. No. 8,281,699 of Jan Henrik Jebsen of Oct. 9, 2012.

In all patents of that series of Jebsen and Kerbrat, the bolt head and slider linkage mechanism is a Kinematic Chain. And said patents reiteratively, and repeatedly define the inertia mass as a "slider", and Kinematically is a proper expression to describe such type of joint in complete accordance with all of their patent drawings, descriptions, and functional kinematic analysis of their mechanisms. The word "slider" has a sole meaning in total agreement with the definition of "slider" given in kinematics joint classification to be a Prismatic Joint: "a joint moving along a linear path only". The slider repeatedly is defined to be confined to exclusively move along a rectilinear transverse, upwards and downwards path.

Such over stated definition of the part that is connected to the Bolt Head, completely excludes any possibility of the "slider" to move other than transversally or horizontally, or rotate, or even changing its path partially towards a different bearing. There is no room for another different semantic understanding of the word "slider".

The supreme interest of theses series of patents in generating a massive momentum vector perpendicular to the axis of the barrel, as a means to counter balance the muzzle raise, is present and evident in every one of the patents U.S. Pat. No. 7,201,094;U.S. Pat. No. 7,997,183;U.S. Pat. No. 8,122,633; U.S. Pat. No. 8,281,699, and their selection and array of inks and mechanisms, for their purpose, well serves the design intent, to the point that the entire mass of the slider or inertia block is confined to move downwards in a solely linear transverse highly steep angle path, through a dedicated passage, and even the bolt abandons the axis of the barrel to follow the inertia block in its sinking to contribute with its mass to increase magnitude of the downwards momentum vector. The transformation of the direction of the momentum vector from horizontal to transverse is expeditiously made by sliding contact, against an inclined surface inside a "pin in slot" closed joint, by a side projection or tennon of the Bolt Head confined and trapped to move along the closed slot.

Said type of joint is classified in Kinematics as a half joint (a higher pair) where a pin allows a link to rotate and the pin itself can slide in the slot. The geometry keeps the joint constrained or closed. Positioned at a steep linear inclination, it allows the side projection of the bolt to contact the two surfaces at an inclined plane, like a wedge, forcing the slider, or inertia block, being one piece with said joint, to displace confined to a downwards and upwards motion with a good mechanical advantage. It is a good link efficiently combining Prismatic and Revolute joints and works well for their objective. However, the inertia mass, or slider, part combines two different types of joints in one: a slider type P (prismatic) joint, and a pin in closed slot, which is very restrictive in motion because it anchors the bolt to the slider inside the slot and it drastically limits and ruins the bolt head displacement in the horizontal direction, by trapping the Head Bolt tennon inside the closed slotted joint in which it moves, and the slider itself is confined to a transverse motion, as repeatedly and explicitly stipulated in every one of U.S. Pat. No. 7,997,183; U.S. Pat. No. 8,122,633; U.S. Pat. No. 8,281,699, series of patents. This vital restraint, to make their mechanism work, prevents all Jebsen's and Kerbrat's patents bolt head to displace along the horizontal bearing, aligned with the axis of the barrel for long practical distances required to eject and load from magazines large rifle cartridges, without up scaling beyond the realistic dimensions of the slider and the inclined closed slot joint along which the bolt tennon moves. An additional inconvenience of the array of this Kinematic Chain is the immediate transmission of the initial primary horizon component of the recoil impulse directly to the receiver frame when the tennon of the bolt head impacts the first steep surface of the slotted joint, transmitting the force to the prismatic joint connected to the receiver frame.

Recapping: The firearms covered by Jebsen and Kerbart patents have limitations intrinsic to the design manifested in the following disadvantages:

- The horizontal Bolt Head horizontal travel is severely limited due to the transitive grounding of the bolt's tennon inside the slider, which in turn is confined to upwards and downwards transversal displacement only.
- The Slider can't follow the bolt head in its complete forward horizontal travel to close the breech.
- The Slider and the bolt head can never be aligned along their longitudinal axes
- Under the perspective of Kinematics, the "slider" is defined as a link moving exclusively along a rectilinear path.
- The slider is grounded by a prismatic joint to a track, and thus confined to a transversal path in a manner that completely excludes any displacement along the horizontal axis.
- The short limited horizontal travel of the bolt realistically excludes the practical use of rotary bolts
- The short limited horizontal travel of the bolt realistically excludes its practical use in firearms using long cartridges by scaling up dimensions to maintain the angular proportions under which this mechanism works.
- The "pin in slot" link mechanism, at the top of the slider, is similar to the action of a wedge where a force applied to an actuating part, having a flat slopped surface, produces a displacement of a part in contact, having a component perpendicular to the axis of the applied force.
- The grounded slider has said steeply inclined, closed slotted surface over which the bolt tennon displaces, becomes an efficient mechanism to decompose the recoiling force of he bolt into the vectorial components associated with the trigonometric functions corresponding to the geometry of the slotted shape mechanism. Meaning that for larger calibers to work it is necessary to scale up the dimensions, maintaining the aspect ratio, proportions, and the angles within certain close tolerance to preserve the vectorial decomposition of forces which make this mechanism work.
- The short limited horizontal travel of the bolt realistically limits its practical use to pistol calibers only.
- The mass distribution of the Bolt and slider array concentrates most of the mass in the slider.
- The slider mass travels exclusively through a dedicated passageway, which is not the handle.
- The firing mechanism is placed in a fixed dedicated location, well above the axis of the barrel, which raises the center of gravity and requires a containing volume.
- Per se, these firearms are voluminous, heavy, not compact, unwieldy.
- Per se, these firearms transmit to the receiver, and thus to the firer, an horizontal jerky transient force due to the instant contact of the bolt tennon against a very steep slotted surface of the slider as the bolt blows back immediately after firing.
- When the bolt head is in its most forward position, closing the breech, the vertex shaped contoured, steeply inclined, upper part of the slider requires to be well above the axis of the barrel, demanding, by default, a bulky upper volume of the receiver to contain such piece, and by default, contributing to raise the center of gravity. This vertex shape, is unavoidable because is the highest point portion of the sloped linear surfaces against which the tennon of the bolt slides.

With respect to the Delay Blowback breech opening function that my invention has, the U.S. Pat. No. 3,283,345 of Theodor Koch is important to mention because it has been extensively divulged and promoted by its use in the Heckler and Koch G3 rifles and especially in the very well known MP 5 sub machineguns. It causes a delay in the breech opening by means of a complicated mechanism inside the bolt whereby a set of sprig loaded rollers are forced to move along a pair of closing arc circle surfaces generating a retention of the force produced by the increasing gas pressure inside the barrel until the point where it overcomes the force of the rollers mechanism, generating a delay. The use of such mechanism has been successful, but has several disadvantages: it is sensitive to dirt, it requires lubrication, rollers break, springs fatigue, and does not lend to trimming. Rollers and pivoting pins are subject to strong forces requiring very demanding manufacture specifications about materials and process controls.

ADVANTAGES

Under the perspective of Kinematics, this invention is a different kinematic Chain, and by far more innovative, capable, and functional than the conceived by Jebsen and Kerbrat, or any other. It uses different joint types to connect link members having different degrees of freedom with less restrictions, reflecting in an efficient out put motion, capabilities simplicity and compactness. It surpasses all prior art in achieving so many objectives through a thoughtful trade of priorities to blend capabilities resulting in a very innovative design with applications in diverse groups of firearms to serve several markets.

This invention focuses in providing solutions to the problems, deficiencies and limitations of previous firearms designs, through achieving several different purposes or objectives, all of them having equal importance, which sometimes compete one against each other, in a manner that demands sacrificing the prevalence of one objective over others in order to blend, in a sensible way, for the accomplishment of all objectives. It is a careful trade of ergonomics, portability, fire power, recoil comfort, ease of field service and manufacturing, dynamics, statics for lowering of the center of gravity, while preserving compactness, and conventional aesthetic pleasant functional silhouette.

It is a rational application of kinematics analysis in which input and out put motions are combined through an array which poses no limitations to the Pivotally Articulated Bolt Train in its motion in the horizontal axis.

It allows its smooth continuous displacement, partially transitioning from a complete horizontal alignment with the axis of the barrel to a curved downwards and transversal path thorough the handle tunnel, while gliding through the path without obstacles.

However one of the previous patents integrates the Active Firing Mechanisms as a part of the recoiling Bolt Train and places it for at all times in the immediate proximity to the firing pin. Nor it uses an active recoil damper mechanism. Formerly It only moved inertia dead mass downwards.

This invention integrates the Active Firing Mechanisms as a part of the recoiling Bolt Train and places it for at all times in the immediate proximity to the firing pin.

The present invention has at least one the following advantages

- The concept of a Pivotally Articulated Bolt Train has never before been used in firearms with the inclusion off moving firing mechanisms inside a train member, while rendering its mass and inertia properties to serve in the recoil management.
- Under the perspective of kinematics the Pivotally Articulated Bolt Train is a completely different mechanism that the one of Jebsen and Kerbart, where the output motion is entirely different and more functional.
- The concept of utilizing an Articulated Bolt Train capable of continuously displacing along tracks, changing diverse bearings, in a continuous reciprocating motion, with the firing mechanism incorporated to the recoiling mass is totally innovative.
- The complete Pivotally Articulated Bolt Train has no horizontal travel limitations. The length of the horizontal tracks can be extended to satisfy the design requirements to be able to load and eject long cartridges.
- Under the perspective of Kinematics, the "slider" is defined as a link moving exclusively along a rectilinear path.
- The Articulated Bolt Train carriage never displaces above the axis of the barrel, maintaining a low profile and a low center of gravity.
- The long unlimited horizontal travel of the bolt enables the practical use of rotary Bolts.
- The long unlimited horizontal travel of the bolt enables the practical use with long rifle cartridges without enlarging the height or proportions of the receiver.
- The long unlimited travel of the bolt enables the practical use also in pistol calibers.
- The mass of the Pivotally Articulated Bolt Train array is evenly distributed contributing to have a smooth recoil action.
- The carriage and subsequent optional train members may travel, horizontally, curvedly downwards, transversally through a handle tunnel.
- The firing mechanism subassembly is mobile, housed inside a carriage displacing along a track aligned with the axis of the barrel, which significantly contributing to the lowering of the center of gravity.
- By deign, this family of firearms are fitted inside a receiver being small, light compact, portable comfortable, user friendly, having a classic, silhouette.
- By deign, this family of firearms transmit to the receiver and thus to the firer an horizontal smooth longer lasting transition force due to the progressive contact of the carriage rollers with the curved downwards track as the bolt train blows back immediately after firing.
- The bolt moves horizontally only aligned with the axis of the barrel, and never leaves said alignment.
- The Pivotally Articulated Bolt Train is capable of aligning all its components along a horizontal track parallel or coaxial to the axis of the barrel.
- The Pivotally Articulated Bolt Train is capable of displacing lengthy enough to load and eject long rifle cartridges.
- The Active Firing Mechanisms Carriage is capable of performing two essential functions: 1) carrying elements of firing mechanism, and 2) generating a strong stabilizing angular momentum vector, while turning, along a plane, in semicircular motion.
- This invention is better because the firing mechanisms are contained in a compact, volume-efficient, carriage that moves transversally.
- This invention is better because, when shooting, the firing mechanisms contained in a compact, volume-efficient, carriage moves gradually from horizontal travel to a transverse downwards bearing, through the handle or grip, producing a unique reaction movement of the receiver resulting in a balanced dynamic behavior.
- Conventionally, the firing mechanisms and its frame are placed in a fixed dedicated location. This invention makes the firing mechanism movable and uses its mass as part of the Bolt Train 90 mass needed to absorb the recoil, saving volume, weight and lowering the center of gravity.
- The active firing mechanisms operate linearly without rotating parts, which make it simple to manufacture and volume effective.
- The Controlling Firing Mechanisms subassembly 74 FIG. 5D is modular, easy to change if needed.
- A part, the mechanisms carriage housing, has multiple functions. It frames the firing mechanisms, it guides the recoil travel, and it displaces transversally with the contained independent mechanisms in place. At the rear it may have a protruding cam that slides over the inclined plane face of the spring loaded, movable recoil compensator forcing it back, adding additional restrain to the opening of the breech. All that in a very dense compact package, making it efficient in terms of minimal volume.
- The mechanisms carriage housing has a rear protruding cam that works in conjunction with the recoil damper sub assembly to produce additional restriction to the rearwards motion, adding more delay to the breech opening.
- When the firing mechanisms sub assembly works in conjunction with the optional protruding delay cam of the Front Bolt 20, it creates a delay on the blowback opening motion without requiring any additional moving parts.
- The mechanisms carriage housing and mechanism can slide down through the firearm handgrip, making it very compact and volume efficient.
- The small vertical horizontal proximity of the compact Bolt Train to the top of the shooter' grabbing hand lowers the center of gravity of the weapon creating a better handling.

When the mechanisms carriage housing and mechanism slide down through the firearm handgrip, the effect of the downwards displacement is felt directly on the grip, eliminating any moments about the grabbing point.

This novel mechanism can be used in many types of firearms; pistols; rifles, shotguns; machineguns; sub-machineguns; heavy machineguns; sniper rifles, grenade launchers, heavy weapons all the above semi automatic and full automatic, gas operated, long or short stroke, blowback, delayed blowback recoil, with rotary bolts and bolt carrier, electrical or mechanical firing.

These mechanisms can be used in bullpup configuration.

The front bolt head can be used as a bolt carrier, enabling the use of rotary locking bolts.

The bolt carrier can be used in conjunction with direct drive rods with gas operated bolts.

Firearms using this type of bolt lend to be partially manufactured with polymer injected materials, which translates into low production costs.

The progressive displacement downwards of the mechanisms carriage housing and mechanism provides a smooth transition of the reaction force.

Rollers can be added to the guide rods to smooth the operation.

Rollers can be added to the hammer to smooth the operation.

This design is better because it uses the change of direction of the path of the bolt train to cock the firing mechanisms.

This design is better and novel because it incorporates a delay blowback breech opening mechanism in the rearwards recoil motion, which enhances the delivered energy of the projectile, and reduces the pressure at the breech when opening.

The delay blowback breech opening system of this invention achieves the same results of Koch with a very simple interaction of two parts and lends to be trimmed by producing a desired controlling surface in the front face of the slider striking hammer.

The delay opening mechanism slows the rate of fire when used in full automatic mode.

This invention is far simpler and advantageous than the one of Jebsen because it only uses only one displaced pivot articulation or hinge as the means of linkage between the front bolt and the mechanisms carriage housing. The movement required at the articulation is only rotational.

No margin of play is required between the front bolt and the mechanisms carriage housing.

This invention does not require any mobile breech to interlock the front bolt and the mechanisms carriage housing.

FIG. 18 shows the schematics of numerous applications where this invention could be used advantageously.

This invention requires a smaller number of components in comparison to any other gun.

This invention has a moving cylindrical extruded sear 58 inside the hammer integrated to the Firing mechanism sub assembly.

Alternatively, this invention comprises a self sprigged sear—hammer FIG. 3B.

When required, internal sears can be used to protrude laterally to outside of the Mechanism Carrier Housing 40 and 40B, and engage against it, to become operational with side mounted column spring or pushing bar 78A FIG. 5D of the controlling firing mechanisms.

The Bolt Train 90 can be used in conjunction of Gas piston systems

The bolt train 90 can be used in conjunction with rotary bolts.

When additional kinetic energy absorption is desired a third component to the Bolt Train 90 can be attached: the Recoil Damper Subassembly FIG. 4B and FIG. 4C.

DRAWINGS-REFERENCE NUMERALS

| PART NUMBER | PART NAME |
|---|---|
| 20 | BOLT |
| 21 | HORIZONTAL PROTRUDING GUIDE (2) |
| 22 | REAR RECTANGULAR PROTRUSION |
| 22A | EDGE LINE |
| 22B | PROTRUDING DELAY OPENING CAM |
| 23 | CYLINDRICAL CAVITY FOR THE FIRING PIN |
| 24 | TOP HINGE |
| 25 | HOLE FOR PIN |
| 26 | RECTANGULAR SLOT FOR EXTRACTOR |
| 27 | FRONTAL FACE |
| 28 | CYLINDRICAL DEPRESION FOR CARTRIDGE REAR FACE |
| 29 | 29 FRONTAL HOLE FOR FIRING PIN |
| 30 | HAMMER |
| 31 | CYLINDRICAL CAVITY FOR SPRING |
| 32 | PUSH ROD FOR FIRING PIN |
| 33 | HAMMER SPRING |
| 34 | FRONT FACE OF HAMMER |
| 35 | DELAY OPENING SLOPED FACE |
| 36 | SEAR ANGULAR FACE |
| 37 | SEAR FLAT SPRING |
| 38 | SET OF MAIN RECOVERY SPRINGS |
| 39 | FIRING MECHANISM SUBASSEMBLY |
| 40 | MECHANISMS CARRIER HOUSING |
| 40A | RECTANGULAR CAVITY |
| 41 | ROD GUIDE (2) |
| 42 | CYLINDRICAL HOLE FOR SEAR SPRING |
| 43 | HINGES FOR SEAR LEVER |
| 44 | HOLES FOR PIN |
| 45 | SQUARE HOLE FOR SEAR TIP |
| 46 | PIN FOR SEAR LEVER |
| 47 | PIN FOR BOLT/MECHANISMS CARRIER HOUSING HINGE |
| 48 | MECHANISMS CARRIER HOUSING HINGE |
| 49 | HOLE FOR MECHANISMS CARRIER HOUSING HINGE PIN |
| 50 | SEAR LEVER |
| 51 | SEAR LEVER HINGE |
| 52 | HOLE FOR SEAR LEVER HINGE PIN |
| 53 | SEAR LEVER SPRING |
| 54 | ANGULAR FACE TIP |
| 55 | TOGGLE INTERNAL SEAR SPRING |
| 56 | TOGGLE INTERNAL SEAR |
| 57 | SEAR CAVITY |
| 58 | EXTRUDED SEAR |
| 59 | WINDOW HOLE |
| 60 | EXTRACTOR |
| 61 | EXTRACTOR PIN |
| 62 | EXTRACTOR SPRING |
| 63 | EXTRACTOR HOLE |
| 64 | RECOIL DAMPER SUBASSEMBLY |
| 65 | RECOIL DAMPER MECHANISM CARRIAGE/65A TWO SIDE HINGES |
| 66 | RECEIVER 66U UPPER 66L LOWER |
| 67 | MOBILE COMPENSATOR |
| 68 | FRONT ANGULAR FACE OF MOVABLE COMPENSATOR |
| 69 | CAVITY FOR COMPENSATOR 69A COMPENSATOR SPRING |
| 70 | FIRING PIN |
| 71 | FIRING PIN REAR |
| 72 | FIRING PIN SPRING |
| 73 | FRONT END OF FIRING PIN |
| 74 | CONTROLLING FIRING MECHANISM SUBASSEMBLY |
| 75 | TRIGGER |
| 76 | LEVER |
| 77 | SAFETY CAM |
| 78/78A | COLUMN SPRING OR PUSHING BAR/78 A LATERAL PUSHING BAR |

-continued

| DRAWINGS-REFERENCE NUMERALS | |
|---|---|
| PART NUMBER | PART NAME |
| 79 | FIRING MECHANISM FRAME |
| 80 | SLOT CHANNEL GUIDE |
| 90 | BOLT TRAIN |

BRIEF DESCRIPTION OF THE DRAWINGS

FIG. 4A shows an isometric view of the MECHANISMS CARRIER HOUSING FOR HAMMER WITH SQUARE HOLD FOR SEAR TIP in a Particular embodiment.

All drawings are schematic and not to scale.

Most of the drawings are self explanatory; however for a better understanding of the advantages, capabilities and innovation of this invention, some of the drawings are explained in more detail.

Figure 1:
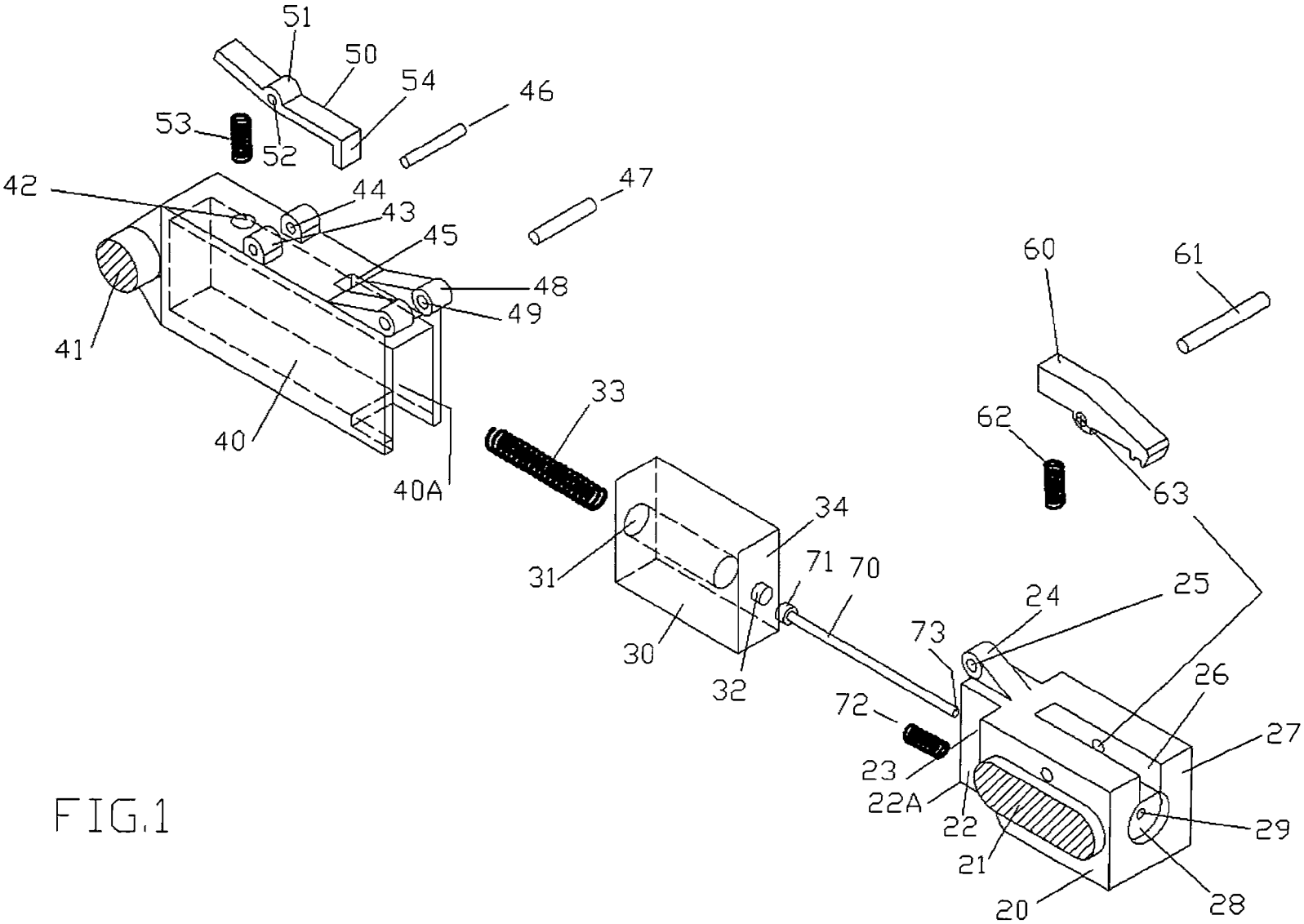
FIG. 1 shows an isometric exploded view of the GENERAL ASSEMBLY of a Pivotally Articulated Bolt Train in a Particular embodiment.

FIG. 1 Shows the general assembly of the Articulated Bolt Train, the basic train with two members: the Bolt Head and the Active firing Mechanism Carriage subassembly, which are connected by pivot pin (47).

Figure 1A:
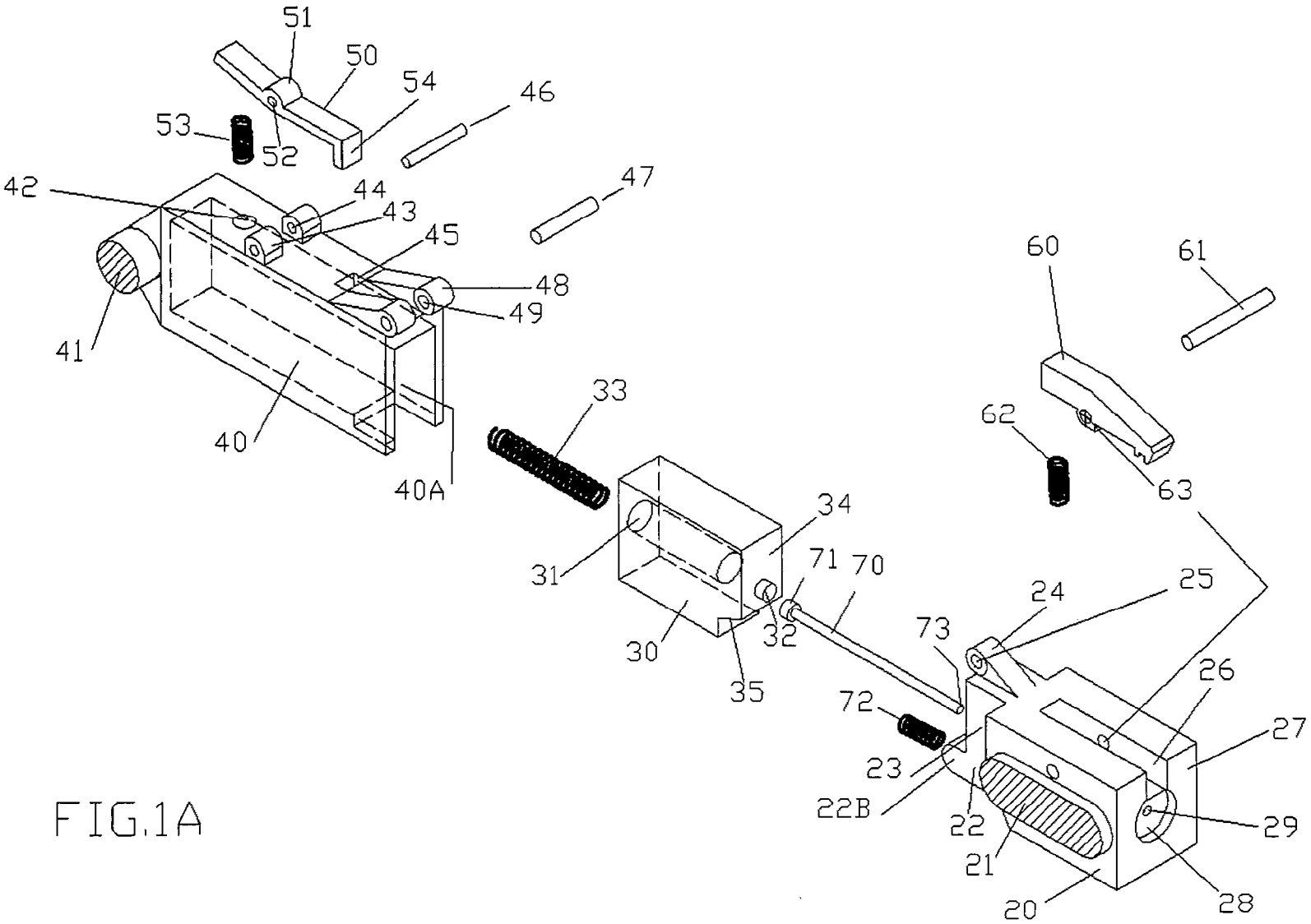
FIG. 1A shows an isometric exploded view of the GENERAL ASSEMBLY WITH DELAY OPENING of a Pivotally Articulated Bolt Train in a Particular embodiment.

FIG. 1A Shows the general assembly of the Articulated Bolt Train with the optional delay blowback opening arrangement, caused by the partially interfering interaction of the cam (22B) of the bolt contacting the cut (35) of the striker hammer (30).

Figure 2:
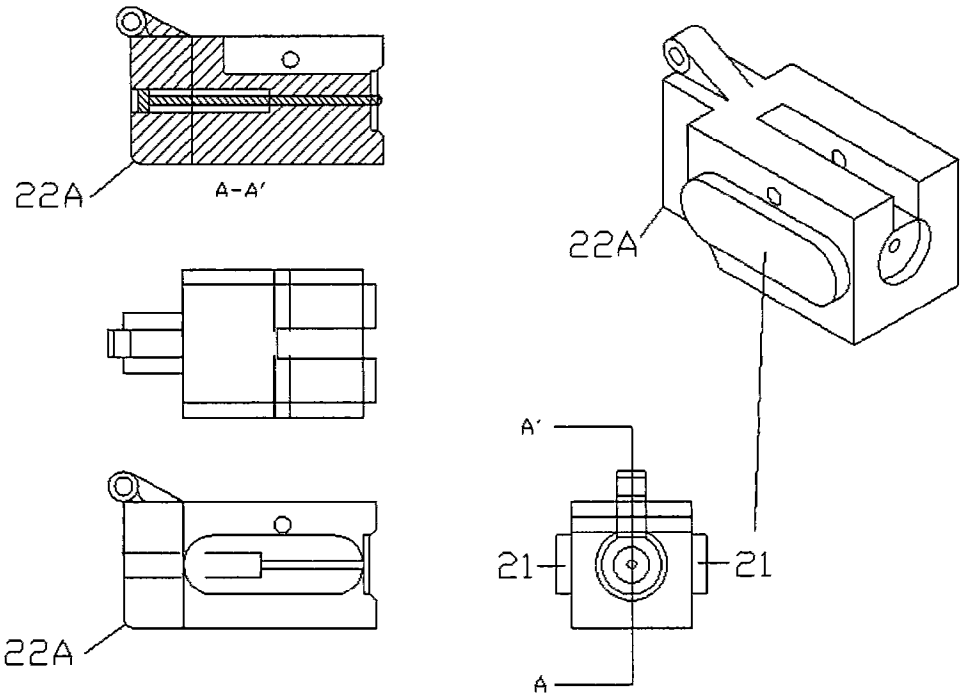
FIG. 2 shows a front, top, side, isometric, and a lateral cut view of a FRONT BOLT.
Figure 2A:
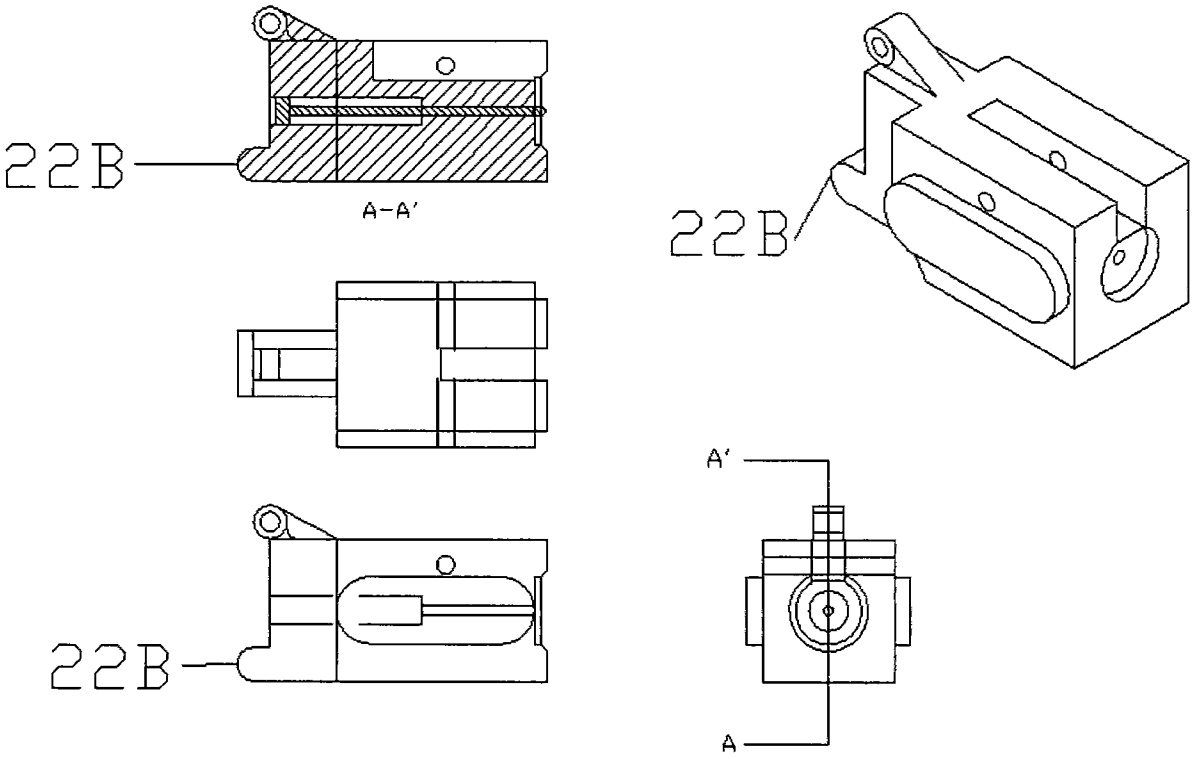
FIG. 2A shows a front, top, side, isometric, and a lateral cut view of a FRONT BOLT WITH DELAY OPENING CAM.
Figure 2B:
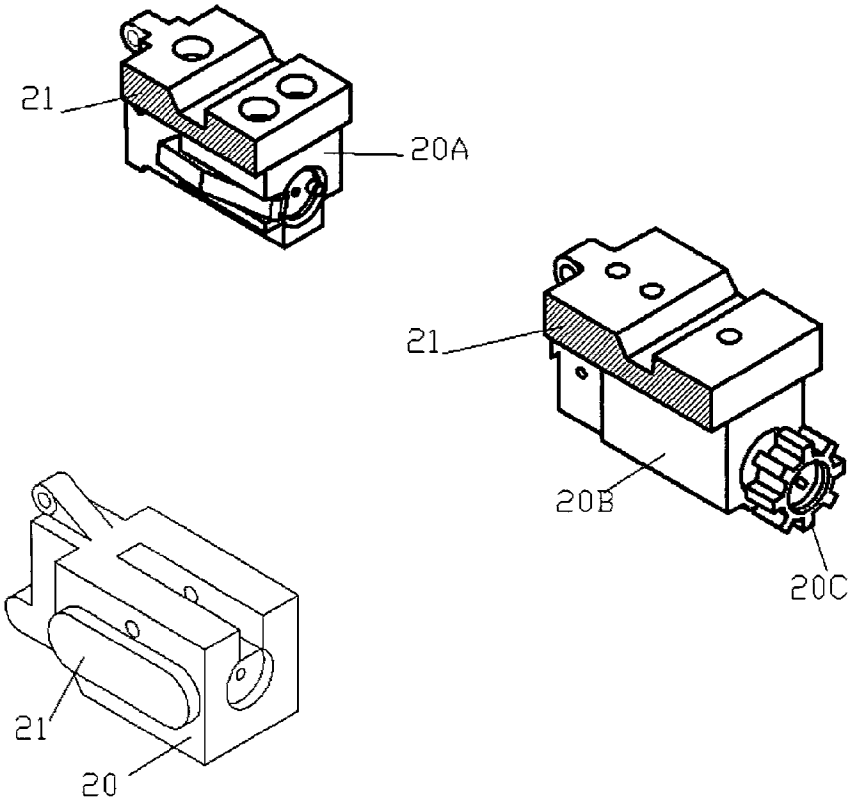
FIG. 2B shows isometric views of SEVERAL FRONT BOLT CONFIGURATIONS where the HORIZONTAL lateral PROTRUDING GUIDE has different possible configurations.
Figure 44:
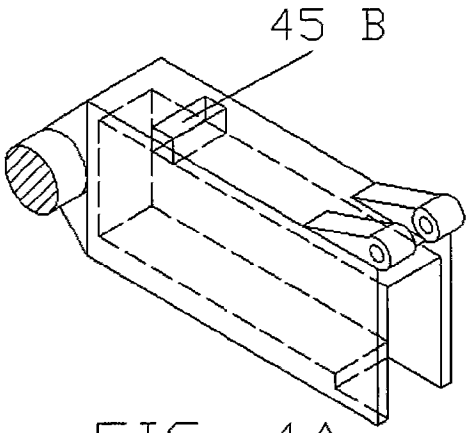
Figure 3:
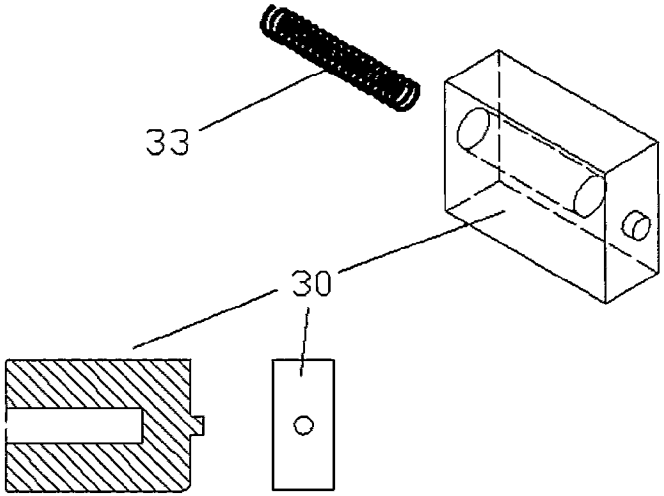
FIG. 3 shows a lateral cut view, a front view and an isometric view of the Striker HAMMER in a Particular embodiment.

FIG. 2B Shows several front bolt configurations with different side protrusions, or lugs, or side projections (21) acting as prismatic joints when connected to side tracks, and confining the Bolt head to horizontal displacement only. Also shows the capability of the Bolt Head to house a rotary Bolt.

Figure 3A:
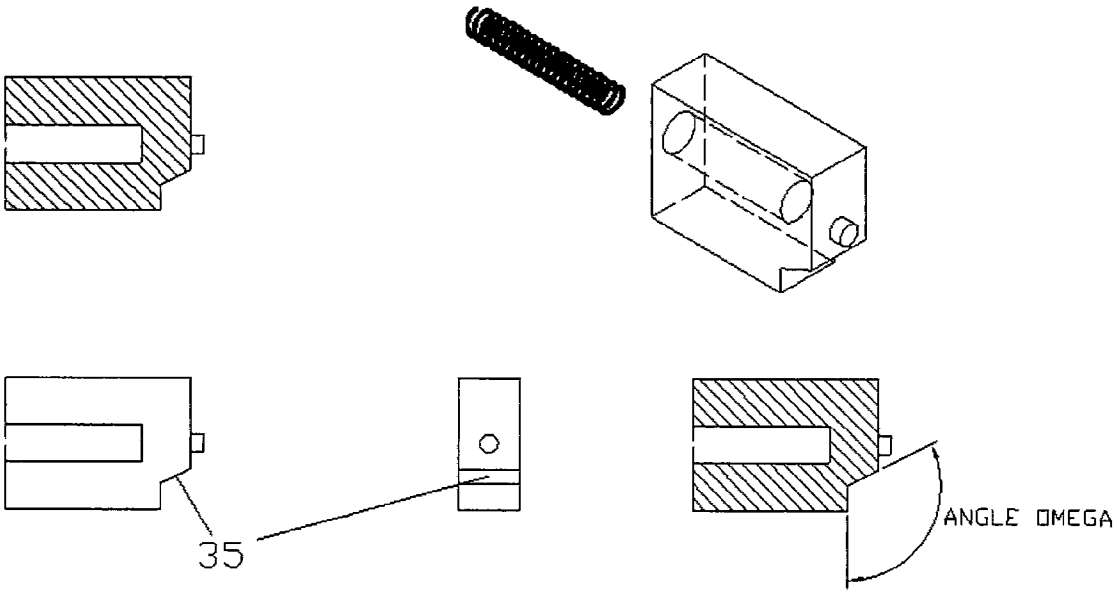
FIG. 3A shows a lateral cut view, a front view and an isometric view of the Striker HAMMER WITH DELAY OPENING SLOPED FACE determining the Angle Omega in a Particular embodiment.
Figure 3B:
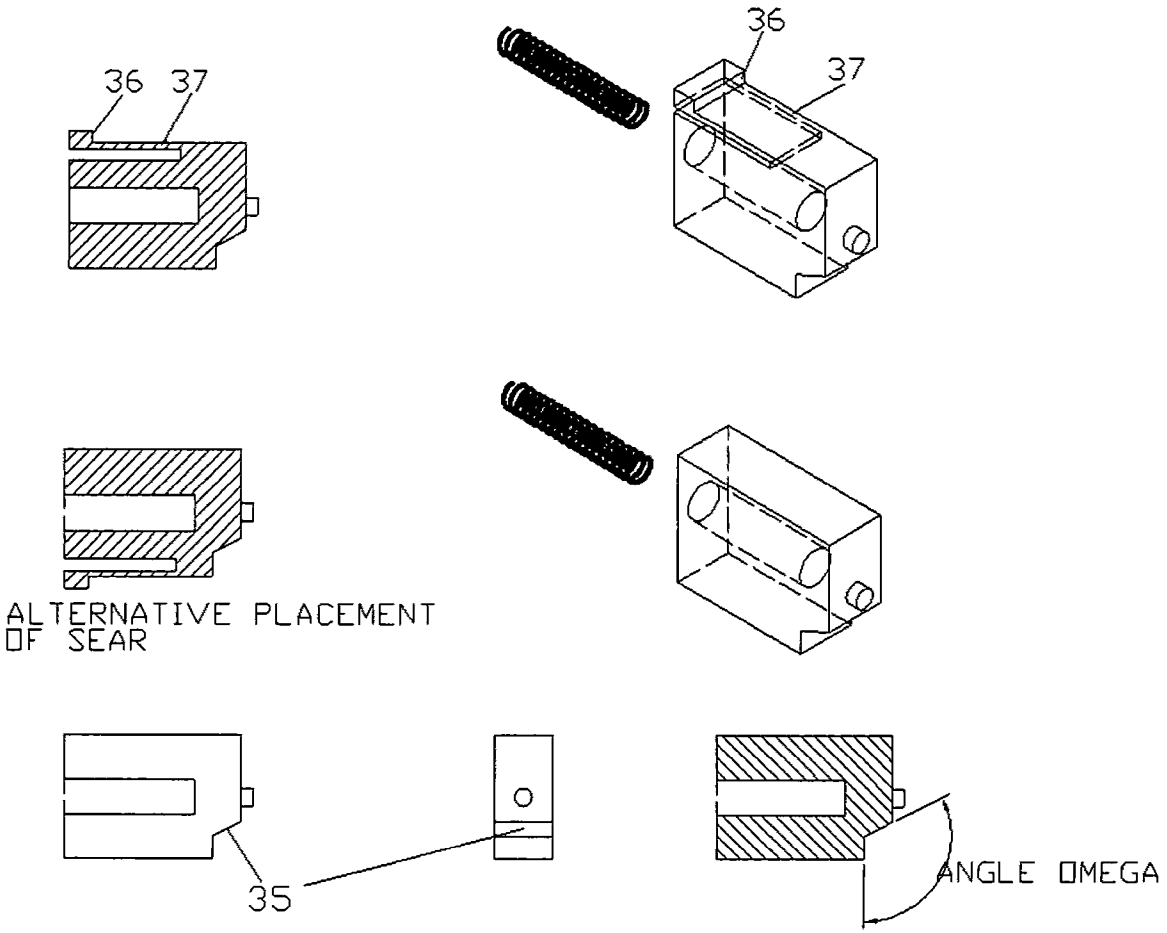
FIG. 3B shows a lateral cut view, a front view and an isometric view of the Striker HAMMER WITH SEAR AND SPRING being integral to the hammer in a Particular embodiment.
Figure 3C:
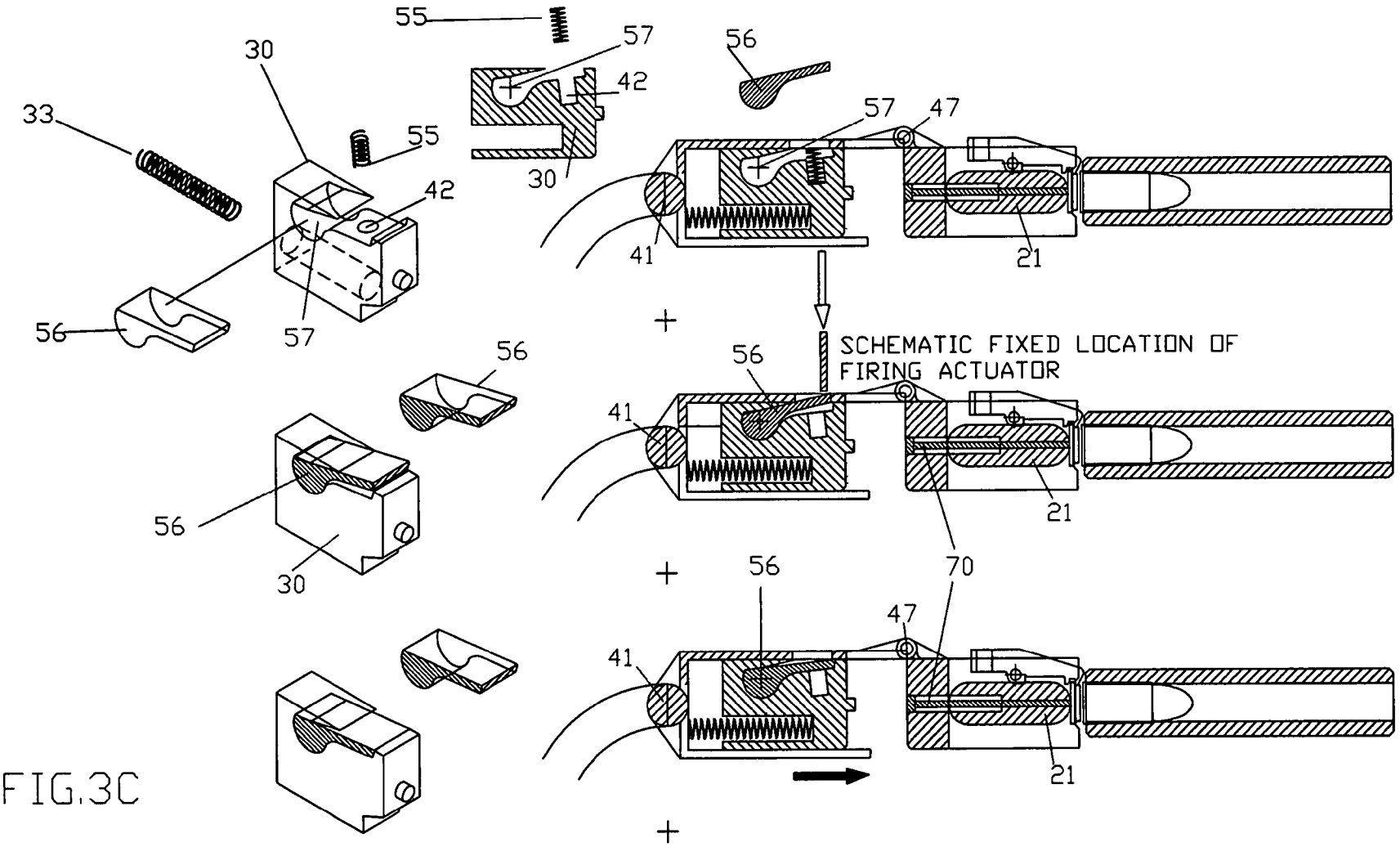
FIG. 3C shows several possible embodiments of a HAMMER WITH ROTARY INTERNAL SEAR AND SPRING being housed internally in a sear cavity of the hammer.
Figure 3D:
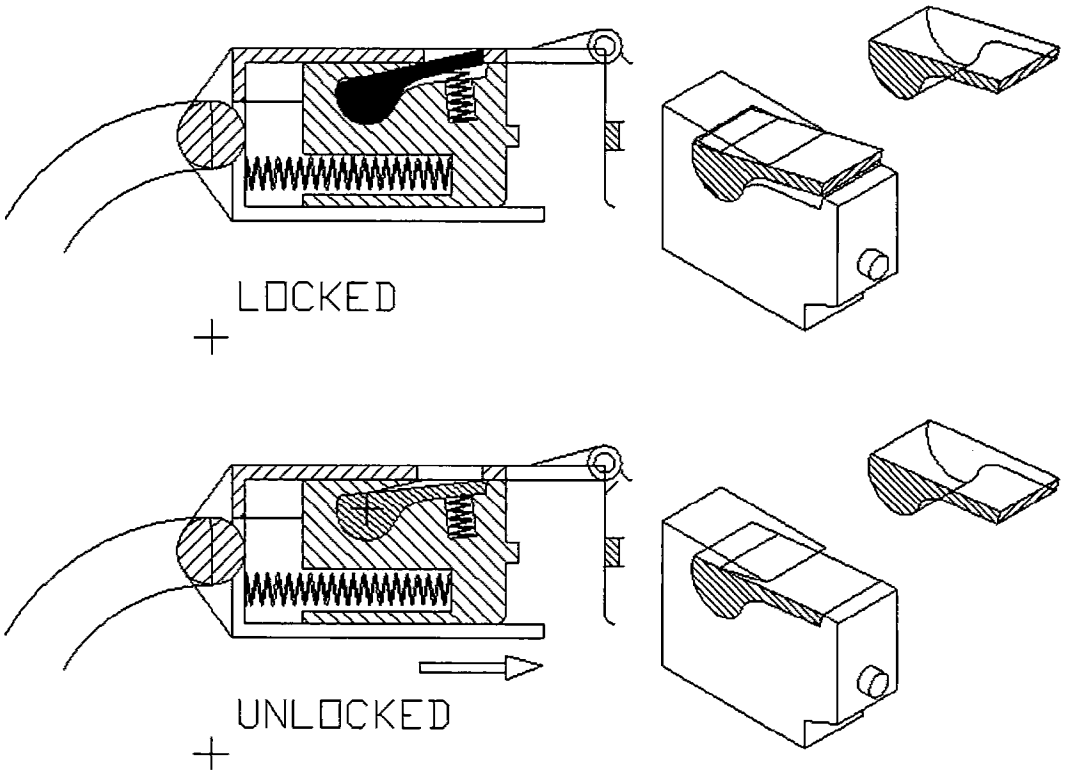
FIG. 3D shows the ROTARY INTERNAL SEAR LOCKING DETAIL in a locked, and unlocked positions, in a particular embodiment.

FIG. 3D Shows the spring loaded internal rotary sear locking detail capable of engaging against a cut of the carriage (40).

Figure 4:
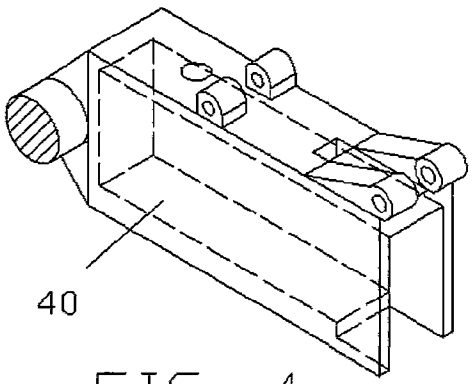
FIG. 4 shows an isometric view of the MECHANISMS CARRIER HOUSING in a Particular embodiment.
Figure 4B:
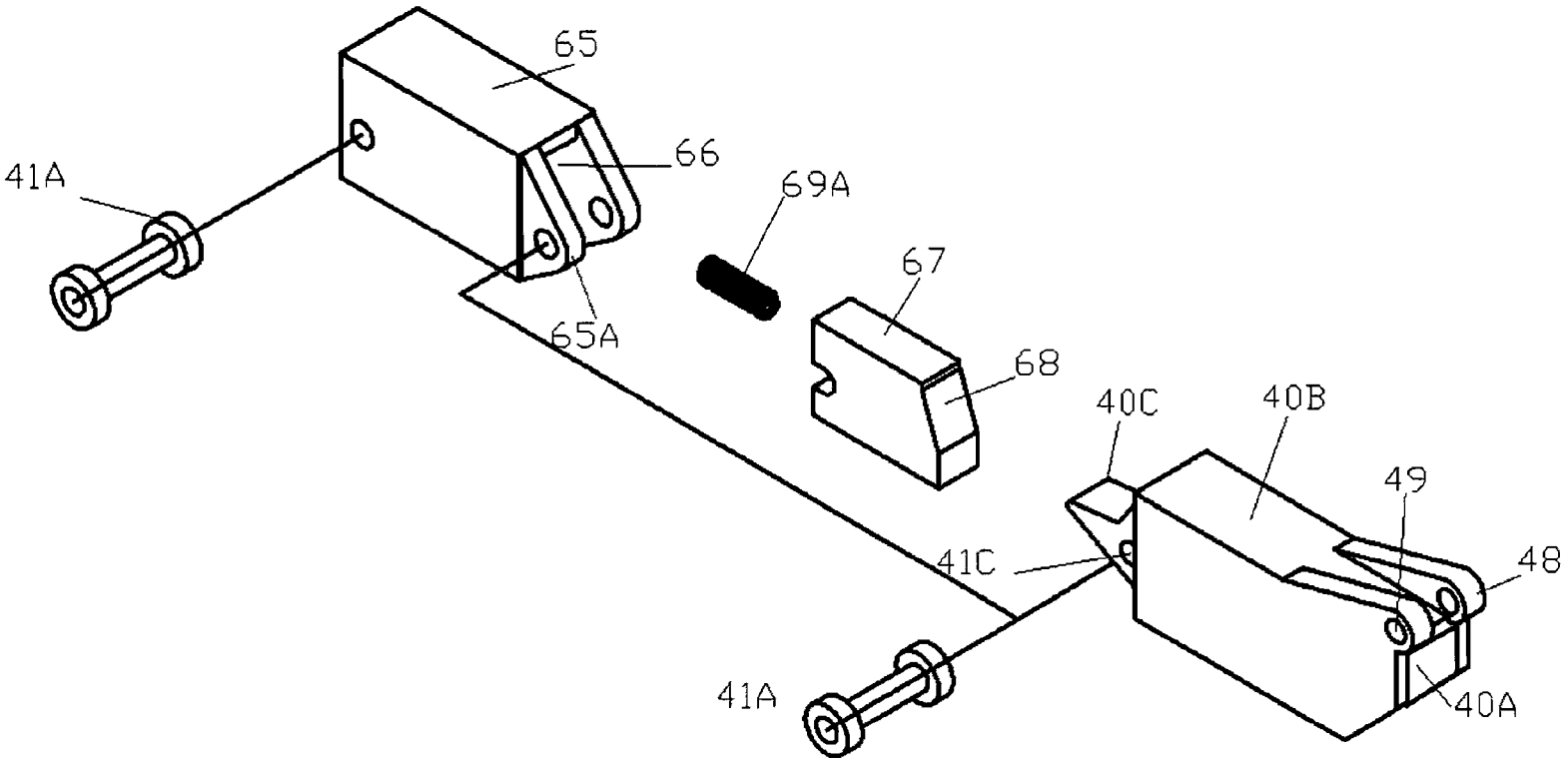
FIG. 4B shows an isometric exploded view of thE RECOIL DAMPER SUB ASSEMBLY AND FIRING MECHANISMS CARRIER HOUSING interaction in a Particular embodiment.

FIG. 4B Shows the interaction and connection of the optional Recoil Damper subassembly, and Firing Mechanism Carrier housing connected by pivot roller pins (41A). Said Roller pins also connect and ground the mechanism to the side tracks of the receiver.

Figure 4C:
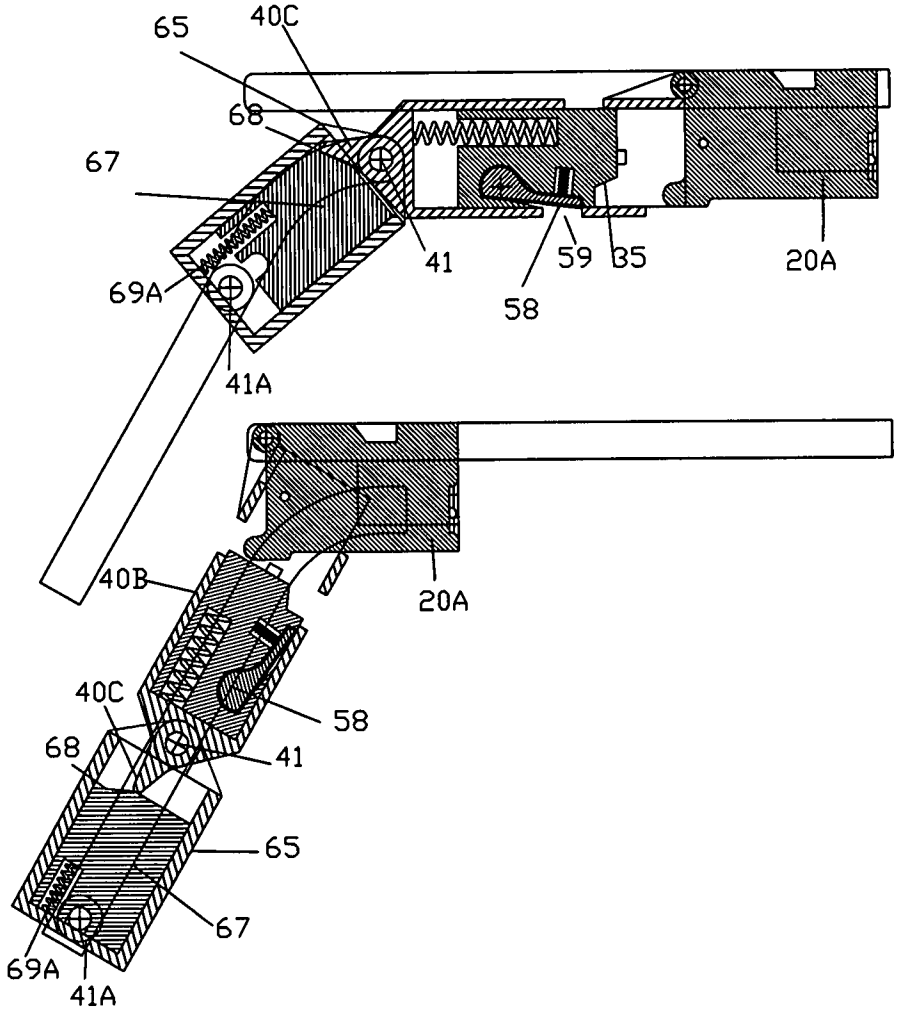
FIG. 4C shows schematic CUT VIEW OF BOLT TRAIN WITH A THIRD MEMBER DELAY DAMPER when the Train is in the most forward position, and when the Train is in the most rearward position.
Figure 4D:
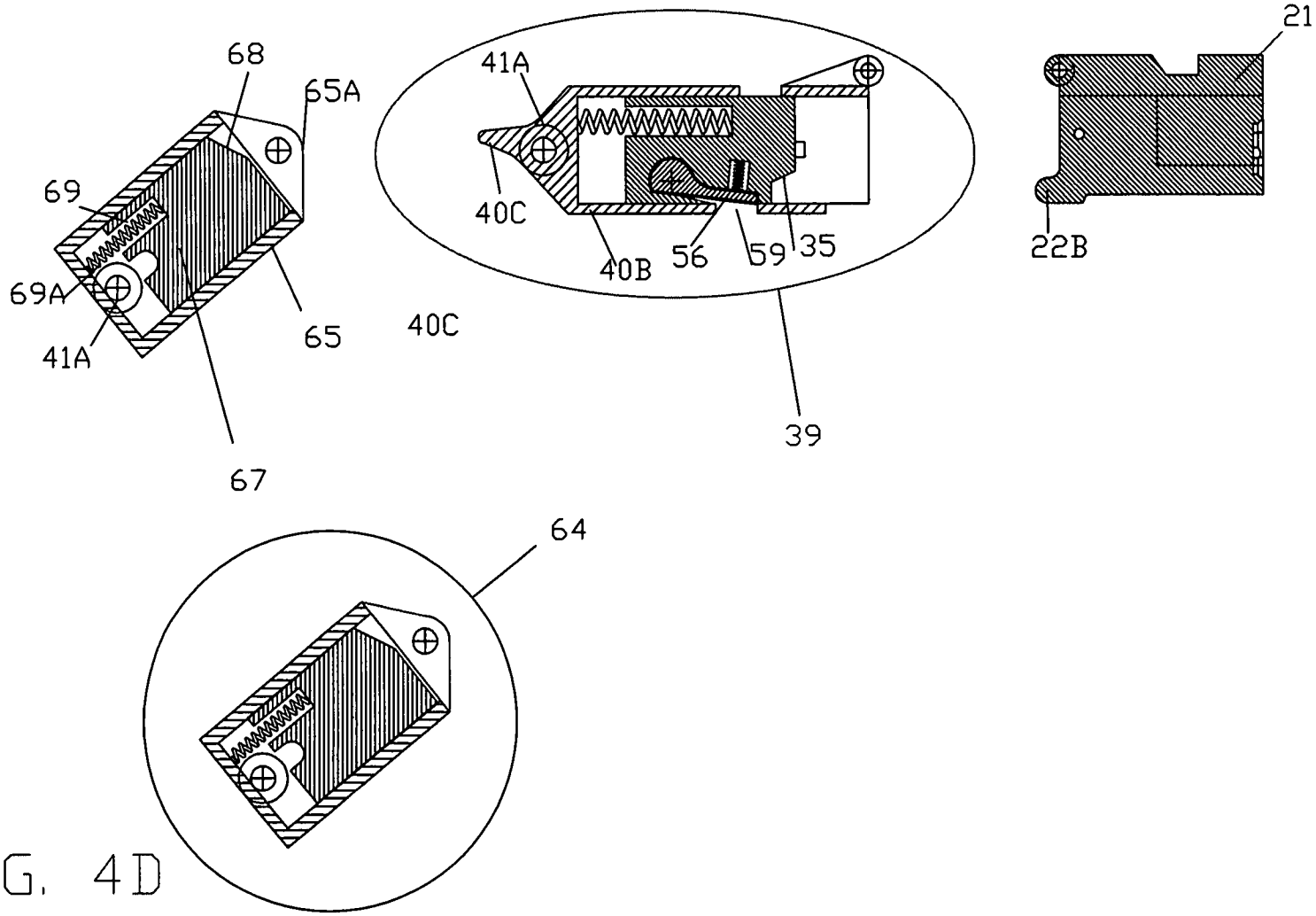
FIG. 4D shows a schematic CUT VIEW RECOIL DAMPER SUB ASSEMBLY (64) AND FIRING MECHANISMS SUBASSEMBLY in a Particular embodiment.

FIG. 4C Shows a cut view of bolt train with an optional third member Delay Damper. Cuts are shown in the most forward position, with the two basic Articulated Bolt Train the Bolt Head and the Active Firing Mechanism Subassembly in complete horizontal alignment. Other view shows the Articulated Bolt Train in its most rear position, where the Bolt Head is still in a horizontal position. Bolt Head never leaves the axis of the Barrel.

Figure 5A:
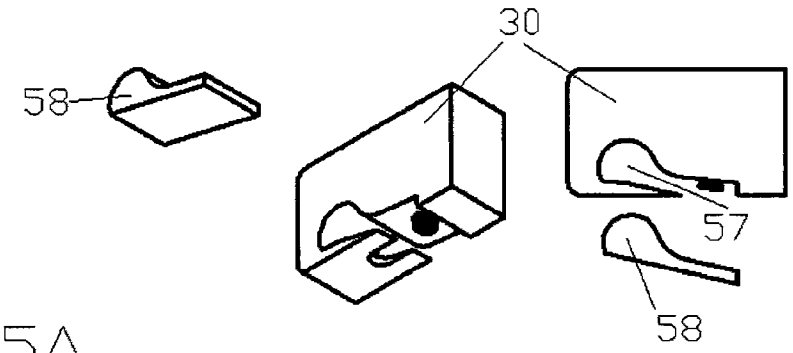
FIG. 5A shows an isometric assembly detail of a CYLINDRICLA ROD INTERNAL SEAR and a sear cavity internal to the striker HAMMER in a Particular embodiment.
Figure 5:
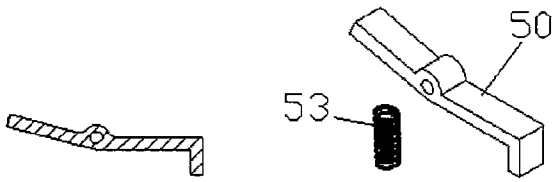
FIG. 5 shows an EXTERNAL SEAR and spring in a Particular embodiment.
Figure 5B:
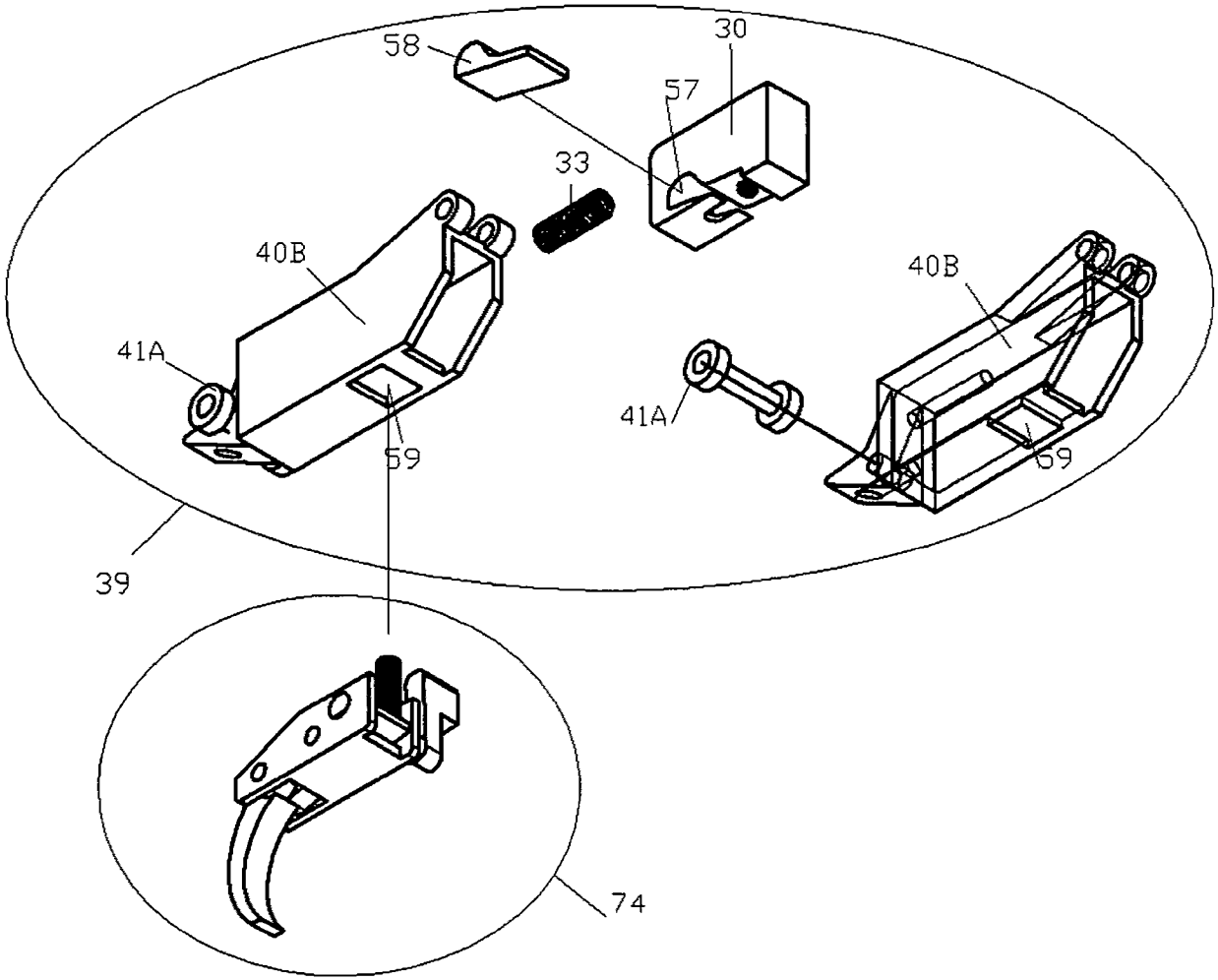
FIG. 5B shows an isometric exploded assembly detail of the FIRING MECHANISM SUBASSEMBLY AND CARRIER, and the CONTROLLING FIRING MECHANISM SUBASSEMBLY and their relative position with respect to the other, in a Particular embodiment.
Figure 5C:
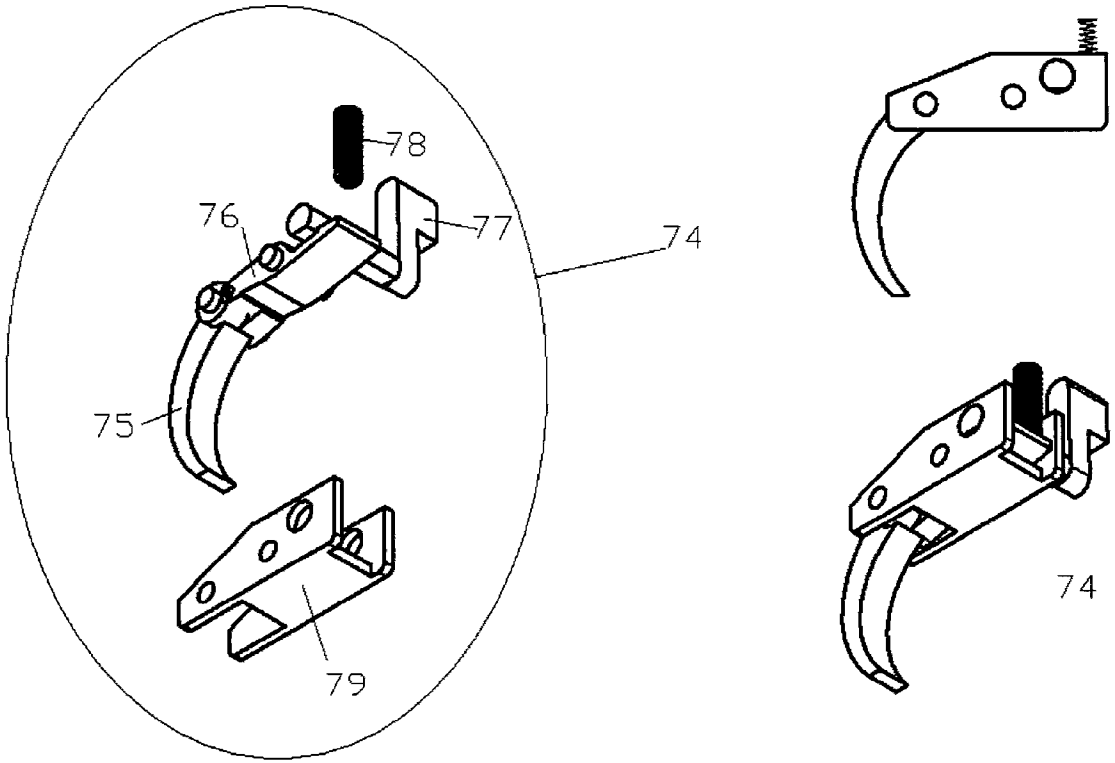
FIG. 5C shows an isometric exploded assembly detail of the CONRTOLLING FIRING MECHANISM SUBASSEMBLY in a Particular embodiment.
Figure 5D:
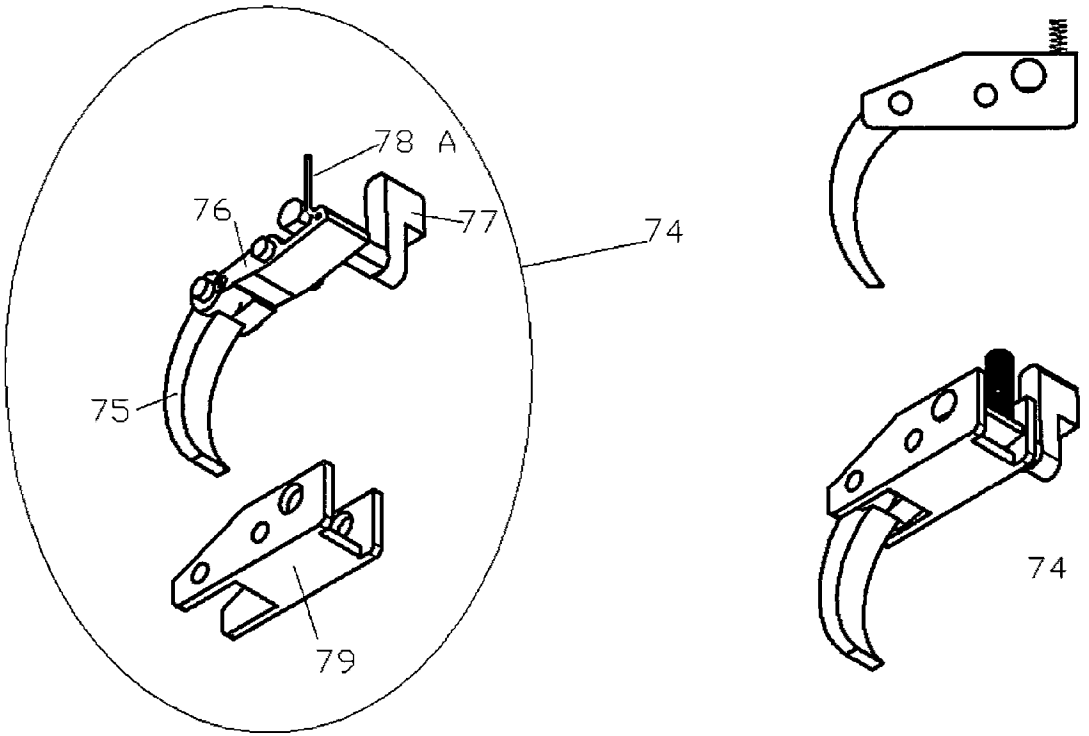
Figure 6:
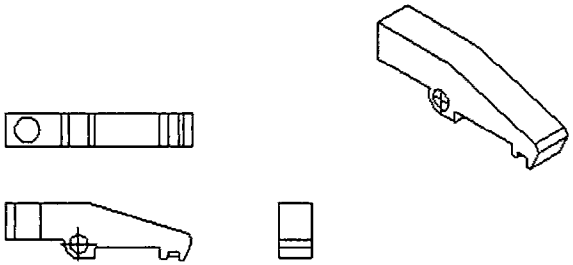
FIG. 6 shows an isometric, a front, a lateral, and a top view of a cartridge EXTRACTOR in a Particular embodiment.
Figure 7:
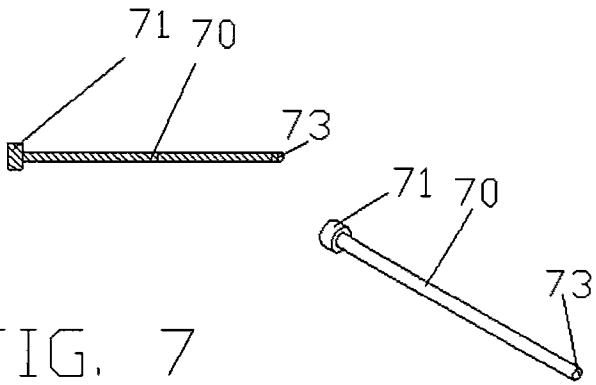
FIG. 7 shows an isometric and a cut view of FIRING PIN in a Particular embodiment.

FIG. 5D Shows the controlling firing mechanism subassembly with lateral actuator (78A) to contact the lateral projections of the rotary sear (58).

Figure 8:
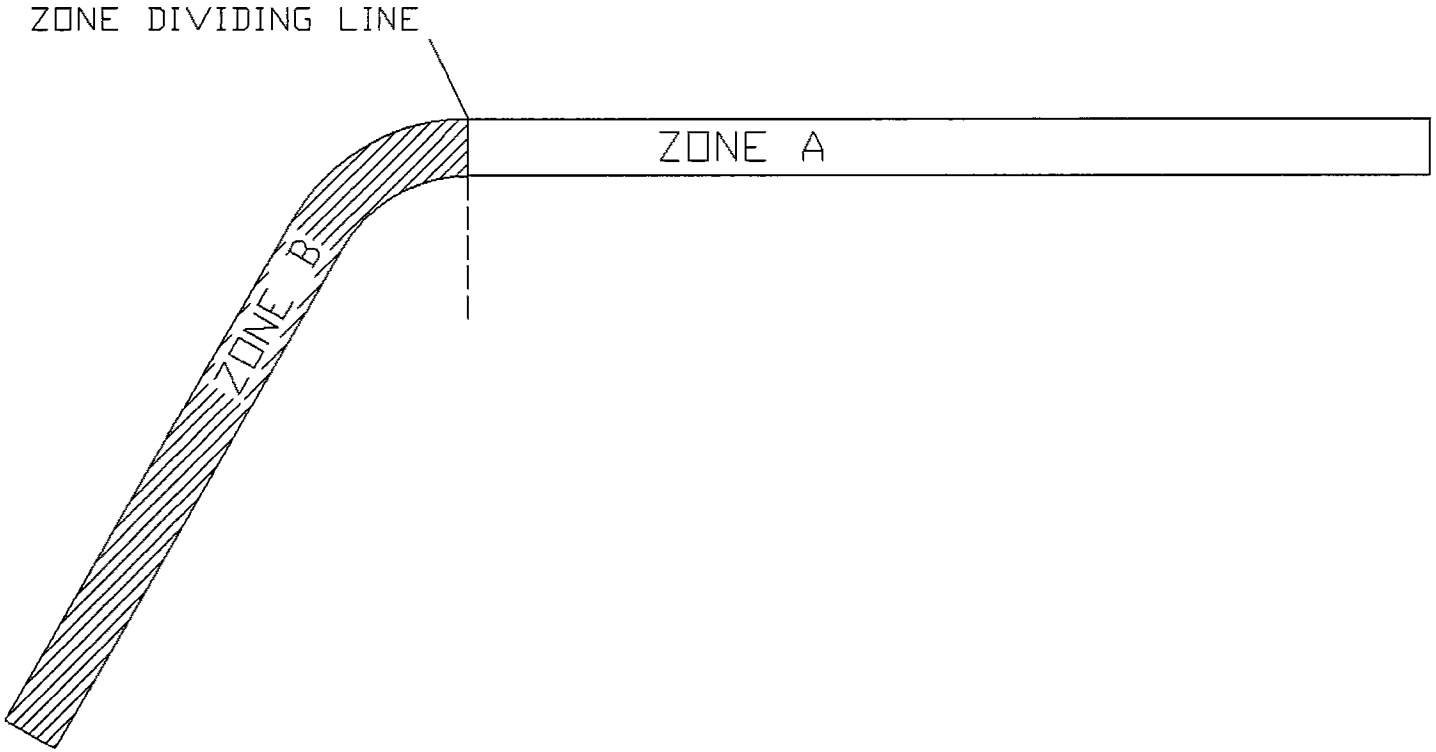
FIG. 8 shows a CONTINUOUS CHANNEL GUIDE (with TRACK SEGMENTS ZONE A ZONE B) in a Particular embodiment.

FIG. 8 Shows a single continuous channel guide with track segments zone a, zone b, in which the horizontal segment can be made long enough, so that the Articulated Bolt Train can lay completely Horizontally, aligned with the axis of the Barrel.

This property or capability is due to the revolute connections or joints used between each subsequent train member, AND to the fact that the second Train member, and the third train members are roller mounted "carriages" capable of changing bearings to follow the continuous uninterrupted path. This property is truly innovative not seen before in prior art.

Figure 8A:
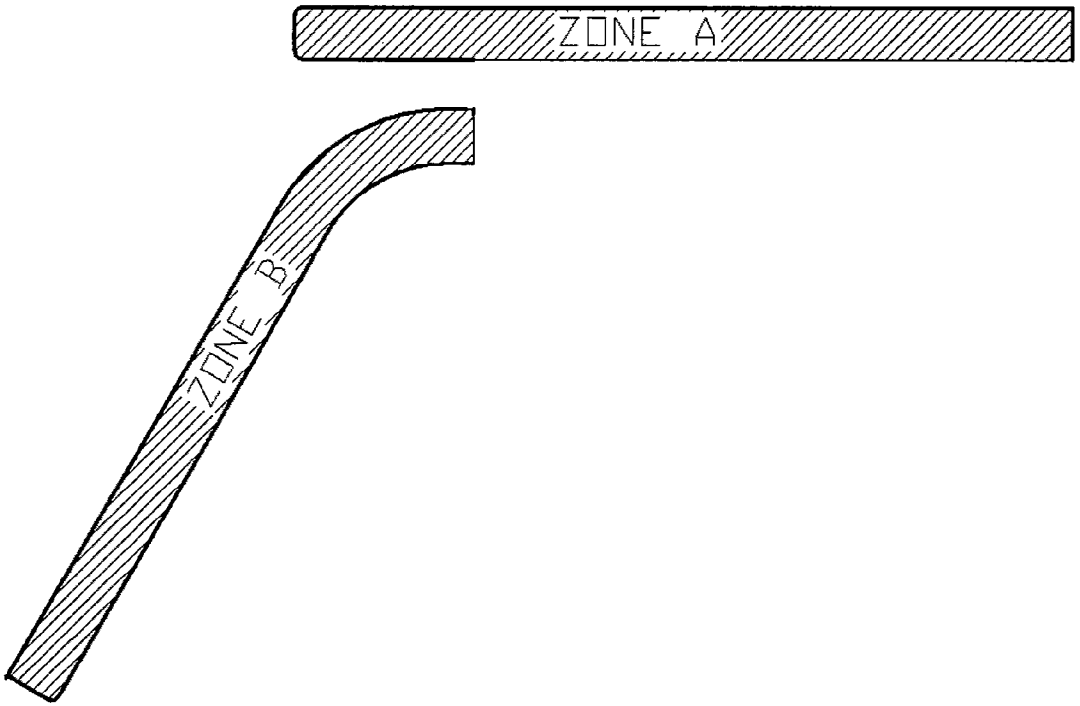
FIG. 8A shows SEPARATED CHANNEL GUIDES (with TRACK SEGMENTS ZONE A-ZONE B) in a Particular embodiment wherein the Zone B of the track is located inside a tunnel located inside the of the receiver handle.
Figure 8B:
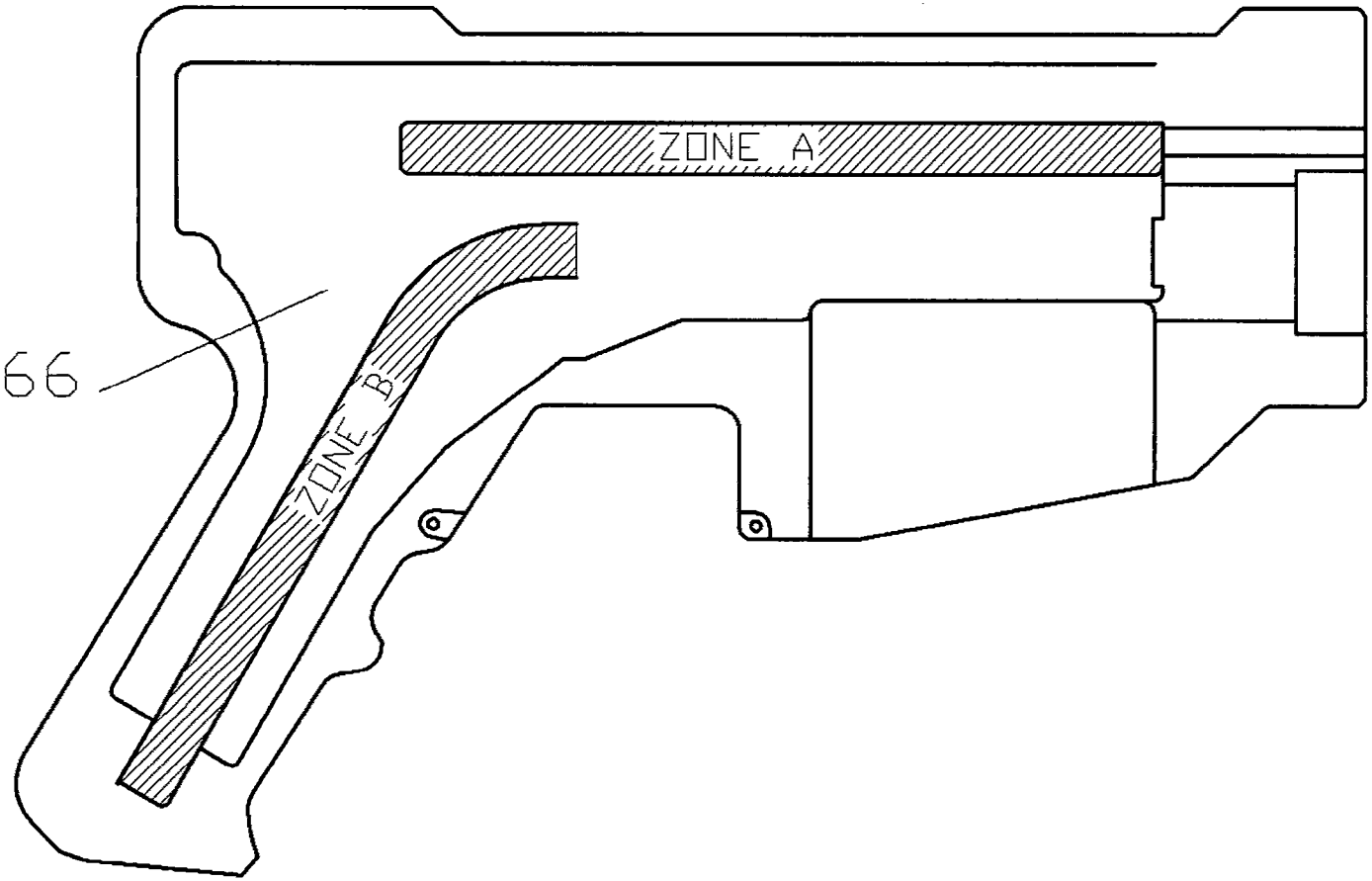
FIG. 8B shows a schematic view of POSSIBLE LOCATION OF CHANNEL GUIDES (TRACKS) ON A RECEIVER in a Particular embodiment.

FIG. 8A Shows dual separated channel guides track segments; zone a, zone b, which is an alternative array of paths and tracks, that assigns the upper straight track for the displacement of the Bolt Head only. Notice that the lower track may be extended horizontally, in parallel with the upper segment to support the total horizontal travel and alignment of the Articulated Bolt Train, even with the optional recoil Damper subassembly, when the design requirements demand.

Figure 9:
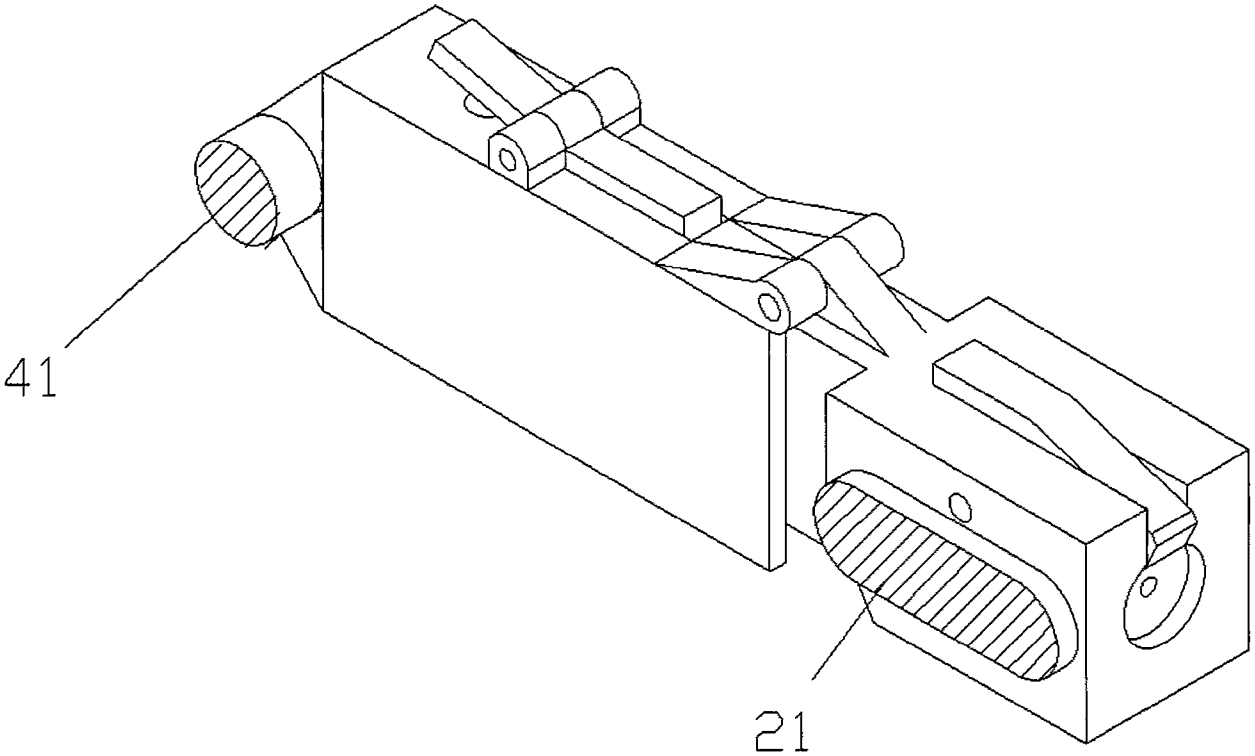
FIG. 9 shows an ARTICULATED BOLT TRAIN WITH ASSEMBLED BOLT AND MECHANISM CARRIER when aligned in a Particular embodiment.
Figure 9A:
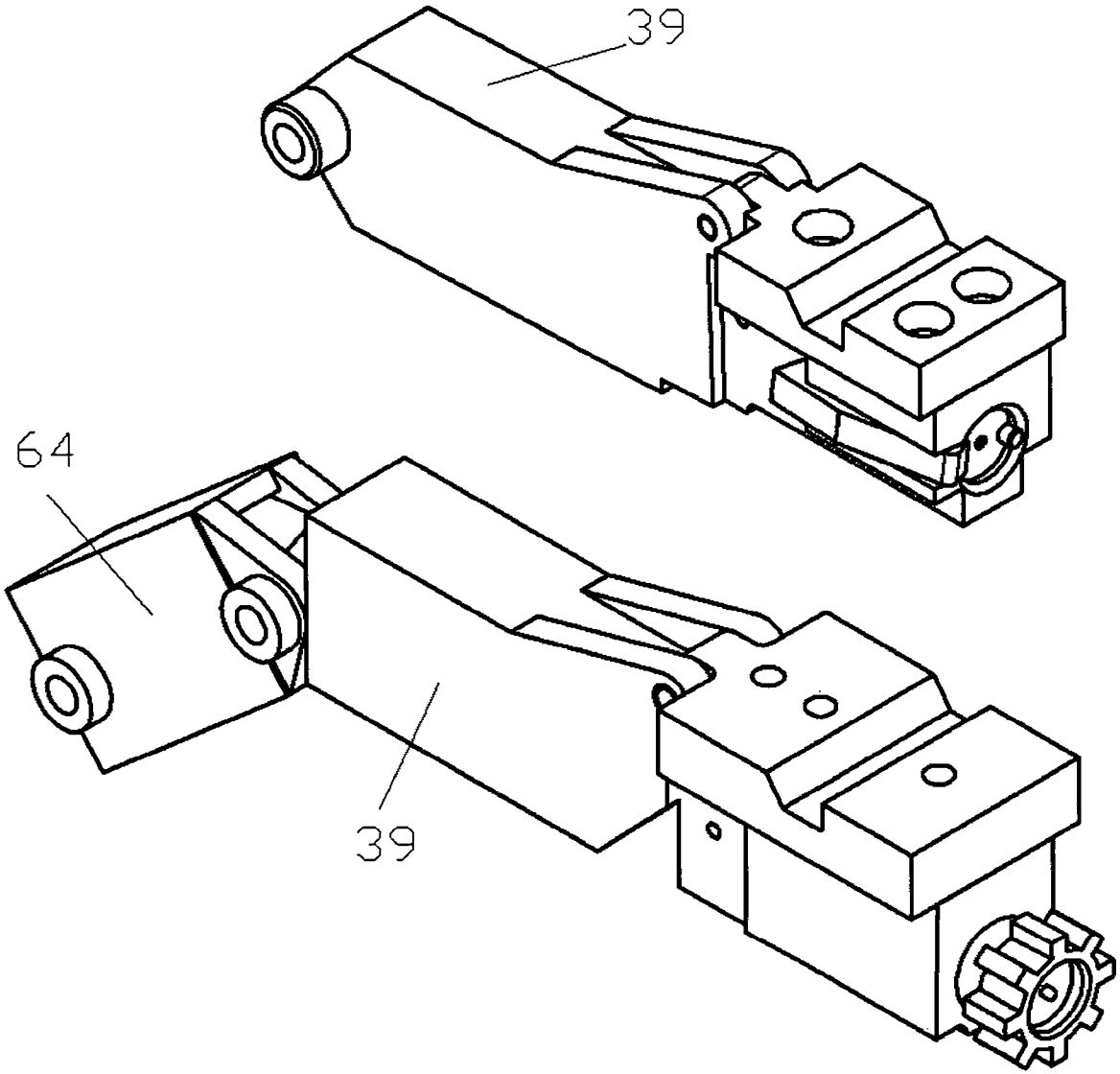
FIG. 9A shows an ARTICULATED BOLT TRAIN WITH TWO OR THREE SUB ASSEMBLIES element in a Particular embodiment.

FIG. 9A Shows two possible embodiments of the Articulated Bolt Train, with two members, or with three members. It can house rotary bolts when required to operate with long powerful rifle cartridges.

Figure 10:
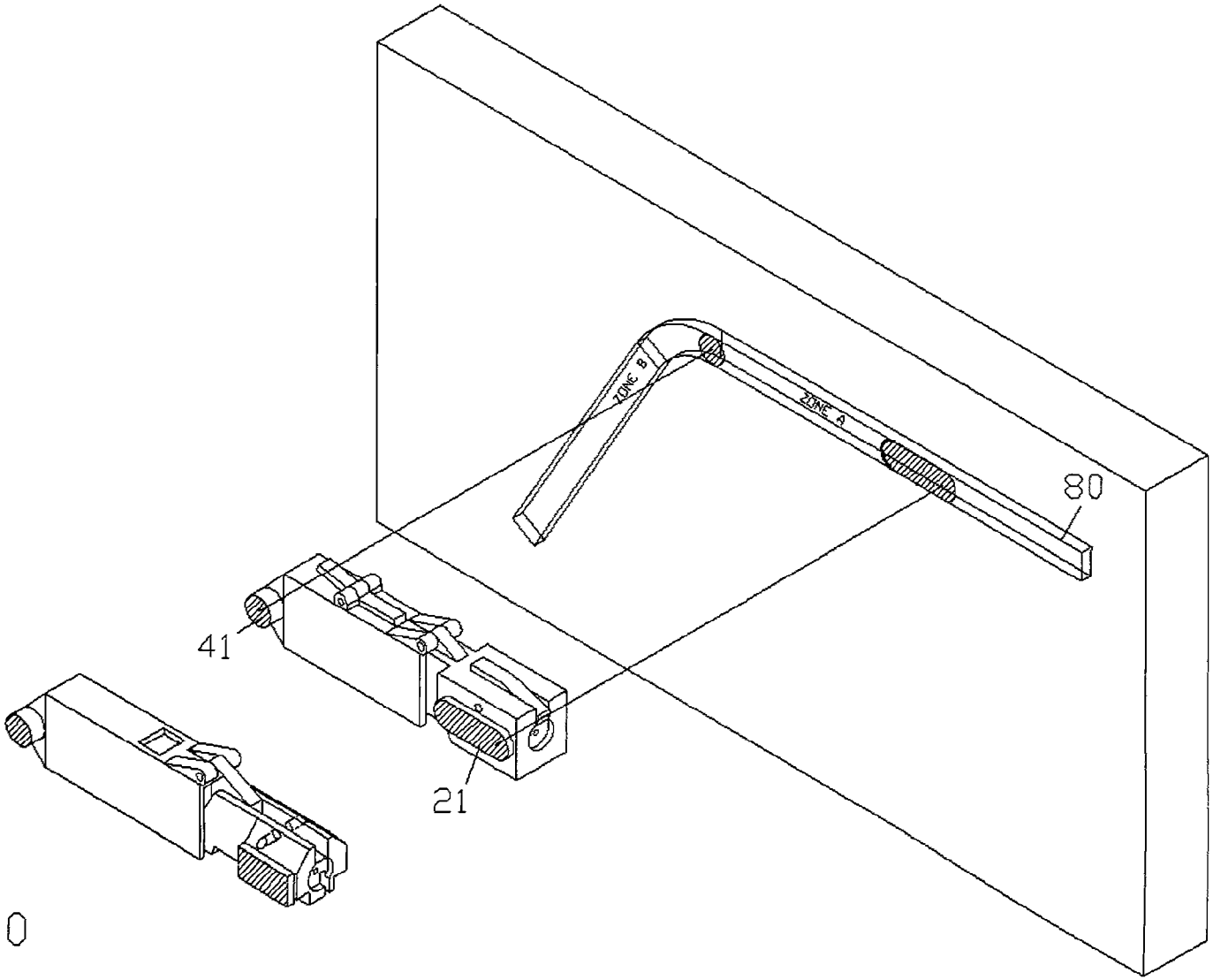
FIG. 10 shows the schematic PLACEMENT OF BOLT-MECHANISMS ON A CONTINUOUS CHANNEL TRACK in a Particular embodiment.

FIG. 10 Shows the schematic placement of Articulated Bolt Train on a continuous channel track. Notice that the front horizontal segment of the track is still unused, and can be extended according to design requirements. This ability is fundamental in the use of this mechanism in ling cartridges, not necessarily limited to rifle cartridges.

Figure 10A:
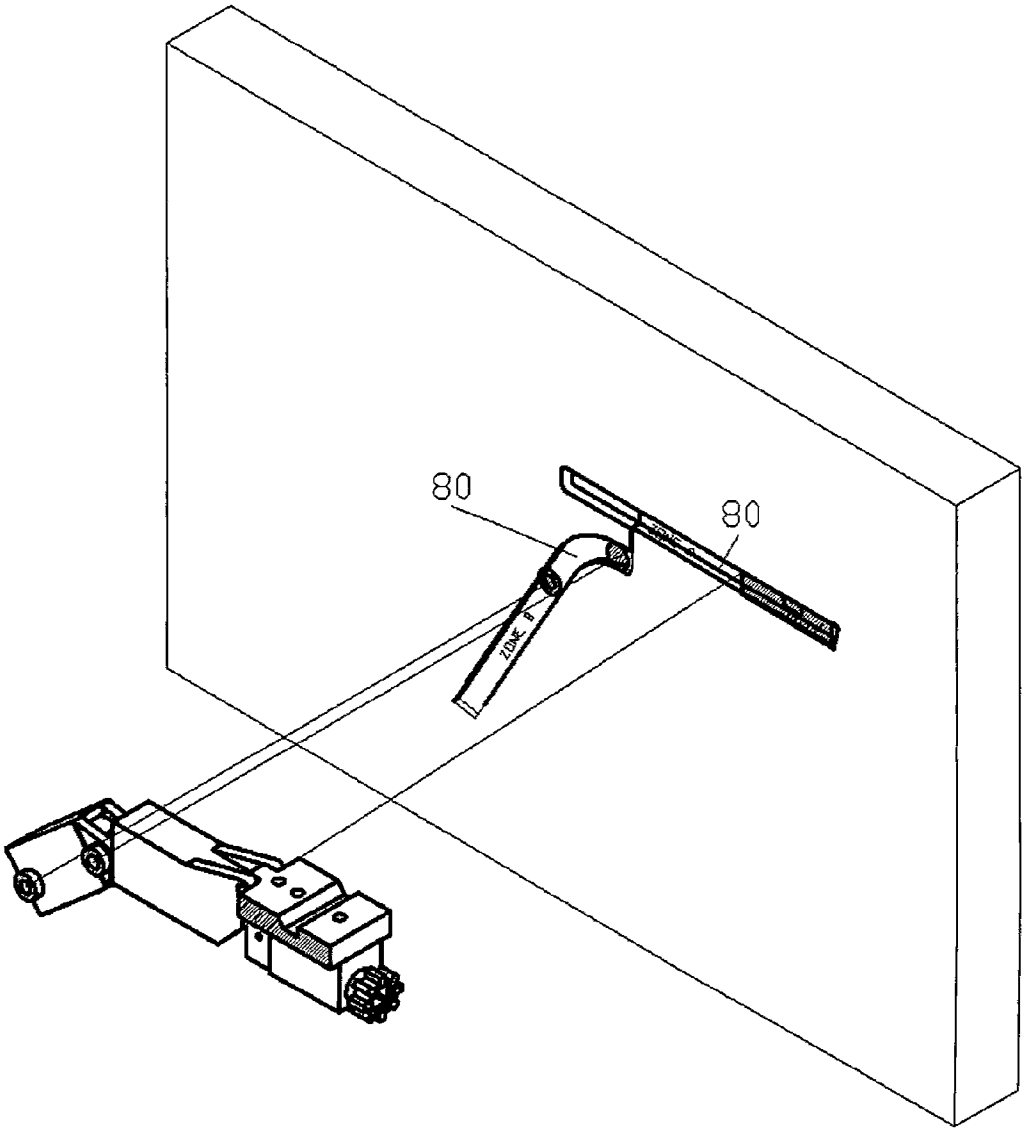
FIG. 10A shows the schematic PLACEMENT OF BOLT-MECHANISMS ON SEPARATED CHANNEL TRACKS in a Particular embodiment.
Figure 10B:
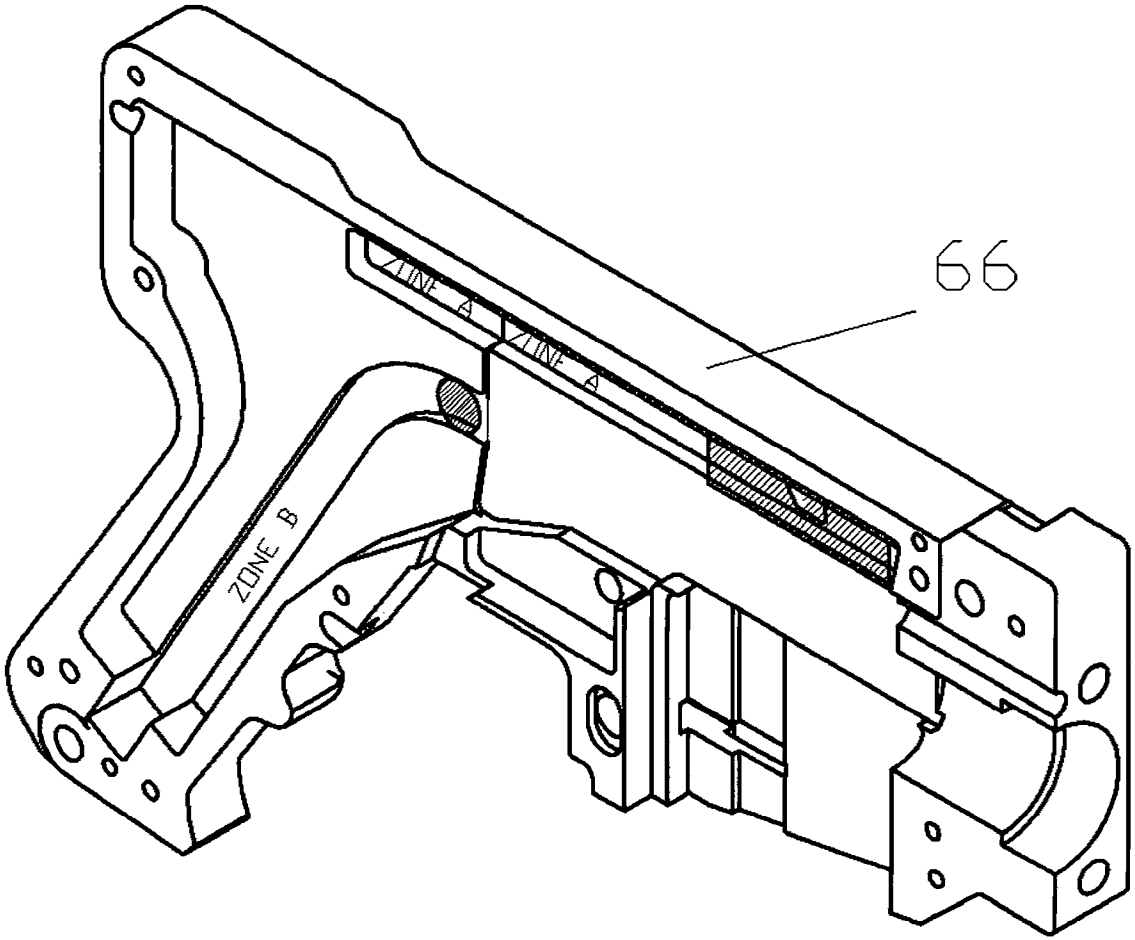
FIG. 10B shows the isometric cut view of the PLACEMENT OF SEPARATE CHANNEL GUIDES ON A RECEIVER in a Particular embodiment, wherein the Zone B of the track is located inside a tunnel located inside the of the receiver handle.

FIG. 10B Shows the placement of separated channel guides on a receiver. This array is convenient when compactness is a must.

Figure 12:
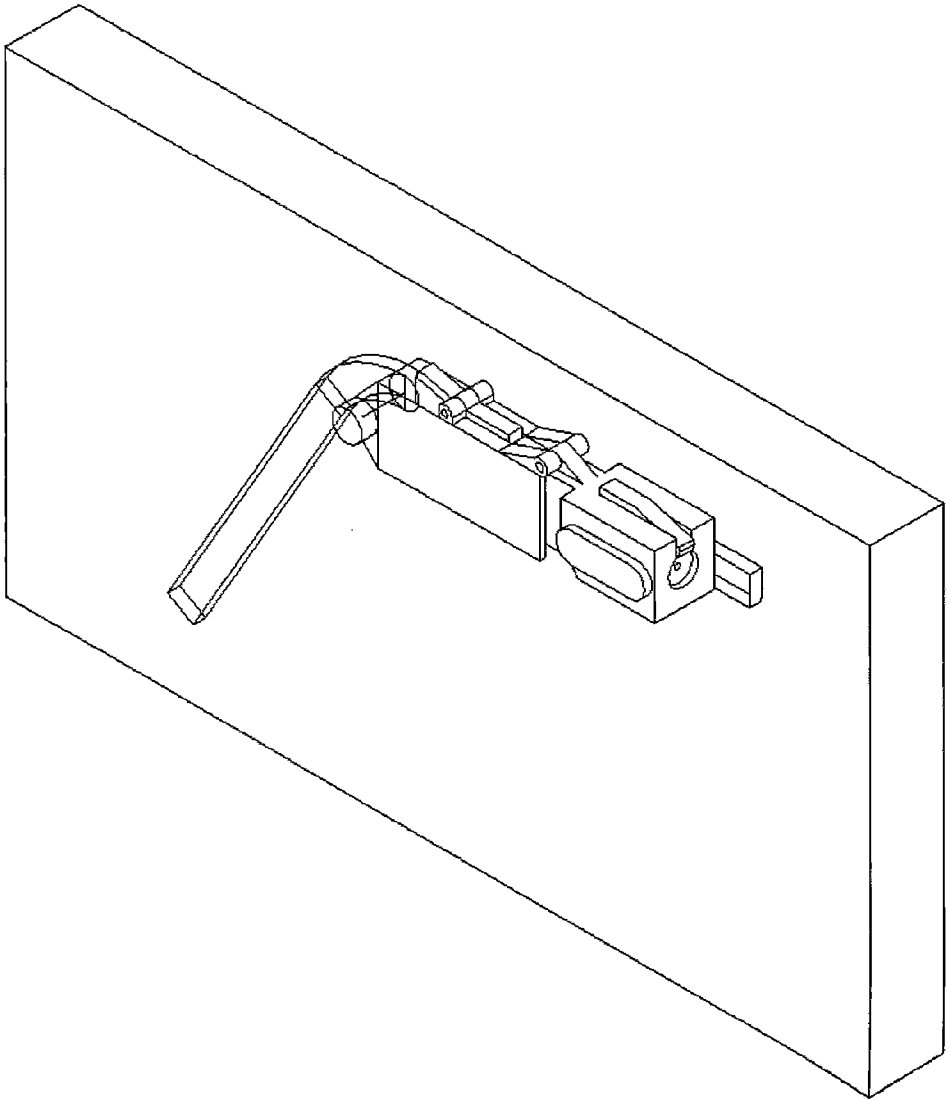
FIG. 12 shows the schematic PLACEMENT of the BOLT TRAIN IN FOREWARD PLACEMENT ON CONTINUOUS CHANNEL TRACKS in a Particular embodiment.
Figure 12A:
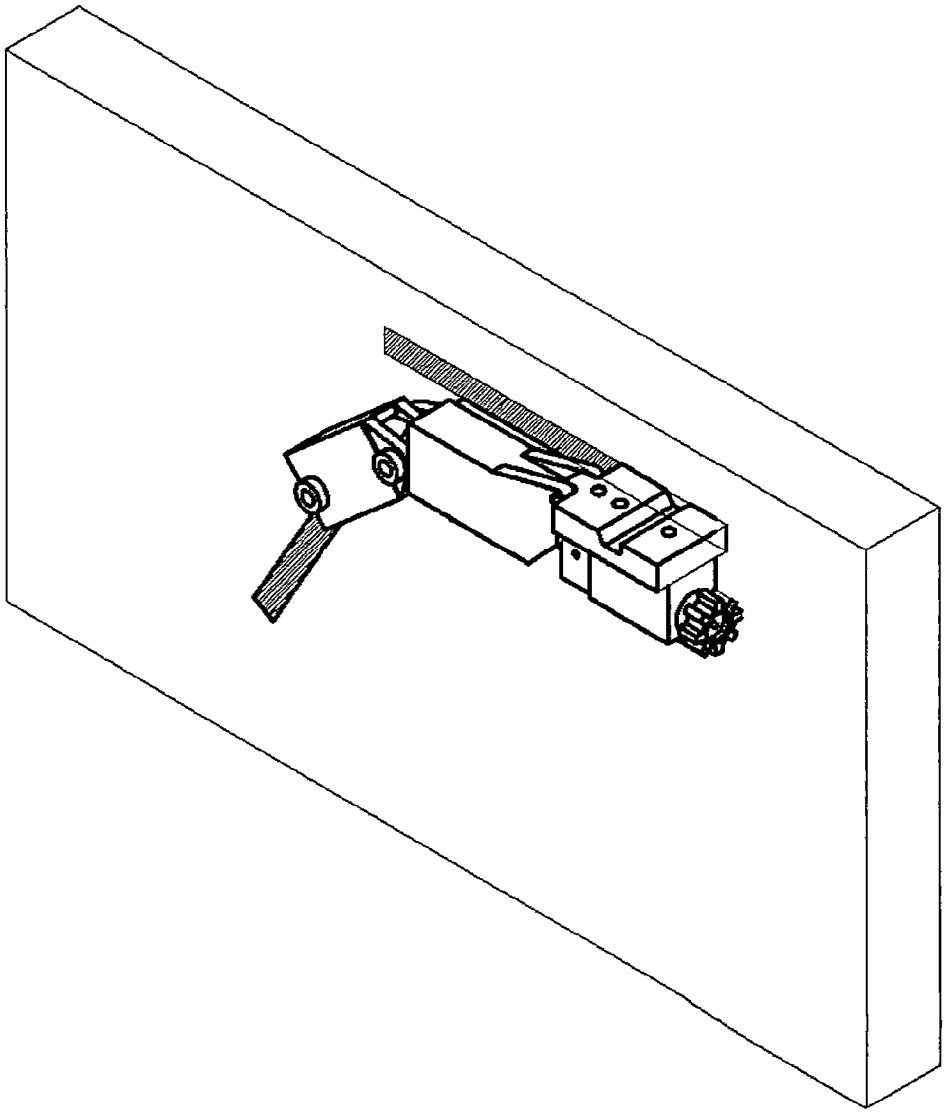
FIG. 12A shows the schematic placement BOLT TRAIN WITH THREE MEMBERS IN FOREWARD PLACEMENT ON SEPARATE CHANNEL TRACKS in a Particular embodiment.
Figure 12B:
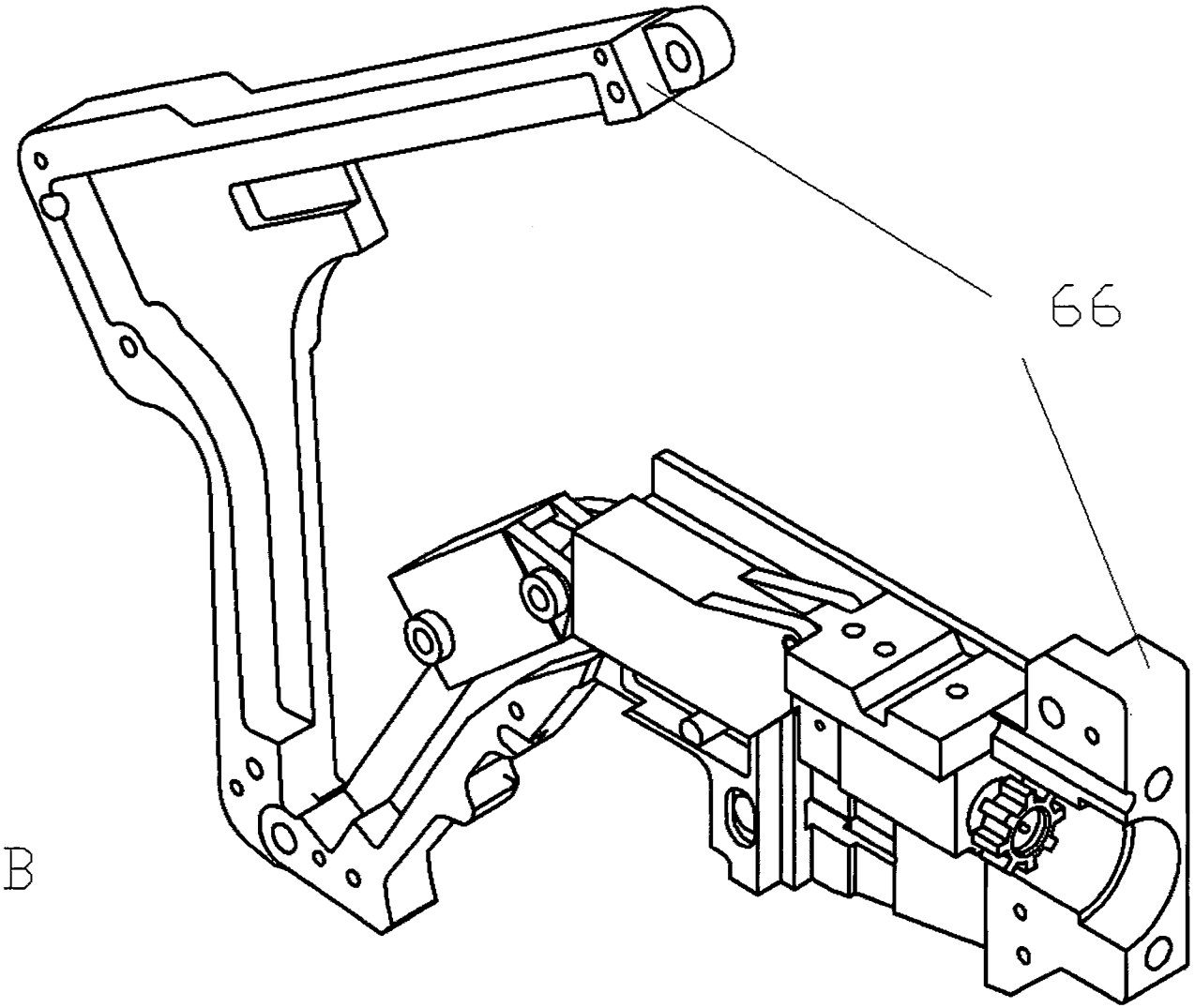
FIG. 12B shows the isometric placement of the BOLT TRAIN IN FOREWARD PLACEMENT INSIDE AN ARTICULATED OPEN RECEIVER showing the Upper and the lower receivers in an opened condition in a Particular embodiment.

FIG. 12B Shows an Articulated Bolt Train with a third optional recoil damper in the most forward position, inside an articulated open receiver. This figure illustrates also the receiver design that allows to open and close by pivoting about a point, and to completely define all tracks and cavities when closing.

Figure 12C:
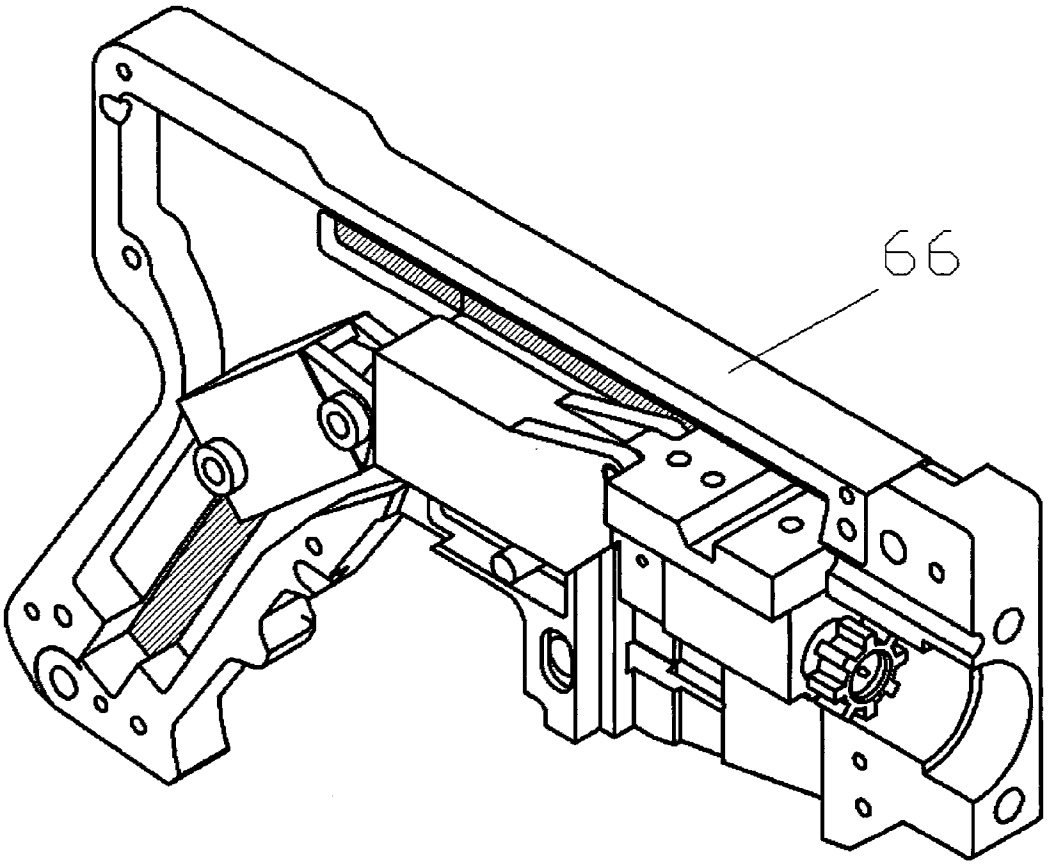
FIG. 12C shows the isometric placement of the BOLT TRAIN IN FOREWARD PLACEMENT INSIDE A CLOSED RECEIVER in a Particular embodiment, wherein the Zone B of the track is located inside a tunnel located inside the of the receiver handle.

FIG. 12C Shows an Articulated Bolt Train having the recoil damper attached, in most forward placement inside a closed receiver. As seen the Train will displace through the handle tunnel when recoiling.

Figure 12D:
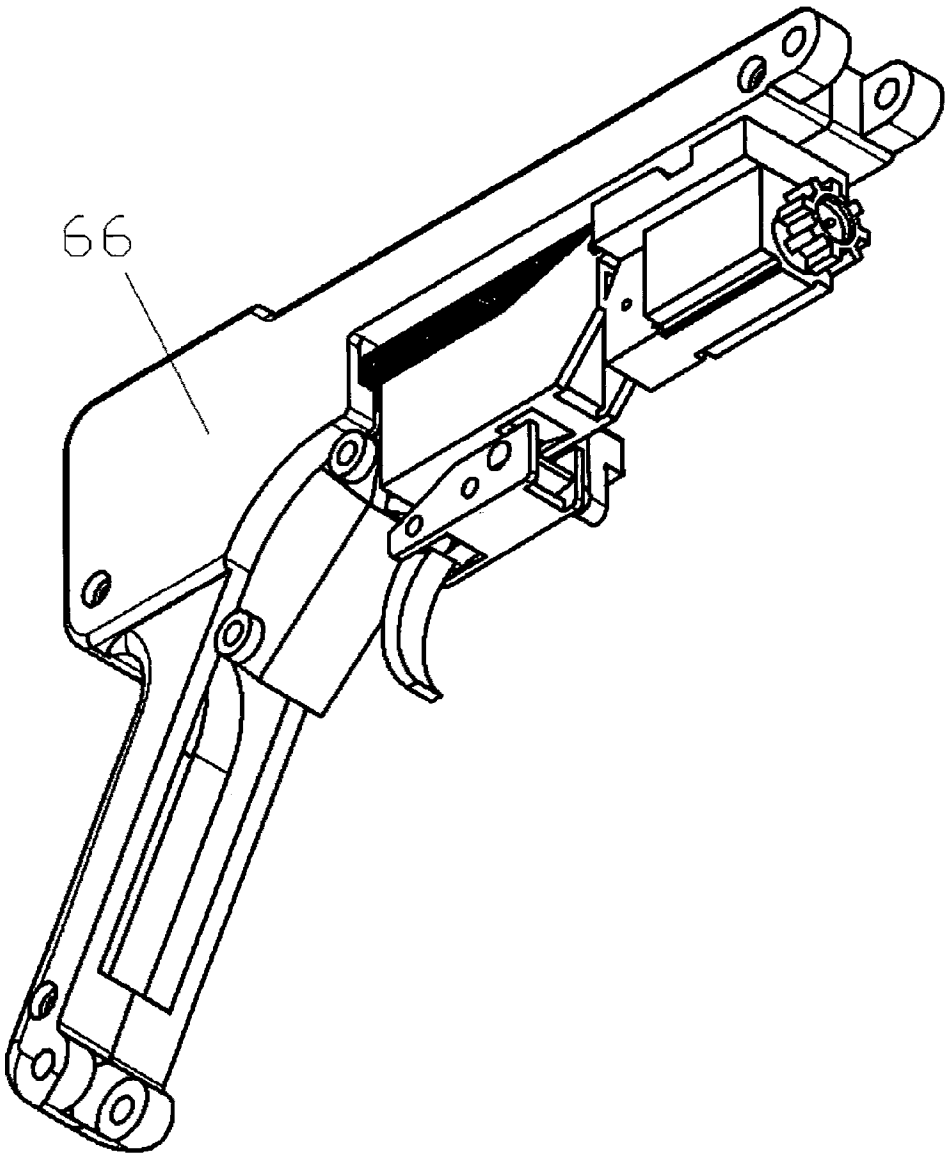
FIG. 12D shows the top isometric placement of the BOLT TRAIN IN FOREWARD PLACEMENT RELATIVE TO UPPER RECEIVER in a Particular embodiment, wherein the Zone B of the track is located inside a tunnel located inside the of the receiver handle.
Figure 12E:
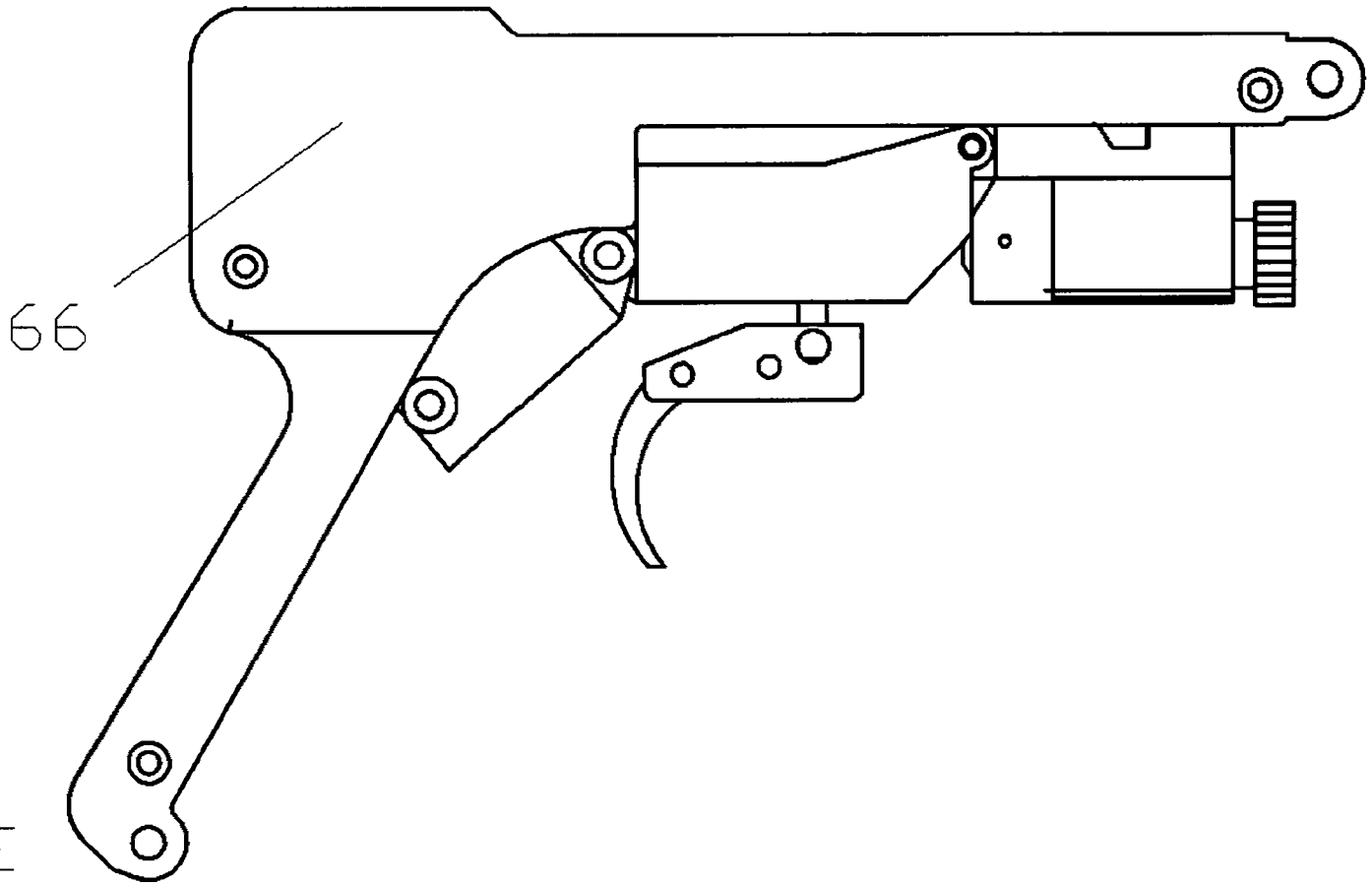
FIG. 12E shows the side view of the BOLT TRAIN in FOREWARD PLACEMENT RELATIVE TO UPPER RECEIVER in a Particular embodiment.

FIG. 12D Shows the Articulated Bolt Train in most forward placement relative to upper receiver. Notice the placement of the main spring, between the Active Firing Mechanism Carriage, and upper receiver, pushing the Bolt Head forward.

Figure 17:
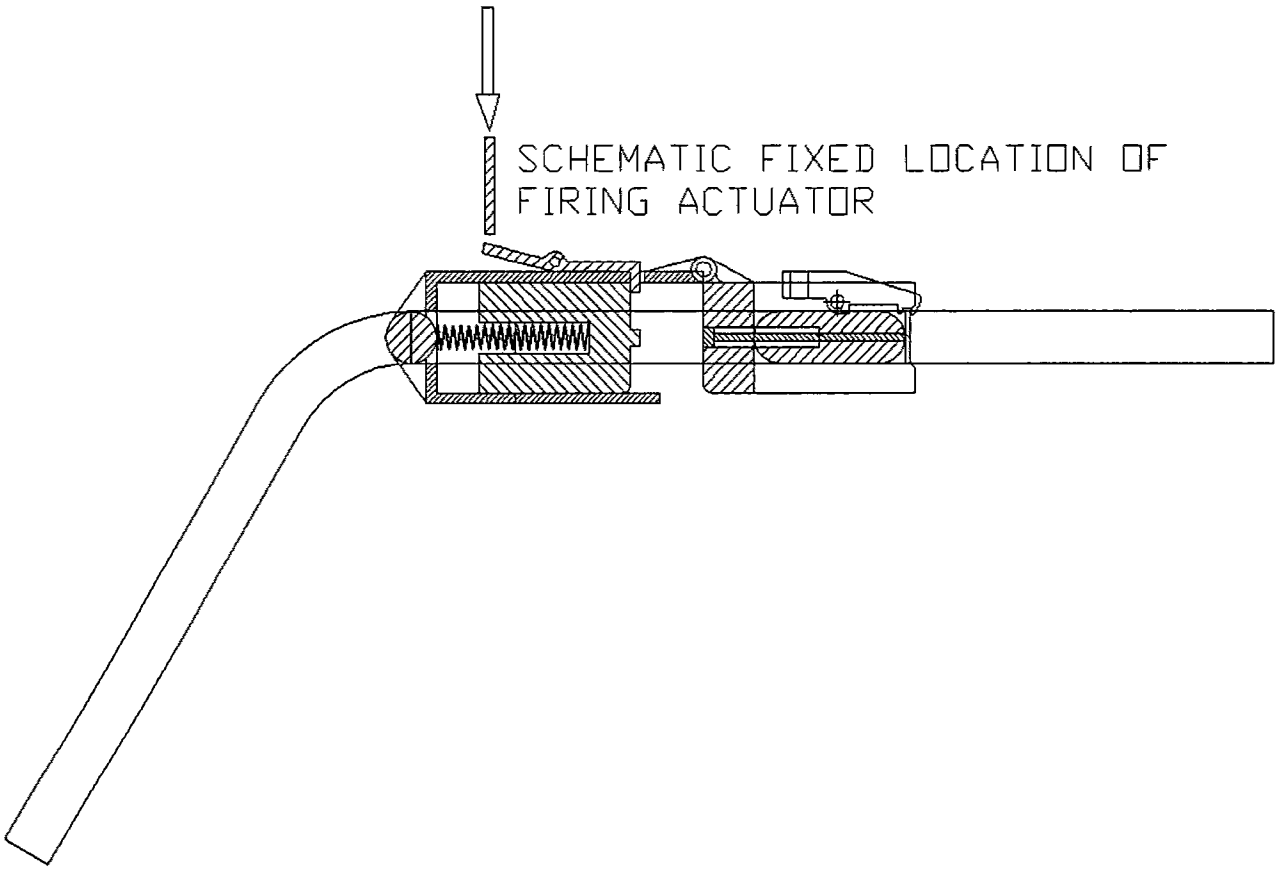
FIG. 17 shows a side cut view of the schematic FIRING MECHANISMS PLACEMENT ON AN EXTERNAL SEAR in a predetermined position, in a Particular embodiment.

FIG. 17 Shows the schematic placement of firing mechanism with an external sear. Many embodiments are possible for the convenient arrays for the Controlling Firing Mechanisms placement.

Figure 17A:
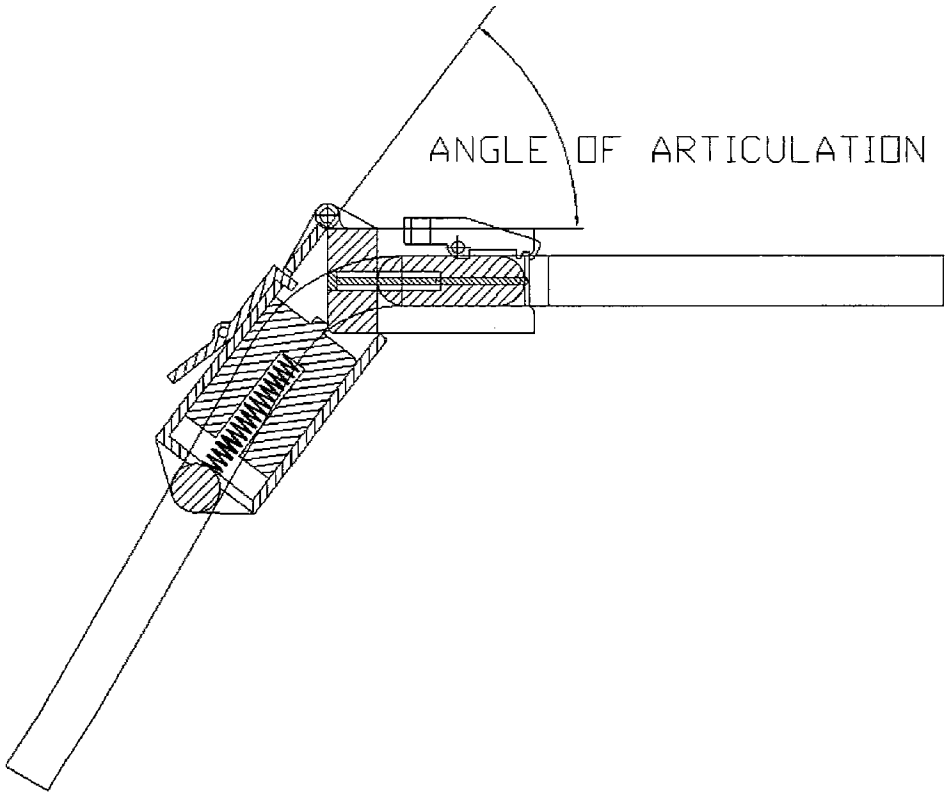
FIG. 17A shows a side cut view of the ANGLE OF ARTICULATION SCHMATIC when the Front Bolt moves horizontally rearwards, and the FIRING MECHANISM SUBASSEMBLY diverts its path transversally downwards, in a Particular embodiment.

FIG. 17A Shows the schematic of definition of the "angle of articulation" given by the angle formed by the intersection of the projection of the longitudinal axes of the Bolt and the Active Firing Mechanism Carriage.

Figure 18:
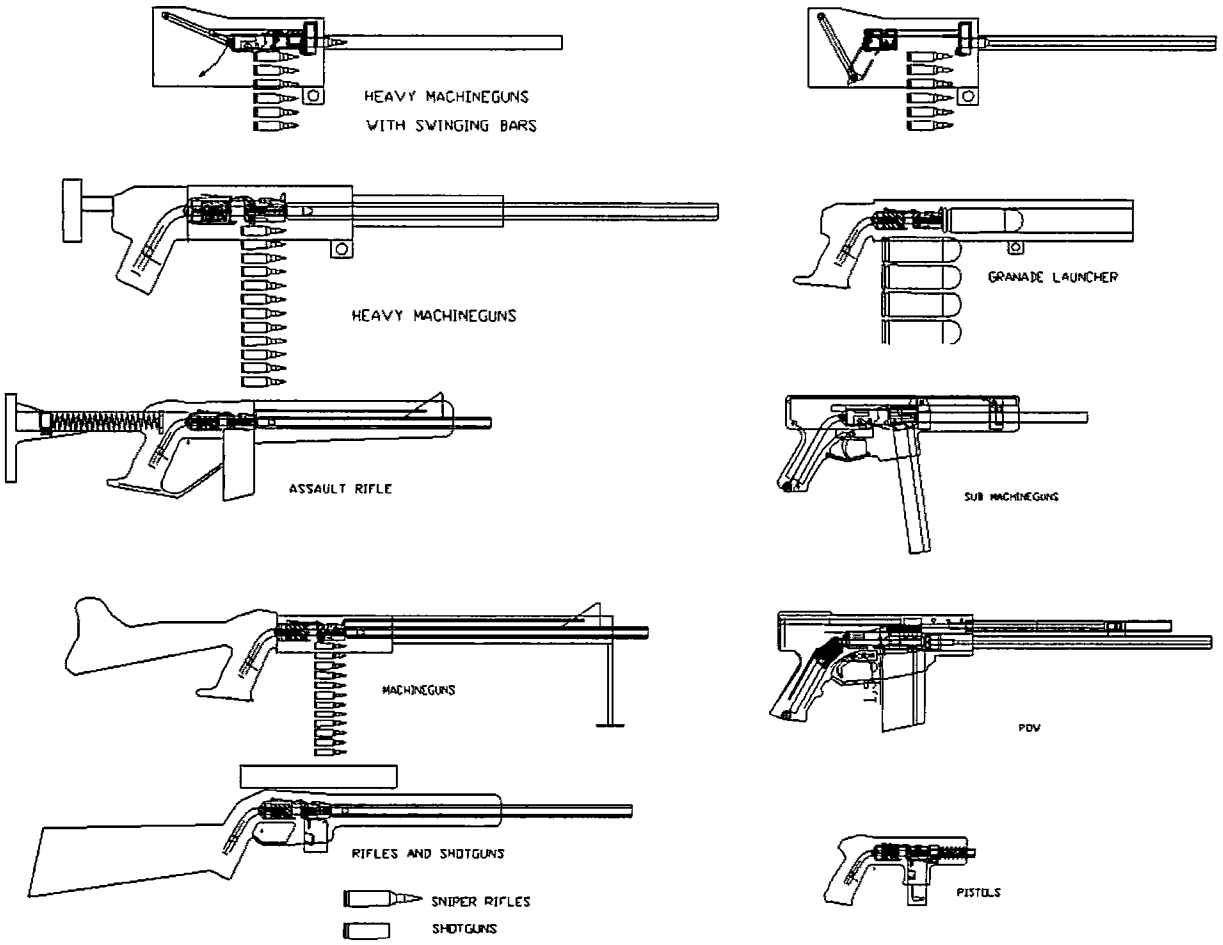
FIG. 18 shows a schematic view of several POSSIBLE USES OF THE PIVOTALLYARTICULATED BOLT TRAIN—in different types of firearms, in Particular embodiments.

FIG. 18 Shows a schematic with few of the numerous possible uses of Articulated Bolt Train Mechanism. Notice that all applications have a functional compact array in which the receiver cooperates with the bolt for the complete definition of tracks and cavities when closed.

Figure 22:
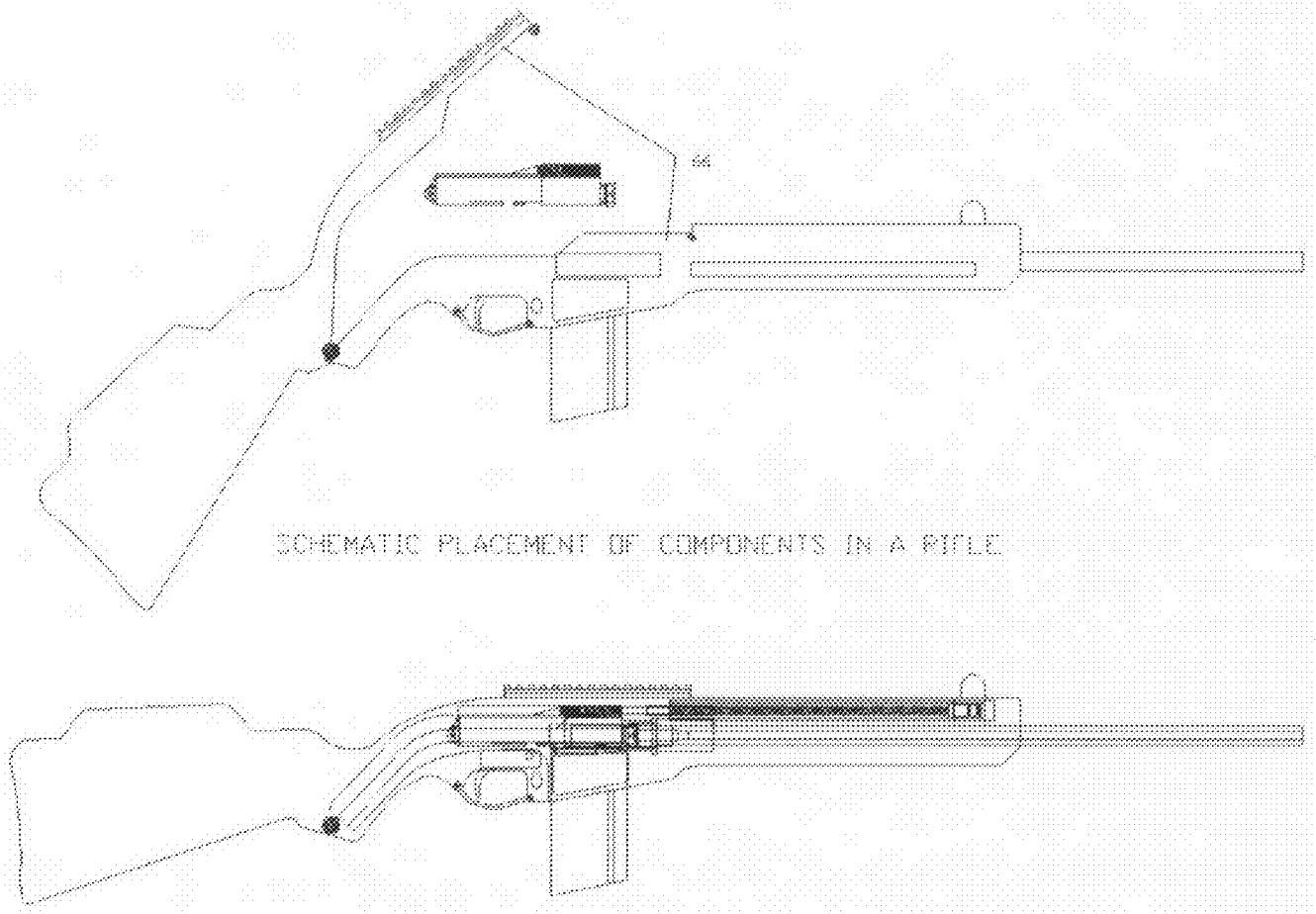
FIG. 22 shows a schematic view of the SCHEMATIC PLACEMENT OF COMPONENTS IN A RIFLE in a Particular embodiment. Notice that the track guides become completely constrictive when the upper and lower receiver members are placed together converting the Articulated Bolt Train mechanism to a completely constrained motion condition.

FIG. 22 Shows an schematic placement of the Bolt Train components on a rifle using large rifle cartridges, having a compact, functional, ergonomic, conventional silhouette, made possible only because of the small volume demanded by the Bolt Train to operate without sacrificing essential compactness.

Figure 23:
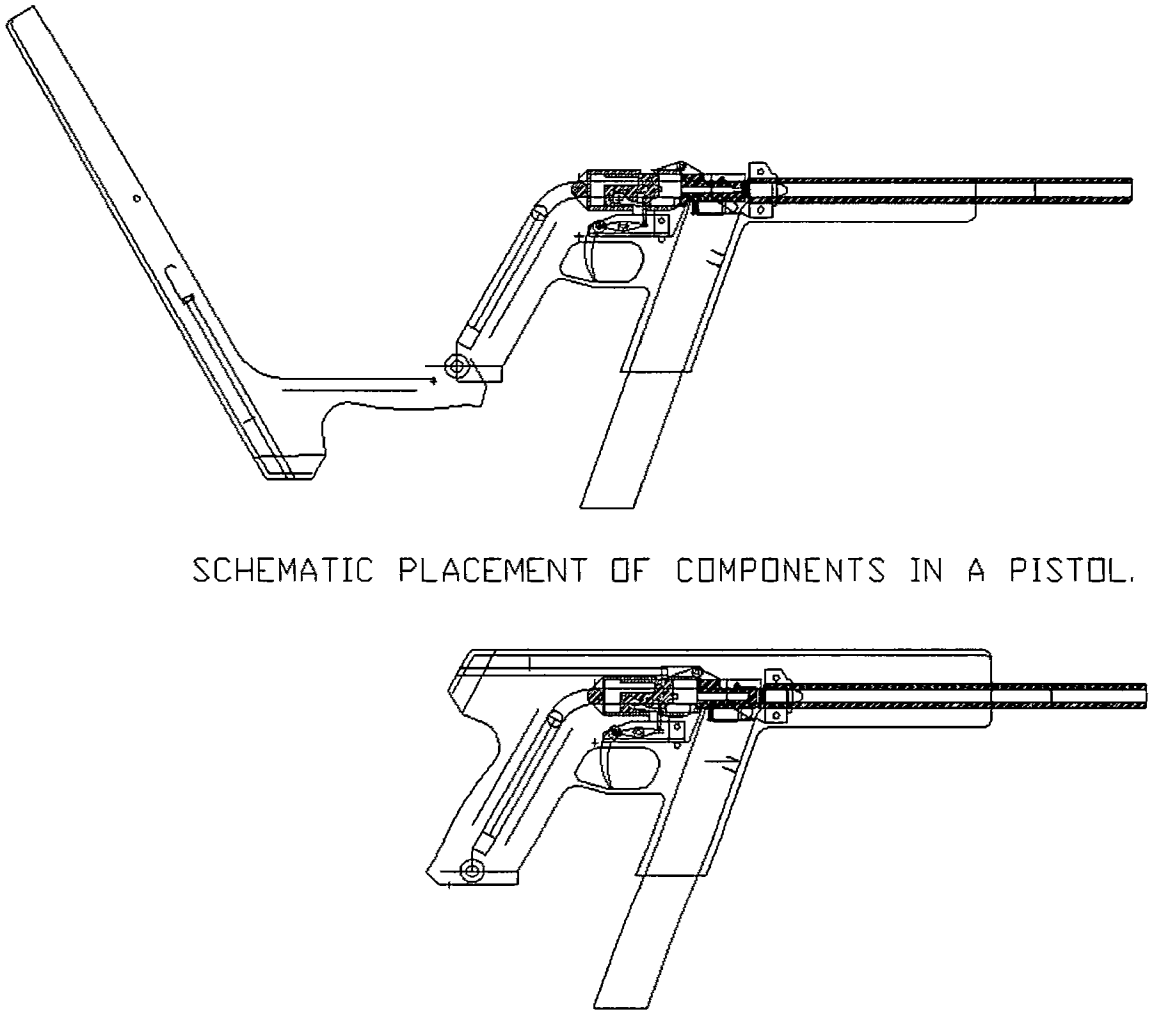
FIG. 23 shows a schematic view of the PLACEMENT OF COMPONENTS IN A POSITION in a Particular embodiment. Notice that the track guides become completely constrictive when the upper and lower receiver members are placed together converting the Articulated Bolt Train mechanism to a completel constrained motion condition.
Figure 24:
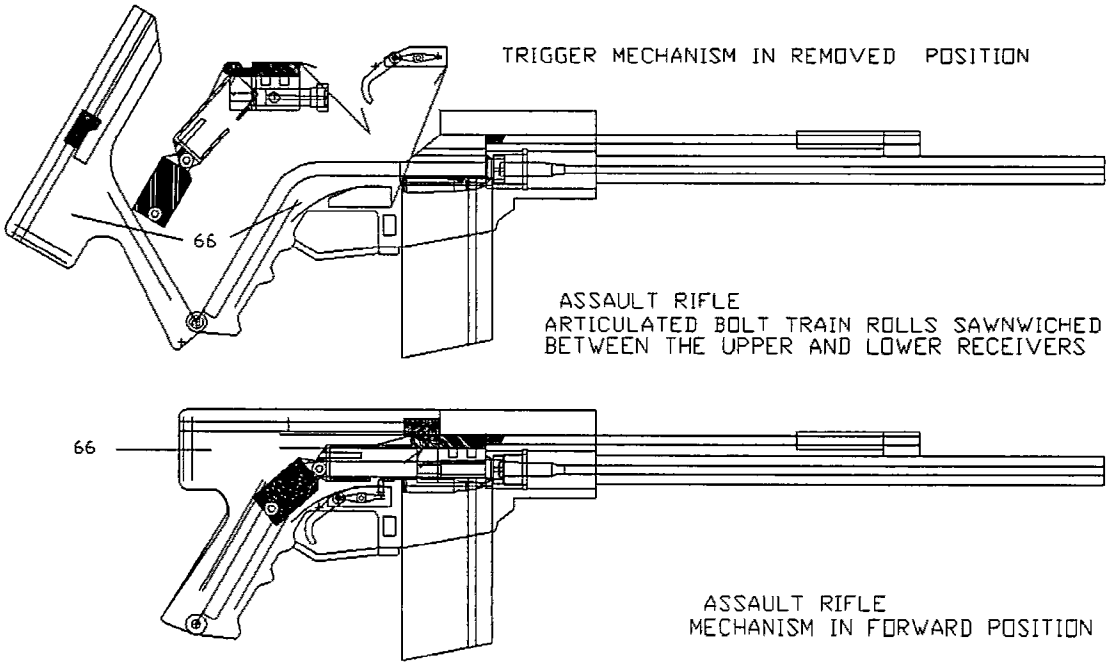
FIG. 24 shows a schematic view of the PLACEMENT OF COMPONENTS IN AN ASSAULT RIFLE in a Particular embodiment. Notice that the track guides become completely constrictive when the upper and lower receiver members are placed together converting the Articulated Bolt Train mechanism to a completely constrained motion condition.

FIG. 23 Shows the schematic placement of the bolt train components on a pistol with small cartridges, and the manner FIG. 24 Shows the schematic placement of the bolt train components on an Assault Rifle, utilizing an Articulated Bolt Train of three members, displacing transversally downwards through the tunnel handle, in a compact, classic, modern silhouette.

PURPOSES

This invention focuses in providing solutions to the problems, deficiencies and limitations of previous firearms designs, through achieving several different purposes or objectives, all of them having equal importance, which sometimes compete one against each other, in a manner that demands sacrificing the prevalence of one objective over others in order to merge, in a sensible way, the accomplishment of all objectives. It is a careful trade of ergonomics, portability, fire power, recoil comfort, ease of field service and manufacturing, lowering of the center of gravity, compactness and conventional silhouette.

It is a rational application of kinematics analysis in which input and out put motions are combined through an array which poses no limitations to the Pivotally Articulated Bolt Train in its motion in the horizontal axis.

It allows its smooth continuous displacement, partially transitioning from a complete horizontal alignment with the axis of the barrel to a curved downwards and transversal path thorough the handle tunnel, while gliding through the path without obstacles.

PURPOSES OR OBJECTIVES, DETAILED DESCRIPTION

Several objectives or purposes are achieved in this invention, and the numeral order in which they are presented is for the purpose of organization of this writing only, and certainly are not associated to its importance relative to the other objectives. All objectives are considered of equal importance in the achievement of the goal of mixing the objectives in a manner that all are satisfied practically.

This invention has seven different purposes or objectives, all having equal relevance. The order in which they are mentioned is not representative of the relevance. The first: To provide a Bolt Train mechanism, capable of aligning completely horizontally when closing the breech, to partially redirect the initial bore axial recoil force into a transversally directed recoil force and to perform several other functions; The second: To provide a firing mechanism subassembly incorporated to the Bolt Train that would displace altogether as part of the recoiling mass, being capable of aligning with, and traveling horizontally, along the axis of the barrel a long enough distance to load and eject at least large rifle cartridges; The third: To provide a firing mechanism subassembly incorporated to the Bolt Train 90 that cocks in response to the backwards recoil displacement, of the Pivotally Articulated Bolt Train, and to the angular rotation of the its components of the bolt train while displacing rearwards following a transverse path; The fourth: To provide a manageable cam delay blowback mechanism to retard the opening of the breech operating only on rearward motion; The fifth: To significantly reduce the total weight, and volume of the firearm utilizing the Bolt Train mechanism; The sixth: To lower the center of gravity of the firearm utilizing the Bolt Train mechanism; The Seventh: To provide an independent Recoil Damper Mechanism attachable to the Bolt Train sub assembly to additionally restrain the rearwards motion increasing the total delay.

In response to the force needed to propel a projectile on a firearm, the bolt experiments a rearward axial reaction force known as recoil force. In auto loading guns the bolt is forced forward by a recoil counter acting spring, but when the recoil force exceeds that of the spring, the bolt moves rearwards allowing the used cartridge to be expelled, and when cycling back, a new cartridge is moved into the chamber in the reciprocating recovery movement, completing the auto loading cycle. In this process, the force acting on the bolt is axial and is transmitted to the frame creating a kick that, depending on the total mass of the gun, causes a displacement which is perceived as a jump in the gun. Large caliber weapons produce significant recoil upon firing to the point that firing such a weapon poses a significant risk of recoil-induced injury to the shooter when it is not firmly supported. The recoil force experienced by the shooter of a conventional weapon is proportional to the product of the projectile mass, and the acceleration of the projectile by the propelling gases, and inversely proportional to the total mass of the gun. Accordingly, there exists a need for a system that reduces recoil in firearms and weapons.

This invention uses a Bolt Train 90 consisting of two or more track mounted members, pivotally articulately and connected between the adjacent members. The first member of the Bolt Train 90 is a Front Bolt 20, or alternatively a Bolt Carrier 20B containing a Rotary Bolt 20C, which initially travels axially only, The Second member is an Mechanism Carriage Housing 40 or alternatively 40B containing, and including, the Active Firing Mechanisms and progressively diverts its path to a downwards or transverse motion as the front bolt 20 displaces rearwards. When needed, a third optional member is incorporated to the Bolt Train 90. It is a Recoil Damper Subassembly 64, that travels linearly or transversally, comprised of a Recoil damper mechanism carrier 65 containing a movable compensator 67 and a spring 69A. The Bolt Train 90 is track slidably mounted by means of protruding guides 21 or by roller guides 41 or 41 A that slide in lateral slot Channel guides 80 embedded or attached to the receiver 66 frame. The slot Channel guides 80 have a path that uniquely directs the displacement of the Bolt Train 90. Because the Firing Mechanism Sub Assembly 39 FIG. 4B, FIG. 5B is articulately linked to the front bolt 20 it always places the firing mechanisms in the closest proximity of the firing pin 70, located inside the front bolt 20. This train array reduces the total weight and the volume, by eliminating the need of having a fixed separate mechanisms subassembly, in other location. The necessary mass to absorb the recoil is present in this transversally recoiling array, but at the same time, is the same mass used in the active firing mechanisms. The mass and volume of the conventional active firing mechanism and its frame are converted into recoiling mass having a very compact volume.

The Articulated Bolt Train 90 is also a kinetic energy multi absorption device. It accomplishes it in several independent ways:

1. By compressing the main recoil spring.
2. By diverting the path of the Mechanism Carriage Housing 40 and parts contained within. The reaction force of the change of direction is perceived in the receiver as a vertical and rearwards movement.
3. By amplifying the force required to compress the Hammer spring 33 via the principle of mechanism explained in the fourth purpose.
4. By compressing the Hammer spring 33 while cocking as explained in the third purpose.
5. By compressing the Spring 69A, and pushing the Movable Compensator 67 of the optional Recoil Damper Mechanism
6. By utilizing the mass of all the above mentioned mechanisms as working mass to compensate the recoil, saving mass and volume that otherwise would be required to perform the same results in independent mechanisms.

As before mentioned, this invention has seven different purposes. The first: To provide a Bolt Train mechanism to partially redirect the initial bore axial recoil force into a transversally directed recoil force and to perform several other functions; The second: To provide a firing mechanism subassembly incorporated to the Bolt Train that would displace altogether as part of the recoiling mass; The third: To provide a firing mechanism subassembly incorporated to the Bolt Train 90 that cocks in response to the recoil displacement, and to the angular rotation of the components of the bolt train while displacing rearwards following a transverse path; The fourth: To provide a manageable cam delay blowback mechanism to retard the opening of the breech operating only on rearward motion; The fifth: To significantly reduce the total weight, and volume of the firearm utilizing the Bolt Train mechanism; The sixth: To lower the center of gravity of the firearm utilizing the Bolt Train mechanism; The Seventh: To provide an independent Recoil Damper Mechanism attachable to the Bolt Train sub assembly to additionally restrain the rearwards motion increasing the total delay. Additionally restrain the rearwards motion, increasing the total delay.

OPERATION

Description of How the Invention Achieves its First Purpose

To provide a Bolt Train mechanism to partially reroute the initial bore axial recoil force into a transversally directed recoil force and perform several other functions.

In one embodiment the Bolt Train 90 can have a plurality of members interconnected by hinges, or any other proper interlinking means, one after the other that move guided along slot channel guides 80. None of the members is a dead mass, each has a specific function and a mechanism inside the corresponding carrier housing. In order to function properly, the Bolt Train 90 has to be placed inside a by design Receiver 66 that controls and urges its path, and holds all the sub assemblies in the convenient location, allowing the synchronic movements of all the components to take place in time and space.

The Receiver 66 is conceived in a manner that it has an Upper receiver and a Lower receiver, so that when both are put together, it will completely define and constrain a plurality of cavities and tracks to enable the unique travel of the Bolt Train 90, and the housing of the modular subassemblies and components of the firearm.

Figure 19:
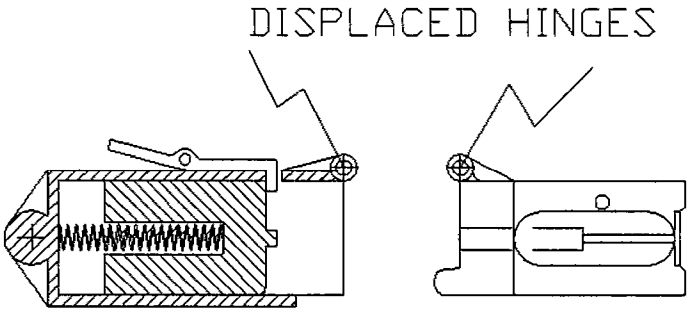
FIG. 19 shows a schematic view of the LOCATION OF DISPLACED HINGES when disengaged, in a Particular embodiment.

When a firearm is discharged there is a reaction force in the opposite direction of the projectile. That causes the Bolt to displace rearwards over a straight path. In the case of This invention, the bolt is comprised by several articulately linked members that form a Bolt Train 90. The bolt train 90 consists of two or more different bodies. See FIG. 9A, FIG. 10, FIG. 10A. The front bolt 20, and mechanisms carrier housing 40, are connected by a pin 47 that holds together the top displaced hinge 24 of the front bolt 20 and mechanisms carrier housing displaced hinge 48. Hinges 24 and 48 can be displaced outside of the bodies to which they are attached and the center of the hinges holes host pin 47, FIG. 19. The total mass of the bolt train 90 is the sum of the mass of front bolt 20 with all the elements that get attached to it, plus the mass of the mechanisms carrier housing 40 with all the elements that get attached to it and hold inside it (the firing mechanisms). plus the mass of the recoil damper mechanism carrier 64 and all the elements that get attached to it. See FIG. 9A. The Bolt Train 90 is track mounted on slot Channel guide tracks 80 embedded inside the internal sides of the receiver 66 and direct the course (path) in a transverse direction. The Channel guide 80 are internally stamped, embedded or held on the firearm frame. At the moment of firing the cartridge transmits the total recoil force to the bolt train 90. The protruding guides 21 (one at the right other at the left) slide inside the slot Channel guide 80 located on both sides of the cavity where the bolt train 90 moves. Slot Channel guides 80 can be continuous or separated as shown in FIG. 8 and FIG. 8A. The Roller guides 41, which are round, also slide inside the slot Channel guides 80. The slot Channel guides 80 are built to the proper length or may have travel stops to limit the rearwards displacement of the Bolt Train 90. The forward displacement of the front bolt 20 is limited by proper means depending on the design application. The slot Channel guides 80 can be of continuous path as shown on FIG. 8, FIG. 10, FIG. 12 or separate discontinuous paths as shown on FIG. 8A, FIG. 8B, FIG. 10B, FIG. 11, FIG. 12A, FIG. 12 C. Due to its design the horizontal protruding guides 21 of front bolt 20, can displace linearly inside the slot Channel guide 80 within the zone A FIG. 8. Due to the integral design of the bolt train 90, the protruding rod guides 41 or the rollers 41A can move within the zone B, FIG. 8, or FIG. 8A. When the bolt train 90 moves to the back from the forward position, the front bolt 20 displaces linearly, urging the displacement of the mechanisms carrier housing 40 with all contained within (the firing mechanisms) by means of bolt top hinge 24, the mechanisms housing carrier hinge 48, and the connecting pin 47. The latter named parts (24, 48, and 47) interlock the first two bodies (20 and 40) of the Bolt Train, and all the contained components, in an articulated manner that enables the rotation about the connecting pin 47. The mechanisms carrier housing 40 with all the elements contained inside (the firing mechanisms), moves transversally only through the zone B. A conventional main recovery spring needs to be permanently acting on the front bolt 20 either by pushing or by pulling, depending on the design needs, in order to urge the return of the bolt train 90 to the full forward position after it has displaced back and down by the action of the recoil force.

The transverse displacement of the recoiling bolt train 90 changes the direction, and the dynamics of the recoil with respect to traditional bore axis lineal recoiling bolts.

OPERATION

Description of How the Invention Achieves its Second Purpose

To provide a firing mechanism subassembly incorporated to the Bolt Train 90 that displaces altogether as part of the recoiling mass.

In one embodiment the firing mechanisms have two different separate types of sub assemblies: The controlling firing mechanisms subassembly 74, FIG. 5C, which has a permanent location, and the Active Firing Mechanism Subassembly 39 FIG. 5B, which moves as a part of the Bolt Train 90.

The lever 76, and the spring column fire actuator, and disconnector 78 all mounted on the frame 79, and the active firing mechanism subassembly 39, FIG. 5B which comprises the hammer, the hammer spring, the sear, sear lever. In conventional designs all of the components of the firing mechanisms are placed together in one subassembly kept in place by a strong frame. The Active Firing Mechanism Subassembly 39, FIG. 5B is located in the closest proximity to the Front Bolt 20, 20*a*, 20*b* FIG. 2B, and linked by means of a hinges 48 and 24 in a manner that they become moveable and integrally coupled to the Articulated Bolt Train 90 and fit into a one and only predetermined placement in a synchronized movement at the moment of firing.

The mechanism works in the following way. See FIG. 1. The hammer 30 has the form of a rectangular prism at the rear end it has cylindrical cavity for the spring 31. This hammer has an optional frontal protruding push rod for the firing pin 32.

All of it is a single body with no moving parts. The above mentioned parts move freely inside a rectangular cavity 40A of the mechanisms carrier housing 40. Alternatively, an angular sear lever 50 is attached at the top side of the mechanisms carrier housing 40 by means of a pin for sear lever which passes through holes for pin 44 and the hole for sear lever pin 52 of the hinges for sear pin 43 and hole for sear lever hinge pin 52 respectively. The angular sear lever 50 has a small angular face tip 54 that passes through a rectangular hole for the sear tip 45.

A sear lever spring 53 accommodates into the cylindrical hole for sear spring 42 and pushes the angular sear lever 50 so that the angular sear lever 50 is permanently pushed into the rectangular hole for the sear tip 45. The angular face tip 54 is long enough to cause a temporary interference with the frontal face of the hammer 30 retaining it in a cocked loaded position when the hammer 30 is moved enough to the rear inside the rectangular cavity 40A of the mechanisms carrier housing 40 causing the compression of the hammer spring 33.

Figure 13:
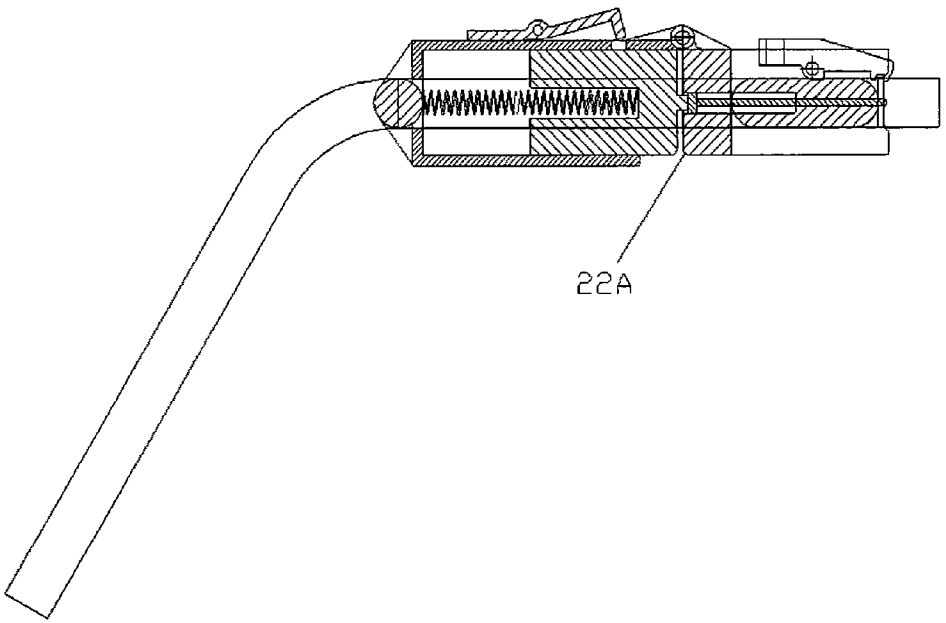
FIG. 13 shows the side cut view OF the BOLT TRAIN IN FIRING POSITION when placed in a continuous track in a Particular embodiment.
Figure 14A:
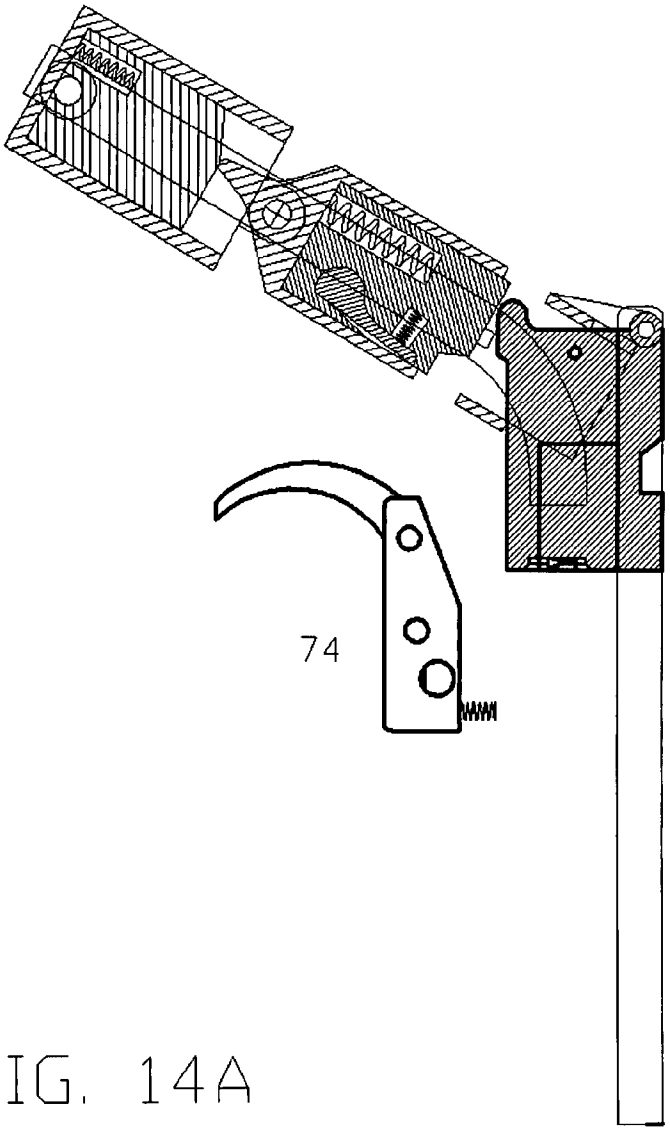
FIG. 14A shows the relative to the CONTROLLING FIRING MECHANISM SUBASSEMBLY schematic CUT OF A THREE MEMBER BOLT TRAIN WITH RECOIL DAMPER IN REARWARDS POSITION in a Particular embodiment.
Figure 14:
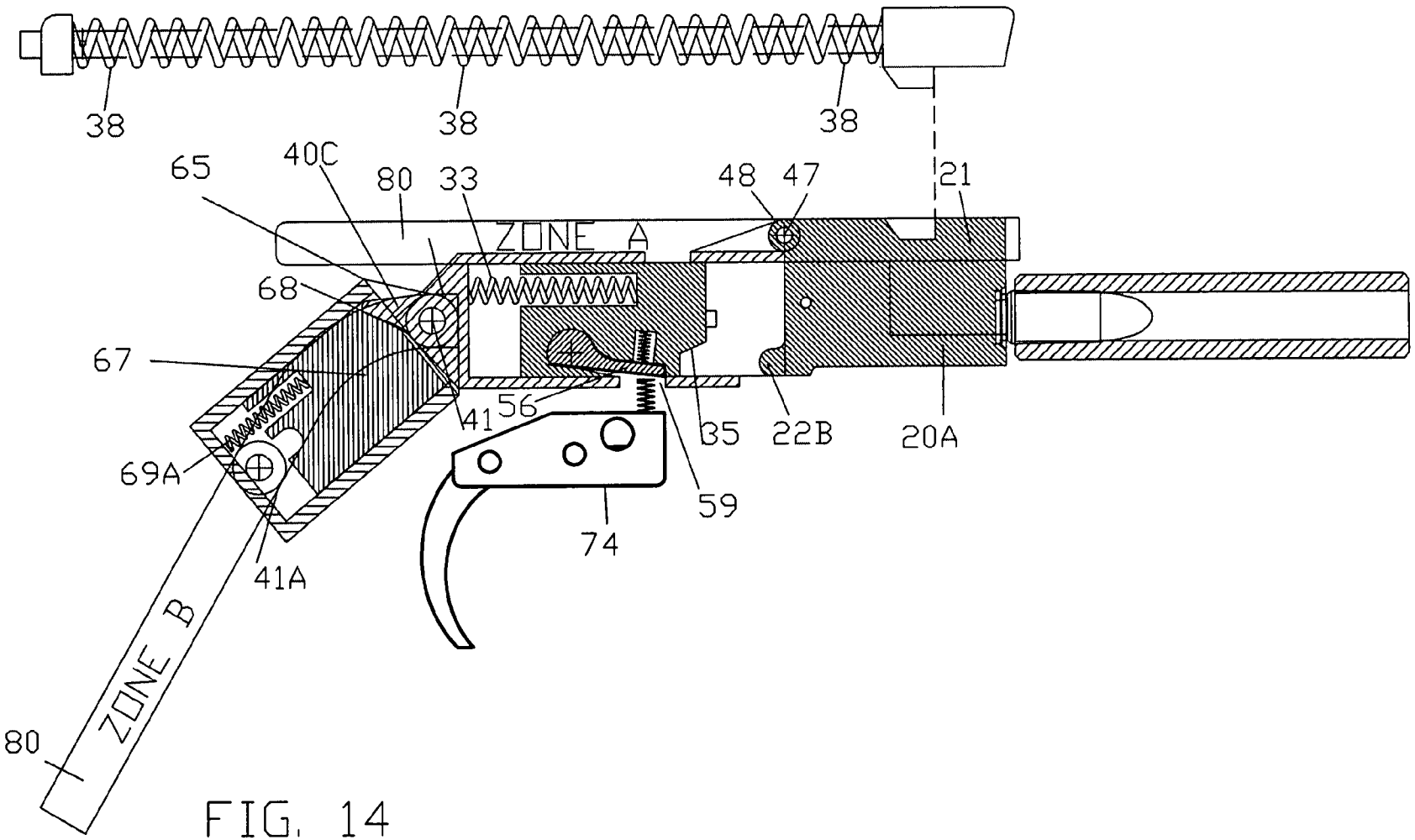
FIG. 14 shows the relative to the CONTROLLING FIRING MECHANISM SUBASSEMBLY schematic CUT OF A THREE MEMBER BOLT TRAIN WITH RECOIL DAMPER IN FOREWARD POSITION and the engagement of the set of main recovery springs with the Front Bolt in a Particular embodiment.
Figure 15:
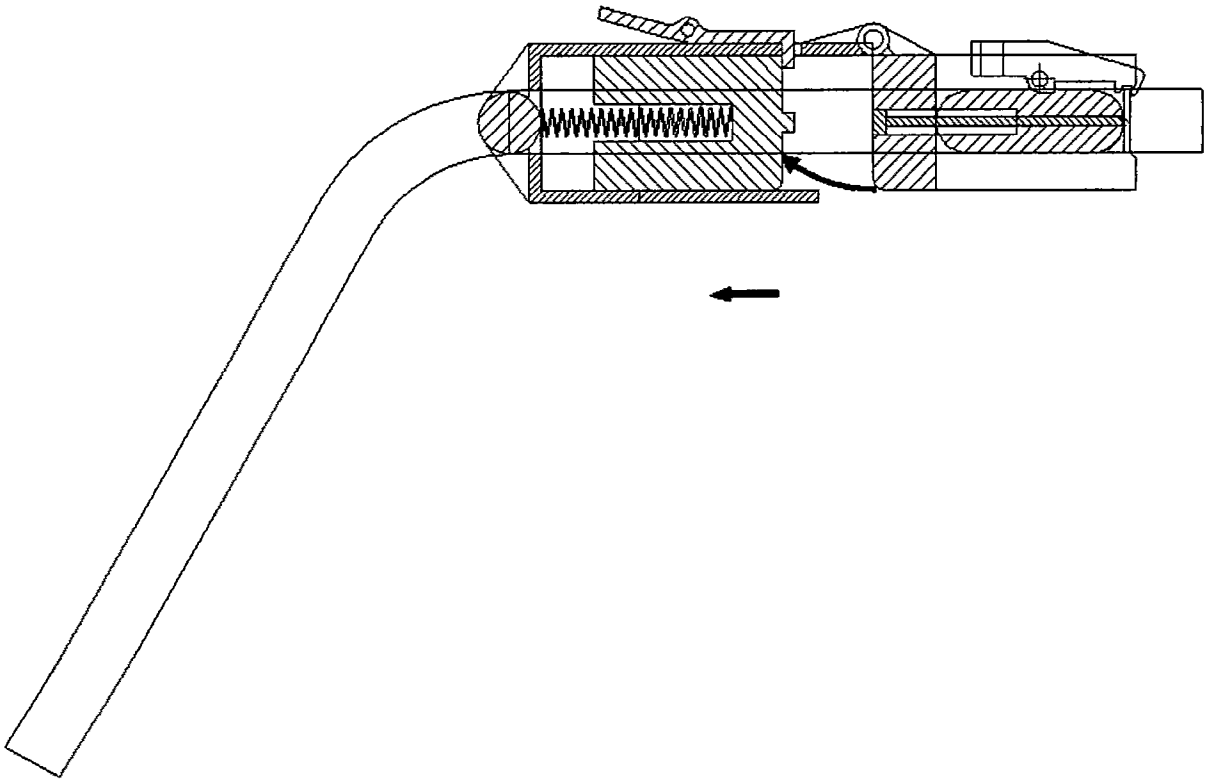
FIG. 15 shows a side cut view of the schematic OF THE BOLT TRAIN INTRUSION INTO THE MECHANISMS CARRIER HOUSING MOVING THE HAMMER rearwards when displacing rearwards and causing a rotation relative to the pivoting pin, in a Particular embodiment.
Figure 15A:
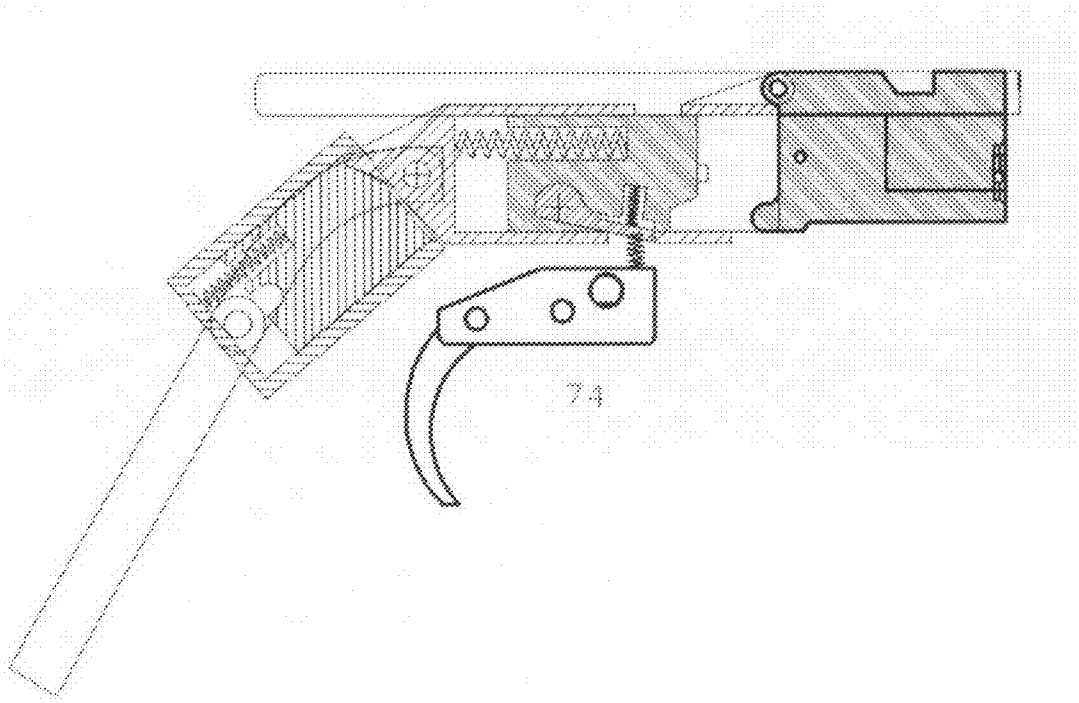
FIG. 15A shows a side cut view of the schematic OF A THREE MEMBER BOLT TRAIN IN FORWARD POSITION WITH INTERNAL SEAR ENGAGED relative to the CONTROLLING FIRING MECHANISM SUBASSEMBLY predetermined position, in a Particular embodiment.
Figure 16:
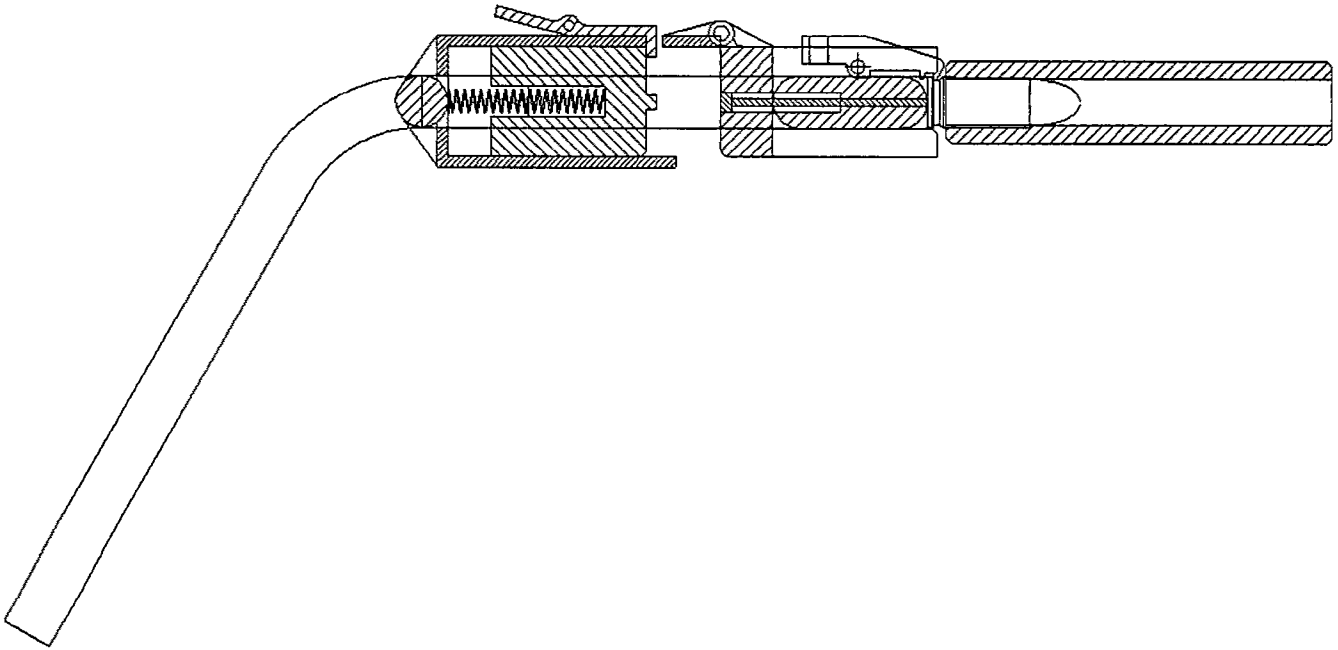
FIG. 16 shows a side cut view of the schematic OF BOLT AND MECHANISMS READY TO FIRE WITH BULLET in a Particular embodiment.

The rear of the mechanisms carrier housing 40 has two laterally protruding rod guides 41 or Roller guides 41 A on to the right, another to the left. They slide along the zone B see FIG. 11 of the Slot Channel guide 80; see FIG. 8. The zone B has a straight part and a curved part adjacent to the zone A. The mechanisms carrier housing 40 connected to the Front Bolt 20 by means of the hinges mechanisms housing carrier hinge 48 and bolt top hinge 24 as previously explained. The mechanisms carrier housing 40 pivots about the connecting pin 47 and connects it (40) with the front bolt 20, constituting on the whole the bolt train 90. The horizontal protruding guides 21 can move linearly inside the slot Channel guide 80 within the zone A FIG. 8. The front bolt 20 and the mechanisms carrier housing 40 are perfectly aligned when the protruding rod guides 41 and the horizontal protruding guides 21 are both in the zone A, This can happen in two situations: when The Bolt Train 90 is in cocked position as described in FIG. 15, and when bolt and firing mechanisms are in forward discharged position as described in FIG. 13. Every time those protruding rod guides 41 are in the zone B, the mechanisms carrier housing 40 and the front bolt 20 are at an angular position pivoting about the connecting pin 47 as shown in FIG. 14. Notice that FIG. 14 is at the extreme position since the horizontal protruding guides 21 is located at the end of zone A. The grouping of the active firing mechanism FIG. 5A inside mechanisms carrier housing 40, is defined as the Active Firing Mechanism Subassembly 39 FIG. 5B. When incorporated to the Bolt Train 90, makes the entire mass to displace when recoiling, fulfilling the purpose.

OPERATION

Description of How the Invention Achieves its Third Purpose

To provide a firing mechanism subassembly incorporated to the Bolt Train that cocks in response to the recoil displacement, and to the angular dislocation or misalignment of components of the bolt train while displacing rearwards following a transverse path.

In one embodiment the increasing displacement of the Articulated Bolt Train 90 in the rearward motion causes an increasingly divergent rotation of the Mechanism Carrier Housing 40 about pin 47, increasing the Angle of Articulation FIG. 17A.

The non parallel paths of zone A and zone B of the slot Channel guides 80 FIG. 10 and FIG. 10 A, forces the two members of the train to move in different directions crating an angle of articulation center at the top hinge 24, (PIN 47) that progressively increases as the parts displace more along the different paths.

The angle of articulation is defined as shown in FIG. 17A. Relative motions are described.

The cocking action of the firing mechanisms takes place in the following way. As the mechanisms carrier housing 40 starts to move through the zone B, FIG. 8, and FIG. 8A, it starts to rotate about the connecting pin 47, in a manner that the edge line 22A of the thin rear rectangular protrusion 22 describes a circular path about the connecting pin 47, and penetrates inside the rectangular cavity 40 A, occupied at this moment by the spring loaded hammer 30, and pushes the hammer 30 towards the back of the rectangular cavity 40A by sliding over the frontal face of the hammer 30. After the hammer 30 passes beyond the sear engagement point, rectangular hole for sear tip 45, the angular face tip 54 of the angular sear lever 50 moves inside the rectangular cavity 40A pushed by the force of the sear lever spring 53 blocking the path of the Hammer 30 and retaining the hammer 30 spring 33. When the bolt train 90 returns forward from the extreme rearward position, the angle of articulation FIG. 17A diminishes, the rear rectangular protrusion 22 moves back reducing the penetration inside the rectangular cavity 40A allowing the hammer 30 to move forward pushed by the force of the compressed spring only to the point that the front face of hammer 34 interferes and contacts the angular face tip 54 locking the firing mechanism in a cocked position. As the Bolt train 90 moves to the aligned position, the protruding rod guides 41 reach the zone A. At this point the hammer 30 is aligned with the front bolt 20 and the firing pin 70 located inside the cylindrical cavity for the firing pin 23. The firing action takes place when the angular sear lever 50 is depressed causing it to pivot about the pin for sear lever 46 raising the angular face tip 54 out of the way of the hammer 30 which moves forward impacting with the push rod of firing pin 32 the rear end of the firing pin 72, which causes the front end of firing pin 73 to strike the primer of the cartridge firing the projectile. On the front bolt 20 there is a rectangular slot 26 to host the placement of a cartridge case extractor 60 which pivots about the extractor pin 61. It is clear that the recoil force causes the displacement of bolt train 90 rearwards inducing an angular displacement of mechanisms carrier housing 40 and the front bolt 20 about the center of the top hinge 24, which produces the cocking of the active parts of the movable firing mechanism.

OPERATION

Description of How the Invention Achieves its Fourth Purpose

To provide a cam delay blowback opening mechanism to retard the opening of the breech.

Figure 13A:
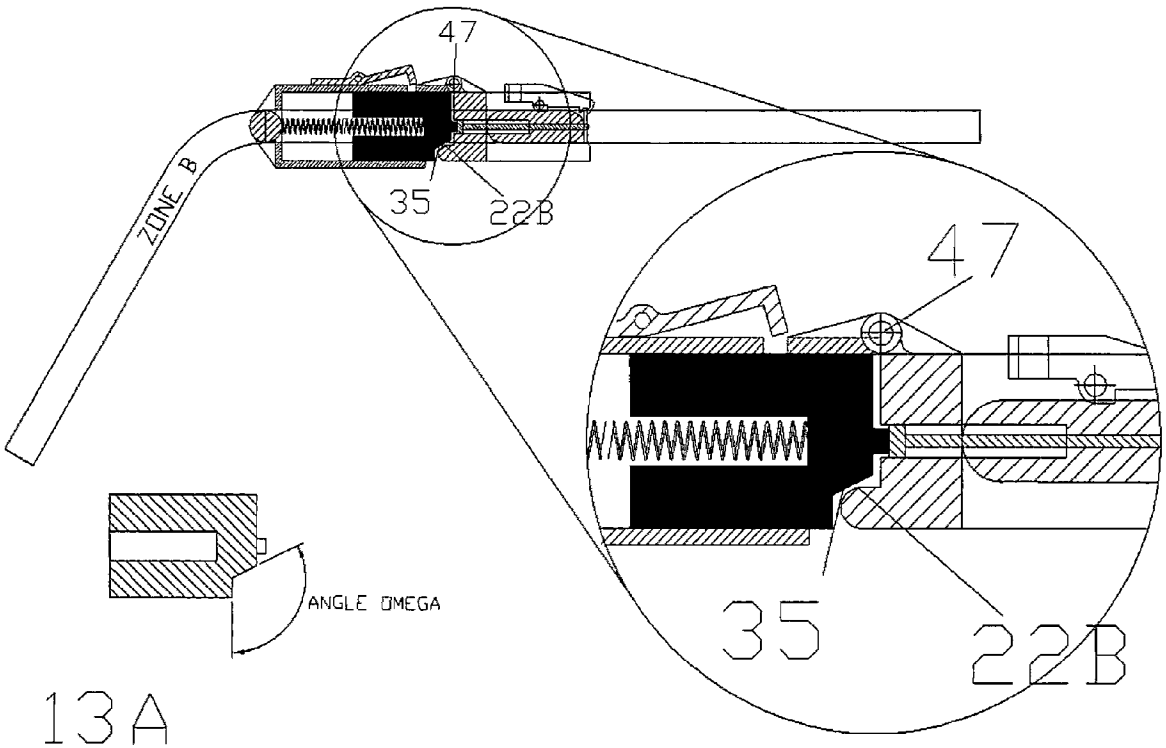
FIG. 13A shows a cut view of the interaction of parts PROTRUDING DELAY OPENING CAM and DELAY OPENING SLOPED FACE providing a DETAIL OF DELAY MECHANISM SCHEMATIC in a Particular embodiment.

In one embodiment, This invention achieves the purpose of creating a delay in the opening of the breech on the rearward motion by generating a restriction to the rearwards motion only, As the recoil force starts to build up it urges the bolt train 90 to move backwards as explained previously. The force opposing to that displacement is that of the main recovery spring of the firearm. An additional force opposing the displacement of the bolt train 90 is crated in the following manner: As the protruding rod guide (2) 41 slidably moves to zone B it starts to rotate about pin 47, as well as the mechanisms carrier housing 40 and the firing mechanisms contained within, causing the protruding delay opening cam 22B of FIG. 1A, 2A to describe a circular path about the center of the top hinge 24, moving inside the rectangular cavity 40A, contacting the delay opening sloped face 35 of front face of hammer 34 of FIG. 1A, 3A as shown in FIG. 13A. The hammer 30 is pushing foreword by the action of the hammer spring 33 of FIG. 1A with a force Fs. To overcome that force, the protruding delay opening cam 22B must exceed a value of force of the equation form F=Fs/cosine of Omega being Omega angle FIG. 3B the one formed by the plane of the front face of hammer 34 and delay opening sloped plane of face 35 as shown more explicitly in FIG. 13A. That is the value of the additional force created by this mechanism and depending on the spring force Fs and the value of the Omega angle FIG. 3B. Once the bolt train 90 progresses into the zone B, the value of that force diminishes as the angle of contact between the protruding delay opening cam 22B and the delay opening sloped face 35 becomes more favorable. The value of the axial force exerted by the front bolt 20 to exceed Fs/cosine of omega depends also of the distance of the protruding rod guide (2) 41 to the pin 47 and other matters. That significant force value is added to the force of the main recovery spring of the firearm, meaning that it will take more time to buildup in the explosion process inside the cartridge, translating into a delay in the opening of the bolt in the recoil. In order to ease the motion and to reduce friction, a roller cam may be used at the protruding delay opening cam 22B. Also rollers can be placed on the side of the hammer 30 in order to smooth the displacement and minimize wear.

OPERATION

Description of How the Invention Achieves its Fifth Purpose

To Significantly Reduce the Total Weight, and Volume of the Firearm Utilizing the Bolt Train Mechanism In one embodiment, this invention achieves the purpose by substituting the conventional fixed placed firing mechanisms by movable firing mechanisms, and placing them and its frame inside the mechanisms carrier housing 40, behind the Front bolt 20 converting then into a part of the Bolt train 90. The Articulated front Bolt 20 and mechanism carrier housing 40 with firing mechanism incorporated within substitutes the fixed conventional firing mechanisms eliminating the volume and weight that is normally dedicated to it, thus reducing substantially the volume and weight.

Figure 17B:
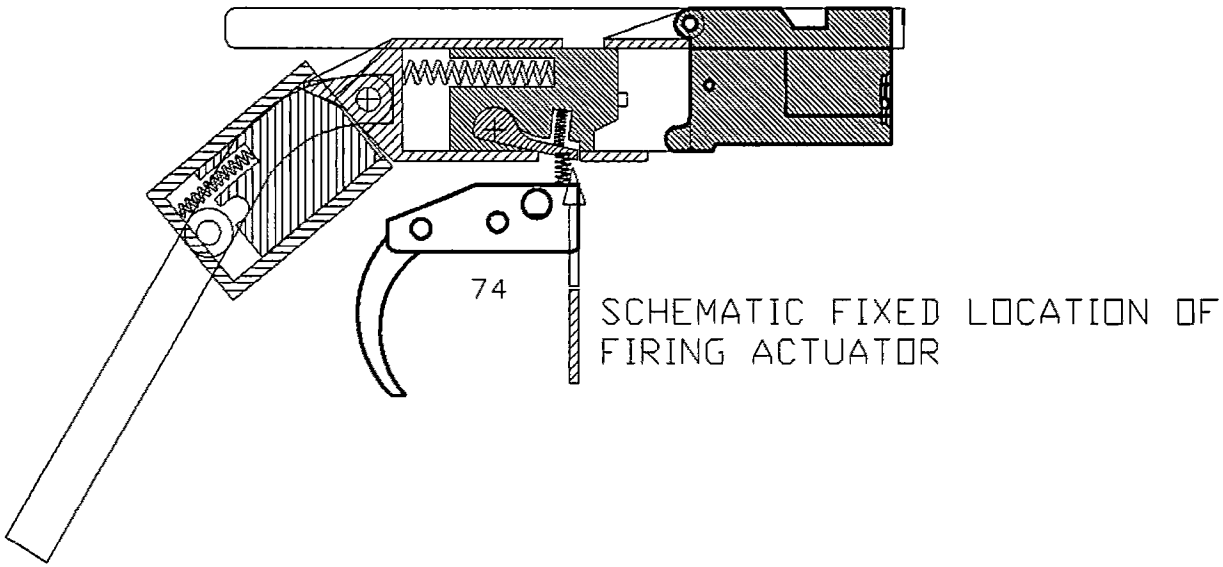
FIG. 17B shows a side cut view of the SCHEMATIC FIRING MECHANISMS PLACEMENT relative to an articulated bolt train having AN INTERNAL SEAR in a Particular embodiment.

The controlling firing mechanisms sub assembly 74 FIG. 5B, FIG. 5C, which comprises trigger, safe, automatic and semi automatic selector, require a small and light structural frame with small volume. It is placed in a convenient predetermined location with the only requirement that, a in order to fire, a pushing element belonging to the firing mechanism can exert a pushing action, to disengage, on the sear 50 or 58, at a unique fixed predetermined location that aligns with the traveler angular sear lever 50 every time that the bolt train 90 is in the full forward position. See FIG. 17. If an internal extruded sear 58 FIG. 5A is utilized, the pushing action of the controlling firing mechanism bar 78 is exerted through a Window Hole 59 of the Mechanism Carrier Housing 40 close to the engaging location of the cylindrical rod sear 58. When the bolt train 90 moves full forward closing the breech, the Window Hole 59 moves to a predetermined position aligning with the pushing bar 78 FIG. 17B of the stationary and compact controlling firing mechanism subassembly 74. This substitution of masses eliminates the volume and mass of the conventional firing mechanisms. The design purpose is possible by identifying masses that can perform dual functions and convert it into a mechanism that serves both functions. The mass present in the hammer, the sear, the mechanisms frame, the hammer spring is used by arranging it into a mechanism that is coupled to the bolt train 90 giving it the necessary mass that needs to be present in the bolt to absorb the recoil.

OPERATION

Description of How the Invention Achieves its Sixth Purpose

To lower the center of gravity of the firearms utilizing the Bolt Train 90 assembly.

In one embodiment, the very dense nature and slim profile of the Bolt Train 90 containing the Firing Mechanism enables the substitution of the conventional voluminous firing mechanisms as explained above and placing it in a predetermined location where it will align to interact with the miniature compact controlling firing mechanism subassembly 74, FIG. 5C placed in the closest proximity of the Window Hole 59. FIG. 17 B The compact size of the subassembly 73 makes it possible to lower the center of gravity.

OPERATION

Description of How the Invention Achieves its Seventh Purpose

To provide an independent Recoil Damper mechanism linkedly attachable to the Bolt Train sub assembly to additionally restrain the rearwards motion increasing the total delay.

Figure 11:
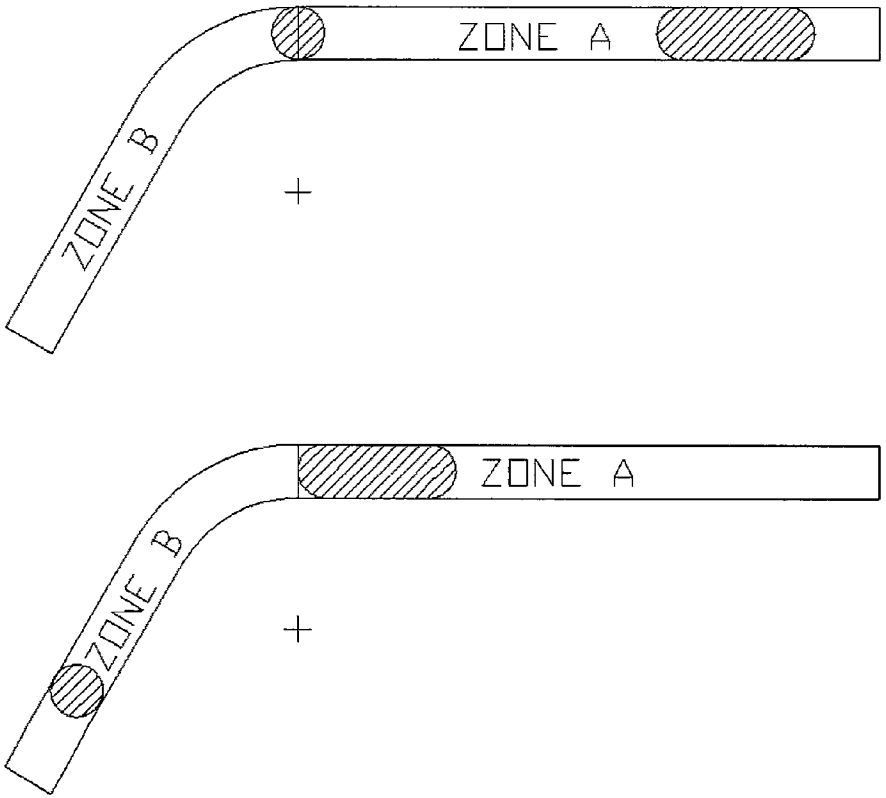
FIG. 11 shows the schematic placement of the lateral HORIZONTAL PROTRUDING GUIDE and lateral ROD GUIDE PATH OF THE CONTINUOUS GUIDES ON THE CHANNEL TRACK when the most forward position and in the most rearwards position in a Particular embodiment.
Figure 11A:
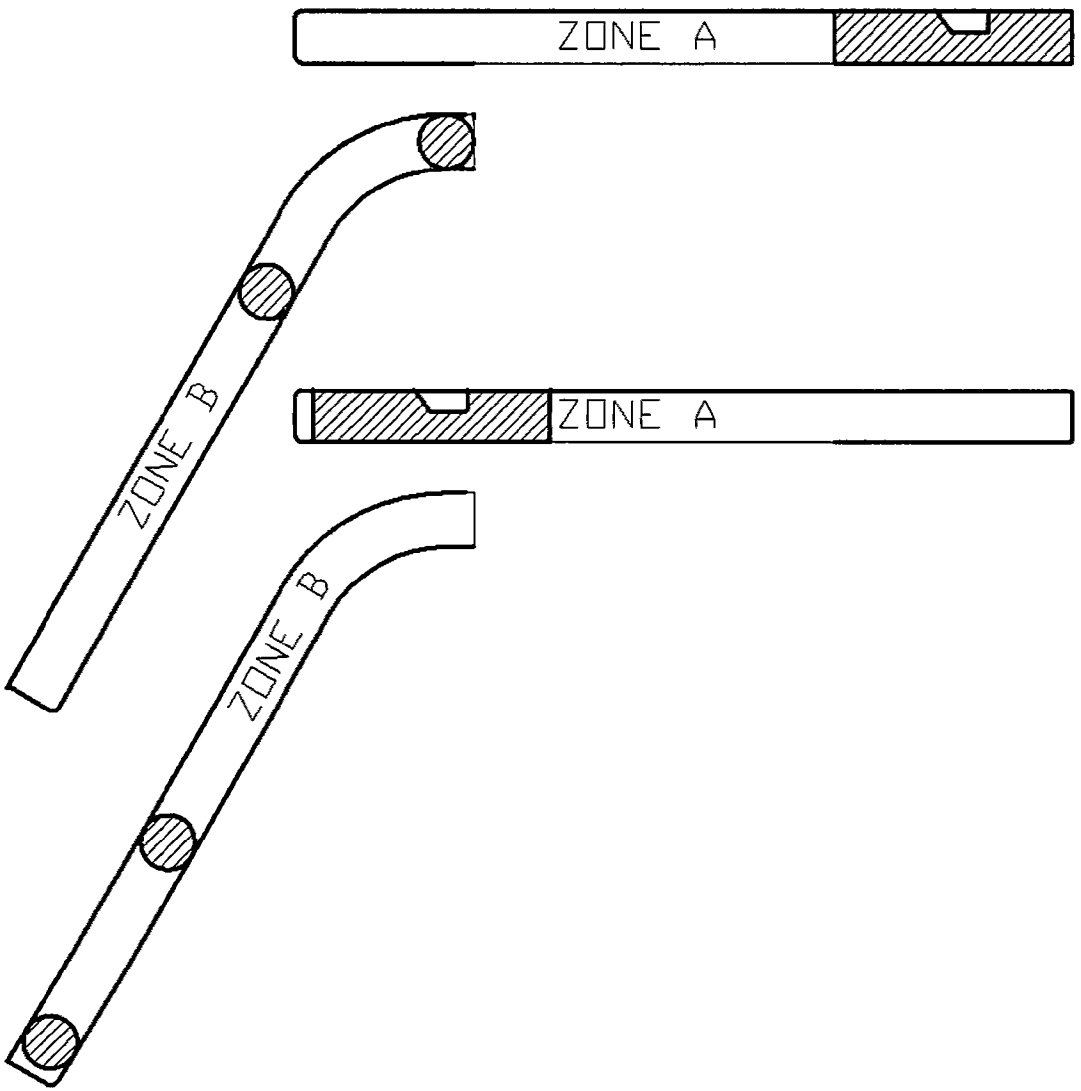
FIG. 11A shows the schematic placement of the lateral HORIZONTAL PROTUDING GUIDE and lateral ROD GUIDE PATH OF THE SEPARATE CHANNEL TRACK when the most forward position and in the most rearwards position in a Particular embodiment.
Figure 11B:
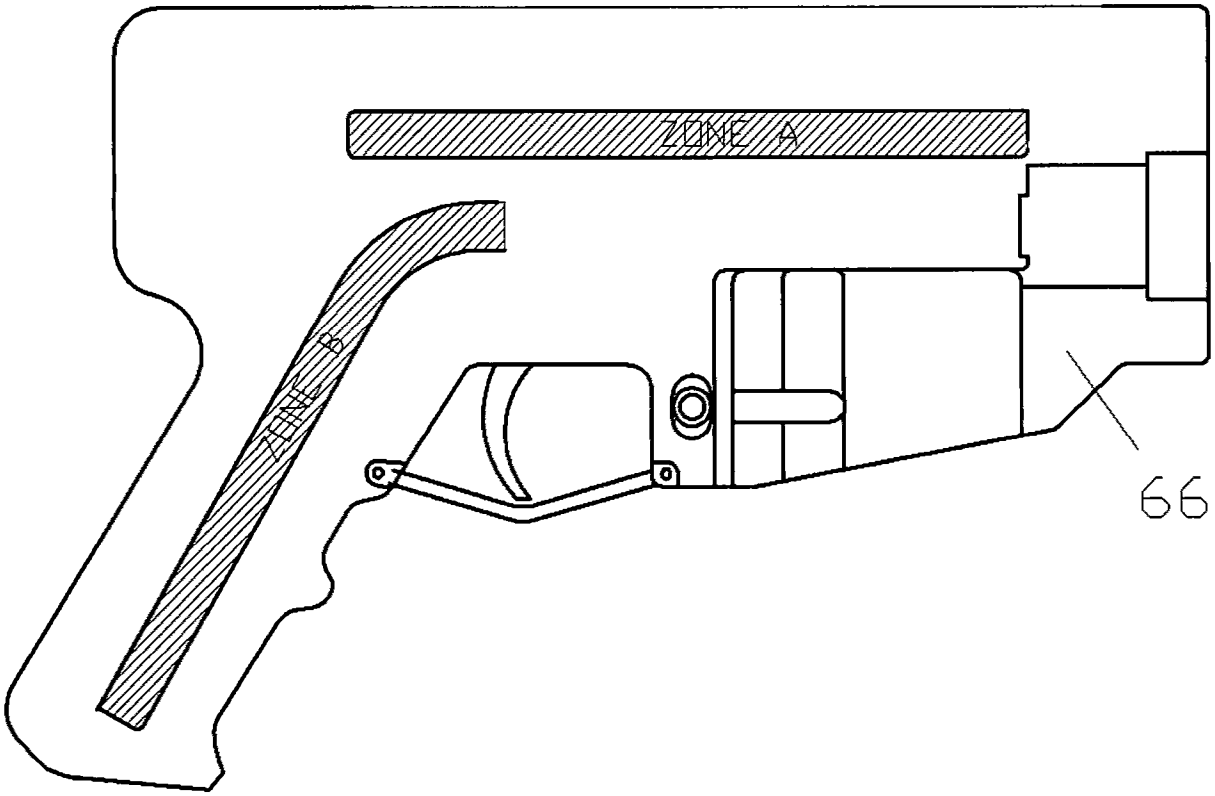
FIG. 11B shows the schematic placement of THE SEPARATE CHANNEL TRACK ON A RECEIVER in a Particular embodiment, wherein the Zone B of the track is located inside a tunnel located inside the of the receiver handle.
Figure 13B:
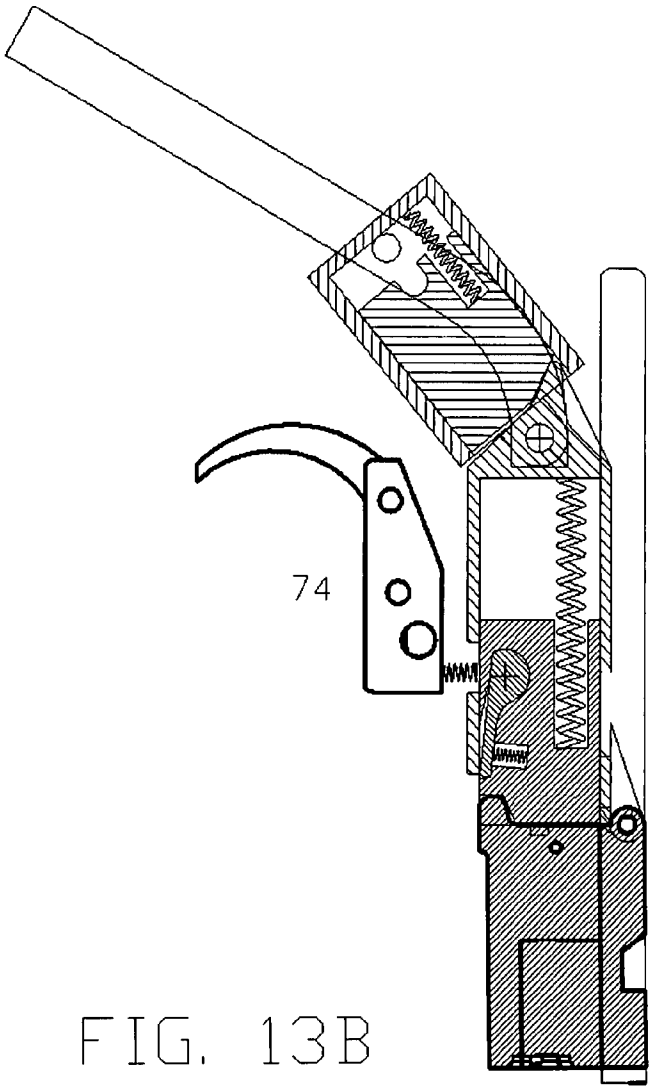
FIG. 13B shows the schematic CUT VIEW OF BOLT TRAIN WITH A THIRD MEMBER DELAY DAMPER relative to the CONTROLLING FIRING MECHANISM SUBASSEMBLY, when the Train is in the most forward position, in a Particular embodiment.

In one embodiment, when a third member, the Recoil Damper sub assembly 64 FIG. 4C is attached to the Bolt Train 90, it will be positioned at the rear behind of the mechanism carrier housing with rear cam 40B, and linked to it by means of roller with pin 41B passing through the centre hole of the two side hinges 65A and the rear center hole of the mechanism carrier housing with rear cam 40B. The mechanisms carriage housing 40B has a protruding cam 40C that penetrates through the front of the cavity for compensator 66 where the compensator 67 slides freely pushed by the spring 69A. As the Bolt Train 90 moves rearwards, the mechanism carrier housing with rear cam 40B and the Recoil Damper sub assembly 64, initially at an angle, move into a straighter path to align with the transverse axis of the ZONE B FIG. 11A, FIG. 13B and FIG. 14A by pivoting about the Roller with pin 41B. This relative rotation causes the tip of the Protruding cam 40C to describe a circular path inside the cavity for compensator 66 and to slide against the front Angular Face 68 of the Movable Compensator 67, displacing it to the interior of the Recoil damper mechanism carrier 65 and compressing the spring 69A. The action of compressing the spring 69A and pushing the Movable Compensator 67 back at an angle requires a force that opposes to the rearward displacement of the Bolt Train 90 and necessarily delays the opening of the breech, creating an additional retard. It is a kinetic energy storing and absorption device.

Figure 20:
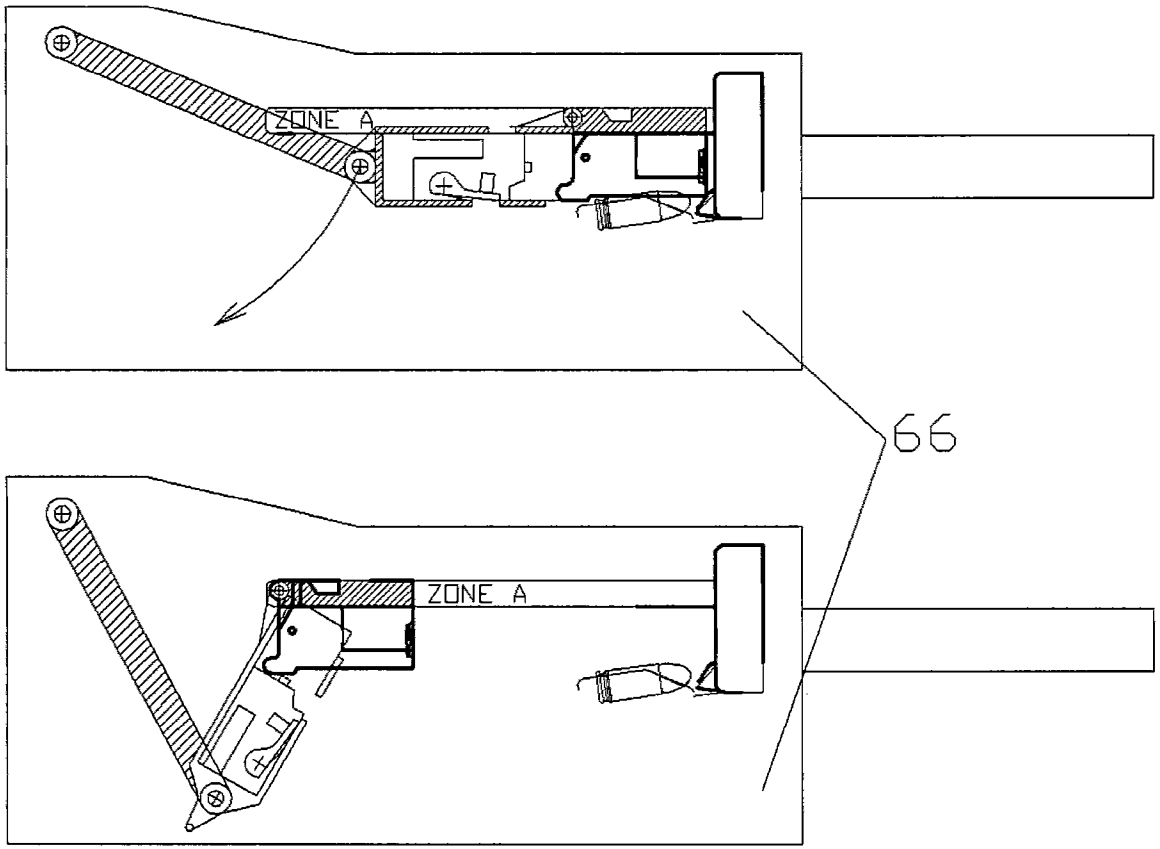
FIG. 20 shows a schematic view of the ALTERNATE METHOD OF DISPLACING THE BOLT TRAIN SUBASSEMBLY BY BARS in a Particular embodiment.
Figure 21:
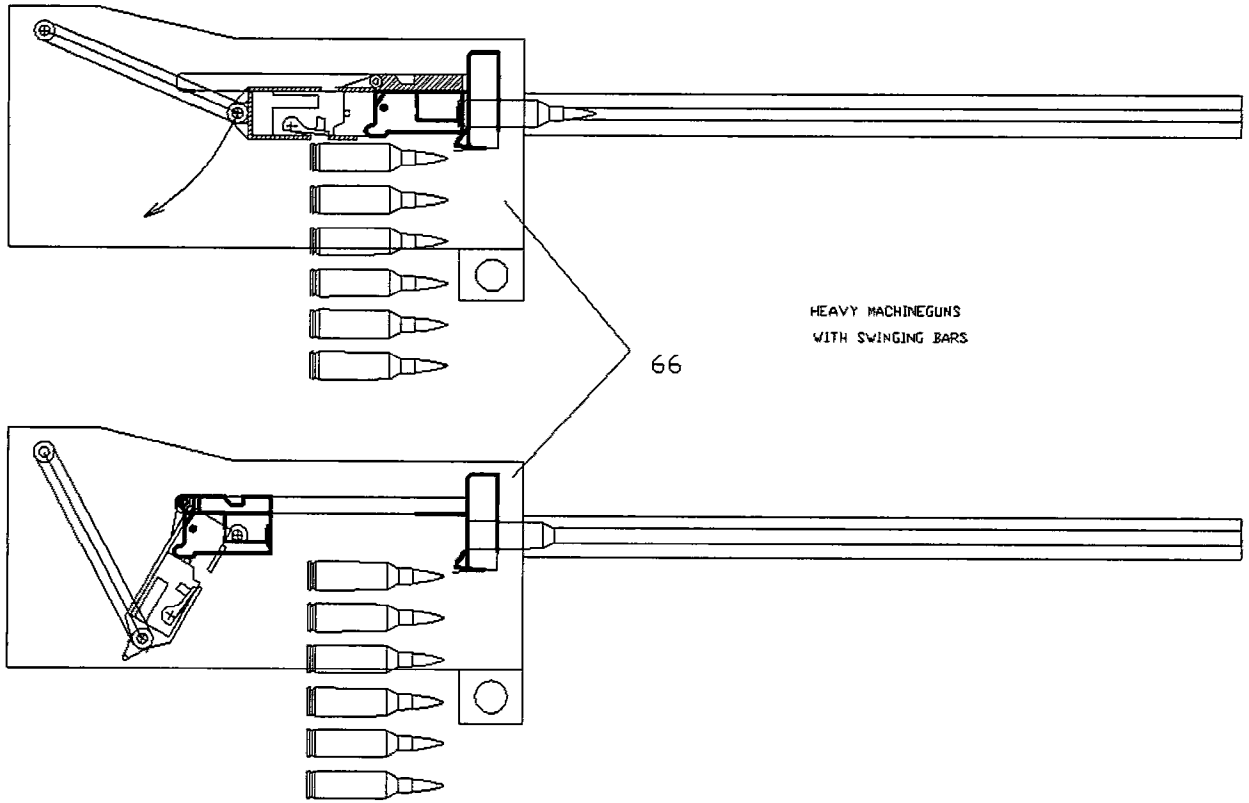
FIG. 21 shows a schematic view of the POSSIBLE USES OF THE BOLT TRAIN IN MACHINE GUN BELT FED in a Particular embodiment.

Alternative Embodiments a. This invention presents a linearly displacing hammer. Similar results in terms of recoil absorption can be obtained by placing a compact array of firing mechanisms with conventional rotary parts behind the front bolt as a part of another type of traveling mechanisms carriage, however it would require more volume, which defeats the purpose of accommodating the traveling mechanisms in a tight space such as the inside of the handgrip.

b. Additional recoil absorption can be achieved by placing conventional shock absorbers, hydraulic or pneumatic, rubber pads at the end of the cavity that receives the mechanisms carrier housing 40. Elastomeric shock absorber can be placed to additionally abate the recoil by allowing the recoiling mechanisms carrier housing 40 stop against them.

c. Neither the mechanisms carrier cavity 40A, the hammer 30, nor the mechanism carriers housing 30 are necessarily rectangular. They are of the convenient shape to accommodate a convenient shaped hammer.

d. FIG. 3B Shows a simpler design of the hammer that incorporates the sear and the sear spring as an integral part of the hammer 30. This locking action takes place internally when the sear angular face 36 moves into the rectangular hole 45B of FIG. 4A at the force of the sear flat spring 37, enabling the elimination of parts numbers 42, 43, 44, 46 50,51, 52,53, 54. Such simpler design of the hammer also makes possible to use a mechanisms carrier housing 40 as shown in FIG. 4B.

e. Slot channel guides 80 are used in this description of the operation, however, other different methods to guide and control the path of the mechanisms may be used without affecting the novelty of this patent invention f. To enhance compactness, the Slot Channel Guides 80 have been shown to be located inside the handle or grip, however, its placement in any other convenient location and with a suitable direction can be used to attain the desired result of recoil management or trimming.

g. FIG. 3C Shows a compact design of the hammer that incorporates an internal articulated toggle internal sear 56 and in a similar way to the latter explained mechanism, has the same benefits, with the advantage of being able to tune the trigger pull sensitivity by using different strength of the toggle internal sear spring 55.

h. A similar active firing mechanism to the one described in this application can be developed to be placed in the Front Bolt location, and operating under the same principles of dislocation of the two main components of the Bolt Train. In this way, the Front Bolt becomes a "Front Bolt and active Firing Mechanisms Carriage Housing", with active firing mechanisms inside, and the mechanisms carrier housing 40, becomes just a mass with the convenient shape and size. The hammer can integrate with the firing pin, in one sole part.

i. Similar results cad be obtained by substituting the transverse slot Channel tracks that urge the displacement, by articulated bar plates of proper length or plates in which one end of the bar is hinged about a fixed position on the receiver, and at the other end is articulated to a hinge placed at the back of Firing Mechanisms Carriage Housing 40, See FIG. 20, forcing a semi circular motion of the rear end of the Firing Mechanisms Carriage Housing 40.

j. The channel slotted guides can be embedded, stamped, machined slotted in the receiver or separately manufactured and properly attached to the receiver.

k. The receiver 66 can be manufactured by several different processes; machined, stamped, injected, metal injection molding etc; in clam shells, upper and lower receivers, with the condition that when assembled, it will define some cavities and track slots, to accept the necessary parts and subassemblies for its proper functioning.

l. The cocking handle can be placed acting directly on the front bolt or as a part of a bar actuated bi by a direct drive gas piston system.

m. A direct drive gas piston system can be used to push back the articulated bolt train upon firing the firearm.

n. When the articulated bolt train is used with large sized projectiles the gun can be fitted with an electric device to assist the drive.

o. The sear can engage in many ways, as long as it locks against the firing mechanisms carriage housing 40, holding the hammer back inside the carriage spring loaded.

p. It is possible to trim, both, the trigger pull, and the trigger travel by placing threaded holes inside the Hammer 30, at the upper side, and the lower side of the cavity that hosts the sear. By placing a spring against the upper part of the seat, exerting trim able force controlled by the displacement of a trimming screw at the opposite side of the threaded hole. The trigger travel is controllable by placing a trim able screw acting over the lower side of the sear, limiting the sear travel to engage, and consequently

CONCLUSION, RAMIFICATIONS AND SCOPE

Accordingly, the reader will see that firearms described in one out of the several possible embodiments, will be improved in numerous ways in terms of ergonomy, comfort, recoil control, ease of manufacture, ease to serve, size of the weapon, weight of the weapon, stability, appearance, cost, consealability, and safety due to the simplified technology herein described.

The utilization of composite polymers, carbon fibers and modern manufacturing processes is compatible with the weapons using the present invention.

The potential use of This invention is abundant in nearly all categories of semi and full automatic guns for civilian and military purposes crating a noble class of weapons. Implications in defense are immediate due to the advantages exposed.

What is claimed is:

1. A firearm comprising a barrel end, a back end opposite said barrel end, a trigger mechanism, at least one internal channel guide having a front end and a back end such that said front end is closer to said barrel end than said channel guide back end and including a front horizontal zone and a back zone including an angled or curved portion leading to a horizontal portion adjacent said front horizontal zone, and a pivotally articulated bolt train subassembly having at least one head bolt component and at least one active firing mechanism carriage component housing at least one sear lever, wherein said at least one head bolt component is situated within said at least one internal channel guide in front of said at least one active firing mechanism carriage component such that said head bolt and said active firing mechanism carriage component are consecutively and pivotally connected and disposed within said internal channel guide, wherein said head bolt component is situated within and is movable solely in a straight plane within said front horizontal zone of said internal channel guide, wherein said active firing mechanism carriage component is situated within and is movable in the plane of said front horizontal zone of said internal channel guide and in the plane of said angled or curved portion of said back zone, and wherein said firearm is selected from the group consisting of automatic and semiautomatic firearms.

2. The firearm of claim 1 wherein said articulated bolt train subassembly moves within said at least one internal channel guide in relation to activation of said trigger mechanism, wherein said bolt train moves to the foremost front of said internal channel guide prior to activation of said trigger mechanism and then moves to the rearmost back of said internal channel guide upon activation of said trigger mechanism.

3. The A method of firing the firearm of claim 1 comprising the steps of:

a) providing said firearm;

b) priming said firearm, thereby manipulating said bolt train subassembly in position with said head bolt component situated at the foremost front of said internal channel guide; and c) activating said trigger mechanism, thereby causing said bolt train subassembly to move backward through said internal channel guide, wherein said head bolt component remains within said horizontal zone component of said internal channel guide throughout said firing of said firearm.

4. The firearm of claim 1 wherein said bolt train subassembly includes at least one recoil damper component pivotally connected to said at least one active firing mechanism carriage component and is situated closer to said back end of said internal channel guide.

5. The firearm of claim 2 wherein said bolt train subassembly includes at least one recoil damper component pivotally connected to said at least one active firing mechanism carriage component and is situated closer to said back end of said internal channel guide.

6. A method of firing the firearm of claim 2 comprising the steps of:

a) providing said firearm;

b) priming said firearm, thereby manipulating said bolt train subassembly in position with said bolt head component situated at the foremost front of said internal channel guide; and c) activating said trigger mechanism, thereby causing said bolt train subassembly to move backward through said internal channel guide, wherein said head bolt component remains within said horizontal zone component of said internal channel guide throughout said firing of said firearm.

7. A method of firing the firearm of claim 4 comprising the steps of:

a) providing said firearm;

b) priming said firearm, thereby manipulating said bolt train subassembly in position with said bolt head component situated at the foremost front of said internal channel guide; and c) activating said trigger mechanism, thereby causing said bolt train subassembly to move backward through said internal channel guide, wherein said head bolt component remains within said horizontal zone component of said internal channel guide throughout said firing of said firearm.

8. A method of firing the firearm of claim 5 comprising the steps of:

a) providing said firearm;

b) priming said firearm, thereby manipulating said bolt train subassembly in position with said bolt head component situated at the foremost front of said internal channel guide; and c) activating said trigger mechanism, thereby causing said bolt train subassembly to move backward through said internal channel guide, wherein said head bolt component remains within said horizontal zone component of said internal channel guide throughout said firing of said firearm.

* * * * *